US009671108B2

(12) United States Patent
Matsumoto et al.

(10) Patent No.: US 9,671,108 B2
(45) Date of Patent: Jun. 6, 2017

(54) COMBUSTION BURNER, SOLID-FUEL-COMBUSTION BURNER, SOLID-FUEL-COMBUSTION BOILER, BOILER, AND METHOD FOR OPERATING BOILER

(75) Inventors: Keigo Matsumoto, Tokyo (JP); Kazuhiro Domoto, Tokyo (JP); Naofumi Abe, Tokyo (JP); Jun Kasai, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 635 days.

(21) Appl. No.: 14/007,858

(22) PCT Filed: Mar. 7, 2012

(86) PCT No.: PCT/JP2012/055850

§ 371 (c)(1),
(2), (4) Date: Sep. 26, 2013

(87) PCT Pub. No.: WO2012/137573

PCT Pub. Date: Oct. 11, 2012

(65) Prior Publication Data

US 2014/0011141 A1 Jan. 9, 2014

(30) Foreign Application Priority Data

Apr. 1, 2011 (JP) ..... 2011-081876
Apr. 1, 2011 (JP) ..... 2011-081877
(Continued)

(51) Int. Cl.
*F23D 1/00* (2006.01)
*F23L 9/00* (2006.01)
(Continued)

(52) U.S. Cl.
CPC ..... *F23D 1/005* (2013.01); *F23C 5/32* (2013.01); *F23C 6/045* (2013.01); *F23D 1/00* (2013.01);
(Continued)

(58) Field of Classification Search
CPC .... F23C 5/32; F23C 6/045; F23D 1/00; F23D 1/005; F23D 2201/10; F23L 9/00; F23N 3/00
(Continued)

(56) References Cited

U.S. PATENT DOCUMENTS 4,428,727 A 1/1984 Deussner et al.
4,622,922 A 11/1986 Miyagaki et al.
(Continued)

FOREIGN PATENT DOCUMENTS

EP 0 650 013 A1 4/1995
JP 58-198606 A 11/1983
(Continued)

OTHER PUBLICATIONS

Office Action dated May 12, 2015, issued in counterpart Japanese Patent Application No. 2011-081877, with English translation (3 pages).
(Continued)

*Primary Examiner* — Kenneth Rinehart
*Assistant Examiner* — Logan Jones
(74) *Attorney, Agent, or Firm* — Westerman, Hattori, Daniels & Adrian, LLP

(57) ABSTRACT

Provided is a combustion burner including: a fuel nozzle (51) that is able to blow a fuel gas obtained by mixing pulverized coal with primary air; a secondary air nozzle (52) that is able to blow secondary air from the outside of the fuel nozzle (51); a flame stabilizer (54) that is provided at a front end portion of the fuel nozzle (51) so as to be near the axis
(Continued)

center; and a rectification member (55) that is provided between the inner wall surface of the fuel nozzle (51) and the flame stabilizer (54), wherein an appropriate flow of a fuel gas obtained by mixing solid fuel with air may be realized.

2 Claims, 31 Drawing Sheets

(30) Foreign Application Priority Data

| | | |
|---|---|---|
| Apr. 1, 2011 | (JP) | 2011-081879 |
| Jun. 22, 2011 | (JP) | 2011-138563 |
| Jun. 22, 2011 | (JP) | 2011-138564 |

(51) Int. Cl.
*F23N 3/00* (2006.01)
*F23C 5/32* (2006.01)
*F23C 6/04* (2006.01)

(52) U.S. Cl.
CPC ..... *F23L 9/00* (2013.01); *F23N 3/00* (2013.01); *F23C 2201/20* (2013.01); *F23D 2201/10* (2013.01); *F23D 2201/101* (2013.01); *F23D 2201/20* (2013.01); *F23D 2209/20* (2013.01); *F23K 2203/201* (2013.01); *F23N 2021/10* (2013.01)

(58) Field of Classification Search
USPC ..... 431/12; 110/188, 234, 265
See application file for complete search history.

(56) References Cited

U.S. PATENT DOCUMENTS

| | | | | |
|---|---|---|---|---|
| 4,634,054 | A | 1/1987 | Grusha | |
| 5,152,051 | A | 10/1992 | Folk et al. | |
| 5,685,242 | A * | 11/1997 | Narato | F23C 6/047 110/104 B |
| 5,764,535 | A | 6/1998 | Okazaki et al. | |
| 6,058,855 | A | 5/2000 | Ake et al. | |
| 2005/0120927 | A1 | 6/2005 | Okazaki et al. | |
| 2006/0115779 | A1 | 6/2006 | Yamamoto et al. | |
| 2009/0277364 | A1 * | 11/2009 | Donais | F23C 7/008 110/263 |
| 2010/0224108 | A1 | 9/2010 | Kamikawa et al. | |

FOREIGN PATENT DOCUMENTS

| | | | |
|---|---|---|---|
| JP | 60-78207 | A | 5/1985 |
| JP | 60-171307 | A | 9/1985 |
| JP | 60-263014 | A | 12/1985 |
| JP | 62-0039112 | | 3/1987 |
| JP | S6298114 | A | 5/1987 |
| JP | 62-288406 | A | 12/1987 |
| JP | H0167440 | U | 4/1989 |
| JP | 01-217109 | A | 8/1989 |
| JP | H01217110 | A | 8/1989 |
| JP | 02-17305 | A | 1/1990 |
| JP | 08-135919 | A | 5/1996 |
| JP | 08-200618 | A | 8/1996 |
| JP | 08-296815 | A | 11/1996 |
| JP | 09-112820 | A | 5/1997 |
| JP | 09-170714 | A | 6/1997 |
| JP | 9-196310 | A | 7/1997 |
| JP | 3-203505 | A | 8/1997 |
| JP | 9-203505 | A | 8/1997 |
| JP | 09-203505 | A | 8/1997 |
| JP | 10-38217 | A | 2/1998 |
| JP | 10-220707 | A | 8/1998 |
| JP | 11-281010 | A | 1/1999 |
| JP | 11-132414 | A | 5/1999 |
| JP | 11-281010 | A | 10/1999 |
| JP | 3009370 | B2 | 2/2000 |
| JP | 2000205556 | A | 7/2000 |
| JP | 3073396 | B2 | 8/2000 |
| JP | 2002-228107 | A | 8/2002 |
| JP | 2003-279006 | A | 10/2003 |
| JP | 2005-273973 | A | 10/2005 |
| JP | 2006-057903 | A | 3/2006 |
| JP | 2006-189188 | A | 7/2006 |
| JP | 2007-107849 | A | 4/2007 |
| JP | 2008-145007 | A | 6/2008 |
| JP | 2009-204256 | A | 9/2009 |
| JP | 2010-139180 | A | 6/2010 |
| JP | 2010-139182 | A | 6/2010 |
| JP | 2010-270990 | A | 12/2010 |
| JP | 2010-270991 | A | 12/2010 |
| JP | 2010-270992 | A | 12/2010 |
| JP | 2010-270993 | A | 12/2010 |
| UA | 100490 | C2 | 1/2013 |
| WO | 02/12791 | A1 | 2/2002 |
| WO | 2011/074281 | A1 | 6/2011 |
| WO | 2011/077762 | A1 | 6/2011 |

OTHER PUBLICATIONS

Decision of a Patent Grant dated Nov. 10, 2015, issued in counterpart Japanese Application No. 2011-081879, with English translation. (4 pages).
Office Action dated Nov. 18, 2014, issued in corresponding Japanese Patent Application No. 2011-081879, with English Translation (5 pages).
Notice of Allowance dated Nov. 18, 2014, Issued in corresponding Japanese Patent Application No. 2011-081876 (3 pages).
Korean Notice of Allowance dated Nov. 17, 2014, issued in corresponding KR Application No. 10-2013-7025379 with English partial translation (3 pages).
Decision of a Patent Grant dated Dec. 31, 2015, issued in counterpart Taiwanese Patent Application No. 101110593, with English translation. (4 pages).
Decision of a Patent Grant dated Jan. 22, 2016, issued in counterpart Korean Patent Application No. 2015-7014776, with English translation. (5 pages).
Decision of a Patent Grant dated Feb. 9, 2016, issued in counterpart Japanese Patent Application No. 2014-256698, with English translation, (5 pages).
English translation of the Written Opinion of PCT/JP2012/055850, mailing date of Jun. 19, 2012 (13 pages).
Extended (Supplementary) European Search Report dated Feb. 12, 2016, issued in counterpart European Patent Application No. 15185735.6. (7 pages).
Extended (Supplementary) European Search Report dated Feb. 12, 2016, issued in counterpart European Patent Application No. 15185737.6. (7 pages).
Extended (Supplementary) European Search Report dated Feb. 18, 2016, issued in counterpart European Patent Application No. 15185738.0. (8 pages).
Extended (Supplementary) European Search Report dated Feb. 22, 2016, issued in counterpart European Patent Application No. 15185739.8. (8 pages).
Ukraine Notice of Allowance dated Apr. 26, 2016, issued in counterpart Ukraine Patent Application No. a201311324, with English translation. (10 pages).
Notice of Allowance dated Apr. 30, 2015, issued in counterpart Korean Patent Application No. 10-2014-7030042, w/English translation (4 pages).
Notice of Allowance dated Jun. 15, 2015, issued in counterpart Korean Patent Application No. 10-2014-7030038, w/English translation (4 pages).
Notice of Allowance dated Jun. 23, 2015, issued in counterpart Korean Patent Application No. 10-2015-7014656, w/English translation (4 pages).
Office Action dated Jun. 9, 2015, isseud in counterpart Japanese application No. 2011-138564 (w/English translation) (5 pages).
Office Action dated Jun. 9, 2015, issued in counterpart Japanese application No. 2011-138563 (w/English translation) (5 pages).

(56) References Cited

OTHER PUBLICATIONS

International Search Report dated Jun. 19, 2012, issued in corresponding application No. PCT/JP2012/055850.
Written Opinion dated Jun. 19, 2012, issued in corresponding application No. PCT/JP2012/055850.
Partial Supplementary European Search Report dated Jun. 29, 2015, issued in counterpart European Patent Application No. 12 768 148.4 (6 pages).
Office Action dated Jun. 30, 2015, issued in counterpart Malaysian Patent Application No. P12013701752 (4 pages).
Notification of Completion of Formalities for Registration and the Notification of Grant of Invention Patent Right dated Aug. 27, 2015, issued in counterpart Chinese Patent Application No. 201280014605.5, with English translation (4 pages).
Korean Office Action dated Aug. 25, 2014, issued in corresponding Korean Application No. 10-2013-7025379; w/English Translation. (11 pages).
Office Action dated Sep. 15, 2015, issued in counterpart Japanese Application No. 2014-256698, with English translation. (11pages).
Notice of Allowance dated Dec. 10, 2014, issued in Korean Application No. 10-2014-7030040, w/English translation. (4 pages).
Office Action dated May 17, 2016, issued in counterpart Japanese Patent Application No. 2015-118581, with English translation. (9 pages).
Ukraine Notice of Allowance dated Oct. 24, 2016, issued in counterpart Ukraine Patent Application No. A 2015 12225, with English translation. (9 pages).
Ukraine Notice of Allowance dated Nov. 24, 2016, issued in counterpart Ukraine Patent Application No. A 2015 12221, with English translation. (12 pages).
Mexican Notice of Allowance dated Nov. 4, 2016, issued in counterpart Mexican Patent Application No. MX/a/2013/011125. (1 page).
Office Action dated Nov. 8, 2016, issued in counterpart Japanese Patent Application No. 2015-118581, with English machine translation. (5 pages).
Notice of Allowance dated Dec. 28, 2016, issued in counterpart Ukrainian application No. 2015 12222, with English translation (13 pages).
Notice of Allowance dated Dec. 28, 2016, issued in counterpart Ukrainian application No. 2015 12223, with English translation. (12 pages).

* cited by examiner (a)

(b)

(a)

(b)

(a)

(b)

COMBUSTION BURNER, SOLID-FUEL-COMBUSTION BURNER, SOLID-FUEL-COMBUSTION BOILER, BOILER, AND METHOD FOR OPERATING BOILER

FIELD

The present invention relates to a combustion burner that is applied to a boiler for producing steam to be used to generate electric power or to be used in a factory or the like. For example, the combustion burner is a solid-fuel-combustion burner that burns solid fuel (pulverized fuel) such as pulverized coal. Also, the invention relates to a solid-fuel-combustion boiler, a boiler that produces steam by burning solid fuel and air, and a method for operating the boiler.

BACKGROUND

For example, a conventional pulverized-coal-combustion boiler includes a furnace which is formed in a hollow shape and is provided in the vertical direction, and plural combustion burners are disposed in a furnace wall in the circumferential direction and are disposed at plural stages in the up and down direction. A fuel-air mixture obtained by mixing primary air with pulverized coal (fuel) formed by milling coal is supplied to the combustion burners, and hot secondary air is supplied to the combustion furnaces so that the fuel-air mixture and the secondary air blow into the furnace. Accordingly, a flame is generated, and hence the fuel-air mixture may be burned inside the furnace by the flame. Then, a flue gas duct is connected to the upper portion of the furnace, and the flue gas duct is equipped with a superheater, a repeater, an economizer, and the like for collecting the heat of a flue gas. Thus, steam may be produced by the heat exchange between water and the flue gas produced by the combustion in the furnace.

As such a pulverized-coal-combustion boiler or such a combustion burner, for example, pulverized-coal-combustion boilers or combustion burners disclosed in Patent Literatures below are known.

CITATION LIST

Patent Literature

Patent Literature 1: Japanese Laid-open Patent Publication No. 08-135919

Patent Literature 2: Japanese Laid-open Patent Publication No. 2006-189188

Patent Literature 3: Japanese Laid-open Patent Publication No. 8-296815

Patent Literature 4: Japanese Laid-open Patent Publication No. 9-203505

Patent Literature 5: Japanese Laid-open Patent Publication No. 2006-057903

Patent Literature 6: Japanese Laid-open Patent Publication No. 2008-145007

SUMMARY

Technical Problem

In the above-described conventional combustion burner, when a fuel gas obtained by mixing pulverized coal with air collides with a flame stabilizer, a separation of a flow occurs at a rear end portion of the flame stabilizer, and hence it is difficult to sufficiently exhibit the flame stabilization ability at the front end portion of the flame stabilizer. Further, in the conventional boiler, since the pulverized coal contains moisture or a volatile content, operation parameters need to be adjusted based on the operation output of the boiler. In this case, it is difficult to directly set the operation parameters from the characteristics of the coal.

It is an object of the invention to provide a combustion burner, a solid-fuel-combustion burner, and a solid-fuel-combustion boiler capable of realizing an appropriate flow of a fuel gas obtained by mixing solid fuel with air.

Further, it is another object of the invention to provide a boiler and a method for operating the boiler capable of improving operation efficiency by appropriately burning solid fuel and a volatile content contained in the solid fuel.

Solution to Problem

According to an aspect of the present invention, a combustion burner includes: a fuel nozzle that is able to blow a fuel gas obtained by mixing solid fuel with air; a secondary air nozzle that is able to blow air from the outside of the fuel nozzle; a flame stabilizer that is provided at a front end portion of the fuel nozzle so as to be near an axis center side of the fuel nozzle; and a rectification member that is provided between an inner wall surface of the fuel nozzle and the flame stabilizer.

Accordingly, since a rectification member is provided between the inner wall surface of the fuel nozzle and the flame stabilizer, the flow of the fuel gas flowing through the fuel nozzle is rectified by the rectification member, and the separation of the flow at the rear end portion of the flame stabilizer is suppressed. Also, since the flow velocity becomes substantially uniform, the deposit of the solid fuel to the wall surface of the fuel nozzle is suppressed. Thus, the appropriate flow of the fuel gas may be realized.

Advantageously, in the combustion burner, the rectification member is disposed so as to have a predetermined gap with respect to the flame stabilizer.

Accordingly, since a predetermined gap is ensured between the rectification member and the flame stabilizer, the flow of the fuel gas flowing between the rectification member and the flame stabilizer is rectified, and hence the flame stabilizing function using the flame stabilizer may be sufficiently exhibited.

Advantageously, in the combustion burner, the rectification member is provided so that a distance between the rectification member and the flame stabilizer is substantially uniform in the fuel gas flowing direction.

Accordingly, since the distance between the rectification member and the flame stabilizer is substantially equal in the fuel gas flowing direction by the rectification member, the flow velocity of the fuel gas flowing between the rectification member and the flame stabilizer becomes substantially uniform, and hence the deposit of the solid fuel to the fuel nozzle or the attachment of the solid fuel to the flame stabilizer may be suppressed. Further, since the passage is not extremely narrowed, the blockage of the passage may be prevented.

Advantageously, in the combustion burner, a widened portion is provided at the downstream side of the flame stabilizer in the fuel gas flowing direction and a tapered portion is provided at the downstream side of the rectification member in the fuel gas flowing direction.

Accordingly, since the front end portion of the flame stabilizer is equipped with the widened portion, the flame may be reliably realized. Then, since the front end portion of the rectification member is equipped with the tapered portion, the distance between the flame stabilizer and the rectification member becomes substantially uniform in the fuel gas flowing direction.

Advantageously, in the combustion burner, a widened portion is provided at the downstream side of the flame stabilizer in the fuel gas flowing direction, and the rectification member is provided at a position where the rectification member does not face the widened portion.

Accordingly, since the rectification member is provided at a position where the rectification member does not face the widened portion of the flame stabilizer, the fuel gas passage between the widened portion of the flame stabilizer and the fuel nozzle is not narrowed, and the flow velocity of the fuel gas becomes substantially uniform. Accordingly, it is possible to suppress the deposit of the solid fuel to the fuel nozzle or the attachment of the solid fuel to the flame stabilizer.

Advantageously, in the combustion burner, the rectification member is provided along the inner wall surface of the fuel nozzle.

Accordingly, since the rectification member is provided in the inner wall surface of the fuel nozzle, a separate attachment member or the like is not needed. Thus, the assembling workability may be improved and the manufacturing cost may be reduced.

Advantageously, in the combustion burner, the flame stabilizer is formed in a structure in which a first flame stabilizing member disposed in the horizontal direction and a second flame stabilizing member disposed in the vertical direction are disposed so as to intersect each other.

Accordingly, since the flame stabilizer is formed in a structure in which the first flame stabilizing member intersects the second flame stabilizing member, the sufficient flame stabilizing function may be ensured.

Advantageously, in the combustion burner, the first flame stabilizing member and the second flame stabilizing member respectively include a plurality of flame stabilizing members, a plurality of the first flame stabilizing members are disposed in the vertical direction with a predetermined gap therebetween, a plurality of the second flame stabilizing members are disposed in the horizontal direction with a predetermined gap therebetween, and the plurality of first flame stabilizing members and the plurality of second flame stabilizing members are disposed so as to intersect each other.

Accordingly, since the flame stabilizer is formed in a double cross structure, the sufficient flame stabilizing function may be ensured.

Advantageously, in the combustion burner, in any one of the first flame stabilizing member and the second flame stabilizing member, one side width is set to be larger than the other side width.

Accordingly, when the width of the first flame stabilizing member disposed in the horizontal direction increases, the flame stabilizing function in the horizontal direction may be improved by the first flame stabilizing member with a wide width. Further, when the width of the second flame stabilizing member disposed in the vertical direction increases, the flame stabilizing function may be improved without the adverse influence of the second flame stabilizing member when the direction of the nozzle swings up and down for the steam temperature control or the like. This is because of the following reasons. When the nozzle moves up and down, the position of the flame stabilizing member with respect to the fuel gas blowing position largely changes in the first flame stabilizing member, but substantially does not change in the second flame stabilizing member.

According to another aspect of the present invention, a combustion burner includes: a fuel nozzle that is able to blow a fuel gas obtained by mixing solid fuel with air; a secondary air nozzle that is able to blow air from the outside of the fuel nozzle; a flame stabilizer that is provided at a front end portion of the fuel nozzle so as to be near an axis center side of the fuel nozzle; and a guide member that guides the fuel gas flowing through the fuel nozzle toward the axis center side of the fuel nozzle.

Accordingly, since the guide member is provided so as to guide the fuel gas flowing through the fuel nozzle toward the axis center side of the fuel nozzle, the fuel gas flowing through the fuel nozzle is guided by the guide member toward the axis center side of the fuel nozzle, and hence the appropriate flow of the fuel gas may be realized. As a result, the inner flame stabilization performance may be improved, and hence the NOx production amount may be reduced.

Advantageously, in the combustion burner, the guide member guides the fuel gas in a direction in which the fuel gas is separated from the secondary air blown from the secondary air nozzle.

Accordingly, the fuel gas is guided by the guide member in a direction in which the fuel gas is separated from the secondary air and the mixing of the fuel gas and the secondary air is suppressed, and hence the outer peripheral portion of the combustion flame is maintained at a low temperature. For this reason, the NOx production amount caused by the mixing of the combustion gas and the secondary air may be reduced.

Advantageously, in the combustion burner, the guide member is disposed along an inner wall surface of the fuel nozzle.

Accordingly, since the guide member is disposed in the inner wall surface of the fuel nozzle, the fuel gas flowing through the fuel nozzle is effectively guided toward the axis center side of the fuel nozzle, and hence the fuel gas may be guided in a direction in which the fuel gas is separated from the secondary air.

Advantageously, in the combustion burner, the guide member is disposed at the front end portion of the fuel nozzle so as to face the flame stabilizer.

Accordingly, since the guide member is disposed so as to face the flame stabilizer, the inner flame stabilization performance may be improved.

Advantageously, in the combustion burner, the guide member is disposed at a position where the guide member faces the inner wall surface of the fuel nozzle in the flame stabilizer.

Accordingly, the fuel gas flowing along the flame stabilizer may be effectively guided by the guide member toward the front end portion of the flame stabilizer so as to stabilize the flame.

Advantageously, in the combustion burner, the guide member is disposed at the upstream side of the flame stabilizer in the fuel gas flowing direction.

Accordingly, since the guide member is separated from the flame stabilizer, the guide member does not degrade the flame stabilizing function of the flame stabilizer.

Advantageously, in the combustion burner, the flame stabilizer is formed in a structure in which two first flame stabilizing members provided in the horizontal direction while being parallel to each other in the vertical direction with a predetermined gap therebetween and two second flame stabilizing members provided in the vertical direction while being parallel to each other in the horizontal direction with a predetermined gap therebetween are disposed so as to intersect one another, and the guide member is disposed at the outside of the intersection position of the first flame stabilizing members and the second flame stabilizing members.

Accordingly, since the flame stabilizer is formed in a double cross structure, the sufficient flame stabilizing function may be ensured, and the fuel gas flowing through the fuel nozzle may be effectively guided by the guide member toward the axis center side of the fuel nozzle.

Advantageously, in the combustion burner, the flame stabilizer includes a widened portion formed at the downstream side in the fuel gas flowing direction, and the guide member is disposed so as to face the widened portion.

Accordingly, the sufficient flame stabilizing function may be ensured.

Advantageously, in the combustion burner, the guide member includes two flame stabilizing members that are provided in the horizontal direction while being parallel to each other in the vertical direction with a predetermined gap therebetween, and the guide member is provided so that the front end portions of the flame stabilizing members face the axis center side of the fuel nozzle.

Accordingly, since the guide member is formed by the flame stabilizing member, the structure may be simplified.

According to still another aspect of the present invention, a solid-fuel-combustion burner that is used in the burner portion of a solid-fuel-combustion boiler and inputs pulverized solid fuel and air into a furnace, includes: a fuel burner that inputs pulverized fuel and primary air into the furnace; and a secondary air input port that ejects secondary air from the outer periphery of the fuel burner. A cross type split member obtained by intersecting a plurality of inner flame stabilization members in a plurality of directions is disposed at a front side of a passage of the fuel burner, and the width of the split member is different for each direction.

According to such a solid-fuel-combustion burner, the solid-fuel-combustion burner includes the fuel burner that inputs the pulverized fuel and the primary air into the furnace and the secondary air input port that ejects the secondary air from the outer periphery of the fuel burner, the cross type split member obtained by intersecting the plurality of inner flame stabilization members in a plurality of directions is disposed at the front side of the passage of the fuel burner, and the width of the split member is different for each direction. For this reason, since the split member provided near the center of the outlet opening divides the passage of the pulverized coal and the air so as to disturb the flow therein, and forms a recirculation zone at the front side of the split member, the split member serves as an inner flame stabilization mechanism. As a result, it is possible to suppress the hot oxygen remaining zone formed in the outer periphery of the flame.

In the above-described invention, the cross type split member may be wide in the up and down direction. Thus, even when the nozzle angle changes in the up and down direction, the positional relation with respect to the splitter member hardly changes.

In the above-described invention, the cross type split member may be wide in the left and right direction. Thus, since the splitter function in the horizontal direction is strengthened, the direct interference with the secondary air input from the up and down direction may be suppressed.

In the above-described invention, three or more cross type split members are disposed in at least one of the left and right direction and the up and down direction. Furthermore, the center portions in at least one of the left and right direction and the up and down direction may be wide. Thus, the inner ignition may be strengthened while preventing the outer peripheral ignition.

According to still another aspect of the present invention, a solid-fuel-combustion burner that is used in the burner portion of a solid-fuel-combustion boiler, includes a fuel burner with an inner flame stabilization function and a secondary air input port without a flame stabilization function, and inputs pulverized solid fuel and air into a furnace, includes: the fuel burner that inputs pulverized fuel and primary air into a furnace; and the secondary air input port that ejects secondary air from the outer periphery of the fuel burner. A cross type split member obtained by intersecting a plurality of members in a plurality of directions is disposed at a front side of a passage of the fuel burner, and a shielding member that reduces a passage sectional area is provided in at least one position of the intersecting corners formed by the intersection of the split members.

According to such a solid-fuel-combustion burner, the solid-fuel-combustion burner includes the fuel burner that inputs the pulverized fuel and the primary air into the furnace and the secondary air input port that ejects the secondary air from the outer periphery of the fuel burner, the cross type split member obtained by intersecting the plurality of members in a plurality of directions is disposed at the front side of the passage of the fuel burner, and the shielding member that reduces the passage sectional area is provided in at least one position of the intersection corner formed by the intersection of the split members. For this reason, the inner flame stabilizing function using the cross type split member may be further strengthened.

In the above-described invention, the solid-fuel-combustion boiler may be divided into the burner portion and the additional air input unit so as to perform the low NOx combustion. Thus, the reduction may be further strongly performed by the division of the additional input air.

Advantageously, in the solid-fuel-combustion boiler, the solid-fuel-combustion burner that inputs the pulverized fuel and the air into the furnace is disposed at a corner or a wall surface inside the furnace.

According to the solid-fuel-combustion boiler, since the solid-fuel-combustion burner that inputs the pulverized fuel and the air into the furnace is disposed at the corner or the wall surface inside the furnace, the split member that is disposed near the center of the outlet opening of the fuel burner and serves as the inner flame stabilization mechanism divides the passage of the pulverized fuel and the air so as to disturb the flow. As a result, the mixture and the dispersion of the air are promoted to the inside of the flame, and hence the ignition surface is further finely divided. Accordingly, since the ignition position is near the center of the flame, the unburned combustible content of the fuel is reduced. That is, since oxygen easily enters the center portion of the flame, the inner ignition is effectively performed, and the reduction inside the flame promptly occurs. Thus, the NOx production amount is reduced.

According to another aspect of the present invention, a solid-fuel-combustion burner that is used in the burner portion of a solid-fuel-combustion boiler and inputs pulverized solid fuel and air into a furnace, includes: a fuel burner that inputs pulverized fuel and primary air into the furnace; and a coal secondary port that ejects secondary air from the outer periphery of the fuel burner. A split member as an inner flame stabilization member is disposed at a front side of a passage of the fuel burner, and a part of an end portion adjacent to the coal secondary port at the outer periphery of the split member is removed.

According to such a solid-fuel-combustion burner, the solid-fuel-combustion burner includes the fuel burner that inputs the pulverized fuel and the primary air into the furnace and the coal secondary port that ejects the secondary air from the outer periphery of the fuel burner, the split member as the inner flame stabilization member is disposed at the front side of the passage of the fuel burner, and a part of the end portion adjacent to the coal secondary port at the outer periphery of the split member is removed. For this reason, the split member that is provided near the center of the outlet opening divides the passage of the pulverized coal and the air so as to disturb the flow therein. Further, since the split member forms a recirculation zone at the front side of the split member, the split member serves as the inner flame stabilization mechanism. As a result, the hot oxygen remaining zone formed at the outer periphery of the flame may be suppressed.

Particularly, in a zone in which the end portion of the split member is removed, the ignition performed using the split member as the ignition source may be suppressed. Furthermore, the flame stabilizing function at the center portion side of the split member as the inside of the flame may be effectively used.

Advantageously, in the solid-fuel-combustion burner, the inner flame stabilization member is a cross type split member obtained by intersecting a plurality of members in a plurality of directions.

Advantageously, in the solid-fuel-combustion burner, a plurality of split members of the inner flame stabilization member are disposed in at least one direction.

In the above-described invention, the end portion of the cross type split member in any one direction of a plurality of directions may be removed. Thus, the inner ignition may be promoted by reducing the ignition source at the end portion of the split member. That is, in the cross type split member obtained by the intersection of two directions of the up and down direction and the left and right direction, any one of the end portions in the up and down direction and the left and right direction may be removed.

Particularly, in a case of a turning combustion type, the end portion of the split member in the up and down direction may be removed. Thus, it is possible to prevent a zone with a high temperature and a high oxygen concentration from being formed at the upper and lower ends that may easily and directly interfere with the secondary air.

In the above-described invention, three or more cross type split members may be disposed in at least one of the up and down direction and the left and right direction, and the end portions of the cross type split members may be removed except for at least one cross type split member disposed at the center portion in at least one of the up and down direction and the left and right direction. Thus, a structure is obtained in which the split member does not exist in a zone that is supposed to contribute the outer peripheral ignition the most.

In the above-described invention, the solid-fuel-combustion boiler may be divided into the burner and the additional air input unit so as to perform the low NOx combustion. Thus, the reduction may be further strongly performed by the division of the additional input air.

Advantageously, in the solid-fuel-combustion burner, the solid-fuel-combustion burner that inputs the pulverized fuel and the air into the furnace is disposed at a corner or a wall surface inside the furnace.

According to such a solid-fuel-combustion boiler, since the solid-fuel-combustion burner that inputs the pulverized fuel and the air into the furnace is disposed in the corner or the wall surface inside the furnace, the split member disposed near the center of the outlet opening of the fuel burner and serving as the inner flame stabilization mechanism divides the passage of the pulverized fuel and the air so as to disturb the flow thereof. As a result, the mixture and the dispersion of the air are promoted to the inside of the flame, and hence the ignition surface is further finely divided. Accordingly, since the ignition position is near the center of the flame, the unburned combustible content of the fuel is reduced. That is, since oxygen easily enters the center portion of the flame, the inner ignition is effectively performed, and the reduction inside the flame is promptly occurs. Thus, the NOx production amount is reduced.

Particularly, in a zone in which the end portion of the split member is removed, the ignition performed using the split member as the ignition source may be suppressed. Furthermore, the flame stabilizing function at the center portion side of the split member as the inside of the flame may be effectively used.

According to still another aspect of the present invention, a boiler includes: a furnace that burns solid fuel and air; a heat exchanger that collects heat by a heat exchange inside the furnace; a fuel nozzle that is able to blow a fuel gas obtained by mixing solid fuel with primary air into the furnace; a secondary air nozzle that is able to blow secondary air from the outside of the fuel nozzle to the furnace; an additional air nozzle that is able to blow additional air to the upside of the fuel nozzle and the secondary air nozzle in the furnace; an air amount adjusting device that is able to adjust the amount of the air supplied to the fuel nozzle, the secondary air nozzle, and the additional air nozzle; and a control device that controls the air amount adjusting device in response to a volatile content of the solid fuel.

Accordingly, since the control device controls the air amount adjusting device in response to the volatile content of the solid fuel so that the air amount adjusting device adjusts the amount of the air supplied to the fuel nozzle, the secondary air nozzle, and the additional air nozzle, the primary air amount, the secondary air amount, and the additional air amount are adjusted in response to the volatile content of the solid fuel. Accordingly, the volatile content of the solid fuel may be appropriately burned and the solid fuel may be appropriately burned. Thus, the production of the NOx or the unburned combustible content is suppressed, and hence the boiler operation efficiency may be improved.

Advantageously, in the boiler, the control device controls the air amount adjusting device in response to the volatile content of the solid fuel so as to adjust a distribution of the total air amount of the primary air and the secondary air and the air amount of the additional air.

Accordingly, the total air amount of the primary air and the secondary air is the air amount necessary for burning the volatile content of the solid fuel, and the total air amount of the primary air and the secondary air changes in response to the volatile content of the solid fuel. Thus, the volatile content of the solid fuel may be appropriately burned.

Advantageously, in the boiler, the furnace is equipped with a tertiary air nozzle that is able to blow tertiary air from the outside of the secondary air nozzle, and the control device controls the air amount adjusting device in response to the volatile content of the solid fuel so as to adjust a distribution of the total air amount of the primary air and the secondary air and the total air amount of the tertiary air and the additional air.

Accordingly, since the total air amount of the primary air and the secondary air changes, the volatile content of the solid fuel may be appropriately burned.

Advantageously, in the boiler, the control device controls the air amount adjusting device so that the primary air amount and the additional air amount become a predetermined air amount, and adjusts a distribution of the secondary air and the tertiary air in response to the volatile content of the solid fuel.

Accordingly, since the primary air is the transportation air for transporting the solid fuel and the additional air completely burns the solid fuel so as to suppress the production of NOx, the primary air and the additional air are set as the predetermined air amounts, and the distribution of the secondary air and the tertiary air is adjusted in response to the volatile content of the solid fuel. Thus, the solid fuel and the volatile content thereof may be appropriately burned while maintaining a predetermined fuel-air ratio.

Advantageously, in the boiler, the control device increases a distribution of the secondary air when the volatile content of the solid fuel increases.

Accordingly, since the secondary air is the combustion air mixed with the fuel gas so as to burn the solid fuel, the solid fuel and the volatile content thereof may be appropriately burned by increasing the distribution of the secondary air when the volatile content of the solid fuel increases.

According to still another aspect of the present invention, a method for operating a boiler including a furnace that burns solid fuel and air, a heat exchanger that collects heat by a heat exchange inside the furnace, a fuel nozzle that is able to blow a fuel gas obtained by mixing solid fuel with primary air to the furnace, a secondary air nozzle that is able to blow secondary air from the outside of the fuel nozzle into the furnace, and an additional air nozzle that is able to blow additional air to the upside of the fuel nozzle and the secondary air nozzle in the furnace. A distribution of the secondary air and the tertiary air is adjusted in response to a volatile content of the solid fuel.

Accordingly, since the distribution of the secondary air and the tertiary air is adjusted in response to the volatile content of the solid fuel, the volatile content of the solid fuel may be appropriately burned and the solid fuel may be appropriately burned. Thus, the production of the NOx or the unburned combustible content is suppressed, and hence the boiler operation efficiency may be improved.

Advantageously, in the method for operating the boiler, the distribution of the secondary air increases when the volatile content of the solid fuel increases.

Accordingly, since the secondary air is the combustion air mixed with the fuel gas so as to burn the solid fuel, the solid fuel and the volatile content thereof may be appropriately burned by increasing the distribution of the secondary air when the volatile content of the solid fuel increases.

Advantageous Effects of Invention

According to the combustion burner of the invention, since the combustion burner includes: the fuel nozzle that is able to blow the fuel gas obtained by mixing the solid fuel and the air; the secondary air nozzle that is able to blow the air from the outside of the fuel nozzle; the flame stabilizer that is provided at the front end portion of the fuel nozzle so as to be near the axis center side of the fuel nozzle; and the rectification member that is provided between the inner wall surface of the fuel nozzle and the flame stabilizer, the appropriate flow of the fuel gas may be realized.

Further, according to the combustion burner of the invention, since the combustion burner includes: the fuel nozzle that is able to blow the fuel gas obtained by mixing the solid fuel and the air; the secondary air nozzle that is able to blow the air from the outside of the fuel nozzle; the flame stabilizer that is provided at the front end portion of the fuel nozzle so as to be near the axis center side of the fuel nozzle; and the guide member that guides the fuel gas flowing through the fuel nozzle toward the axis center side of the fuel nozzle, the appropriate flow of the fuel gas may be realized, and hence the inner flame stabilization performance may be improved.

Further, according to the solid-fuel-combustion burner and the solid-fuel-combustion boiler of the invention, since the outlet opening of the fuel burner is equipped with the split member provided as the inner flame stabilization mechanism in a plurality of directions, the passage of the pulverized fuel and the air may be divided and disturbed near the center of the outlet opening of the fuel burner in which the split members intersect each other, and hence the ignition surface is further finely divided by the split members. Accordingly, since the ignition position is disposed near the center of the flame, the oxygen concentration at the center thereof is relatively low. For this reason, the reduction inside the flame is promptly performed, and hence the amount of NOx finally discharged from the solid-fuel-combustion boiler is reduced. Further, since the splitter is provided in a plurality of directions, the inner air dispersion is promoted, and hence it is possible to suppress the unburned combustible content caused by the locally and extremely insufficient oxygen inside the flame.

That is, the hot oxygen remaining zone formed at the outer periphery of the flame is suppressed, and hence the final NOx production amount of NOx discharged from the additional air input unit may be reduced. In other words, since the hot oxygen remaining zone formed at the outer periphery of the flame is suppressed, the NOx produced inside the flame generated by the pre-mixture combustion is effectively reduced. Accordingly, it is possible to obtain a remarkable advantage in which the final NOx amount decreases due to a decrease in the NOx amount reaching the additional air input unit and a decrease in the NOx amount produced by the input of the additional air.

Further, according to the solid-fuel-combustion burner and the solid-fuel-combustion boiler of the invention, since the outlet opening of the fuel burner is equipped with the split member provided as the inner flame stabilization mechanism in a plurality of directions, the passage of the pulverized fuel and the air may be divided and disturbed near the center of the outlet opening of the fuel burner in which the split members intersect each other, and hence the ignition surface is further finely divided by the split members. Accordingly, since the ignition position is disposed near the center of the flame, the oxygen concentration at the center thereof is relatively low. For this reason, the reduction inside the flame is promptly performed, and hence the amount of NOx finally discharged from the solid-fuel-combustion boiler is reduced. Further, since the splitter is provided in a plurality of directions, the inner air dispersion is promoted, and hence it is possible to suppress the unburned combustible content caused by the locally and extremely insufficient oxygen inside the flame.

That is, the hot oxygen remaining zone formed at the outer periphery of the flame is suppressed, and hence the final NOx production amount of NOx discharged from the additional air input unit may be reduced. In other words, since the hot oxygen remaining zone formed at the outer periphery of the flame is suppressed, the NOx produced inside the flame generated by the pre-mixture combustion is effectively reduced. Accordingly, it is possible to obtain a remarkable advantage in which the final NOx amount decreases due to a decrease in the NOx amount reaching the additional air input unit and a decrease in the NOx amount produced by the input of the additional air.

Further, according to the boiler and the method for operating the boiler of the invention, since the distribution of the secondary air and the tertiary air and the additional air, and the like is adjusted in response to the volatile content of the solid fuel, it is possible to improve the operation efficiency by appropriately burning the solid fuel and the volatile content contained in the solid fuel.

DESCRIPTION OF EMBODIMENTS

Hereinafter, preferred embodiments of a combustion burner, a solid-fuel-combustion burner, a solid-fuel-combustion boiler, a boiler, and a method for operating the boiler of the invention will be described in detail with reference to the accompanying drawings. Furthermore, the invention is not limited to the embodiments, and also includes a case where the respective embodiments are combined with one another when there are plural embodiments.

First Embodiment

As a combustion burner of a conventional pulverized-coal-combustion boiler, the above-described combustion burner disclosed in Patent Literature 1 is known. In the combustion device disclosed in Patent Literature 1, the flame stabilizer is provided between the center inside the pulverized coal ejecting hole (primary passage) and the outer peripheral portion thereof so that a pulverized coal condensed flow is made to collide with the flame stabilizer. Accordingly, the low NOx combustion may be stably performed in a broad load range.

However, in the conventional combustion device, when a fuel gas of pulverized coal and air collides with the flame stabilizer, the flow is divided at the rear end portion of the flame stabilizer, and hence the flame stabilization ability at the front end portion of the flame stabilizer may not be sufficiently exhibited. Further, in the vicinity of the flame stabilizer of the passage through which the fuel gas of pulverized coal and air flows, the passage sectional area decreases due to the arrangement of the flame stabilizer and the flow velocity of the fuel gas becomes faster than that of the upstream side thereof. Then, the flow velocity of the fuel gas becomes slow at the upstream side of the flame stabilizer, so that the pulverized coal contained in the fuel gas is deposited or attached to the lower portion of the passage.

A first embodiment solves this problem, and provides a combustion burner capable of realizing an appropriate flow of a fuel gas obtained by mixing solid fuel and air.

Figure 1:
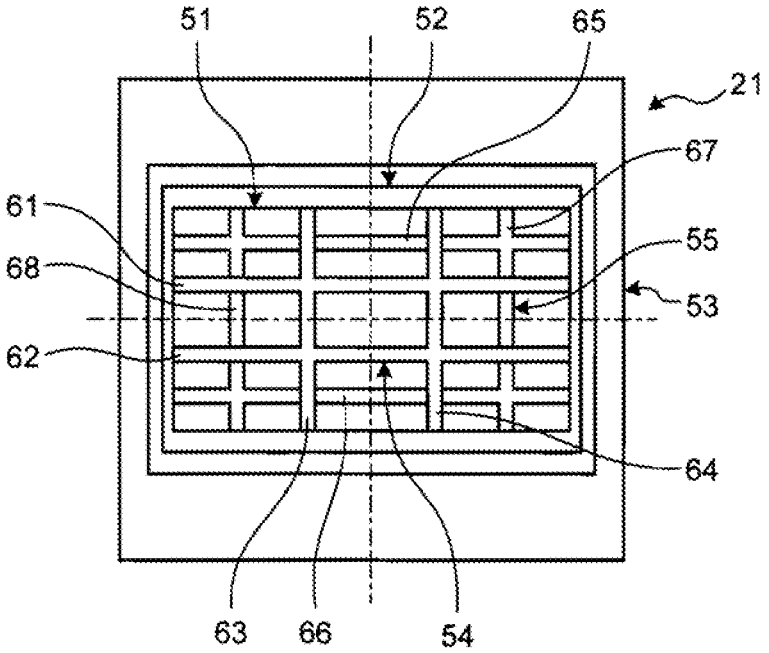
FIG. 1 is a front view illustrating a combustion burner according to a first embodiment of the invention.
Figure 2:
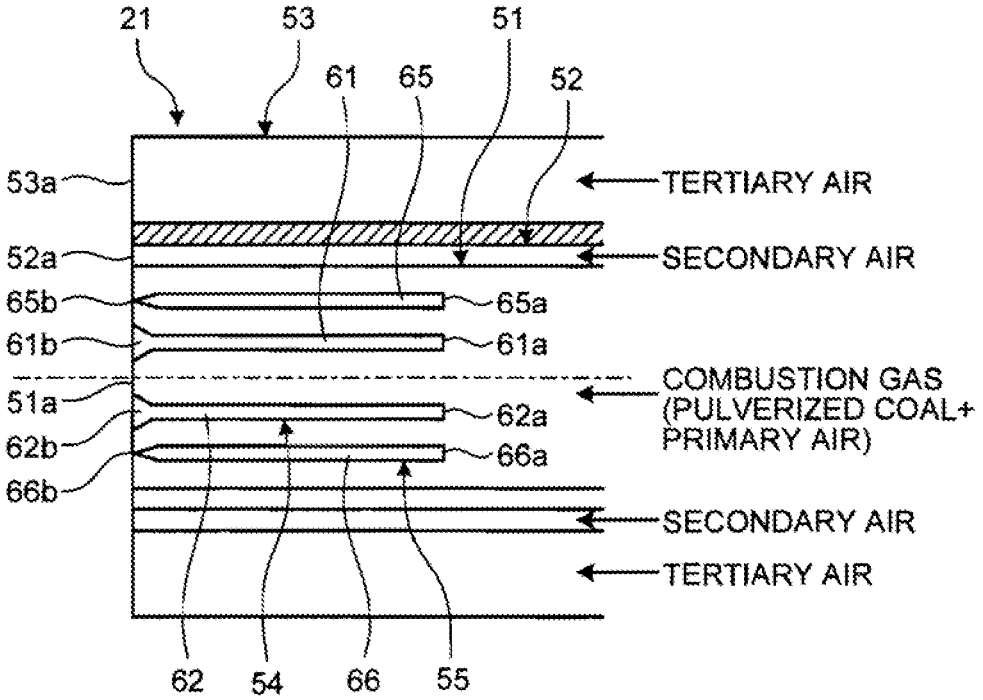
FIG. 2 is a cross-sectional view illustrating the combustion burner of the first embodiment.
Figure 3:
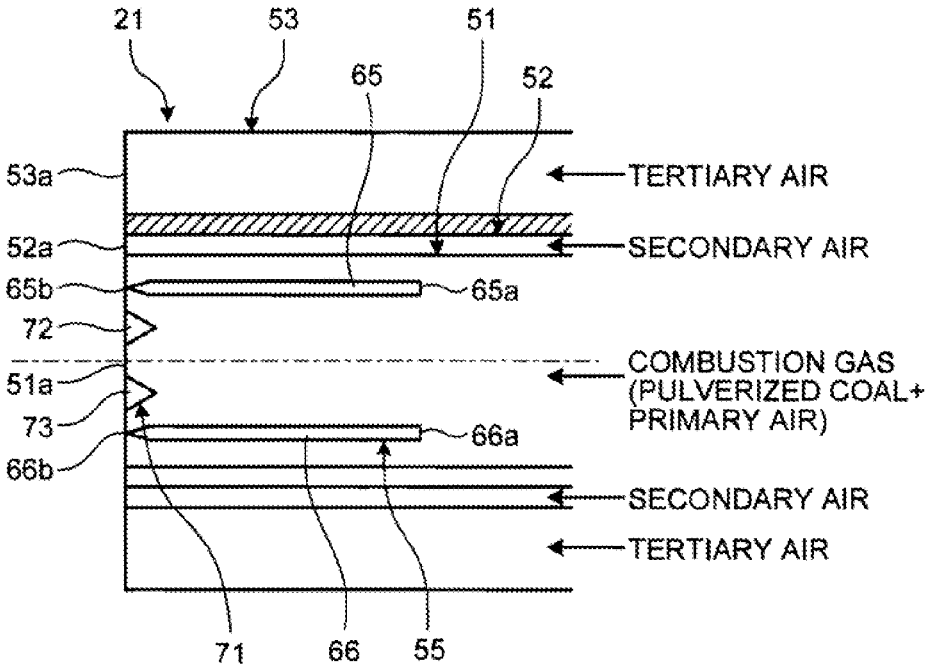
FIG. 3 is a cross-sectional view illustrating a modified example of the combustion burner of the first embodiment.
Figure 4:
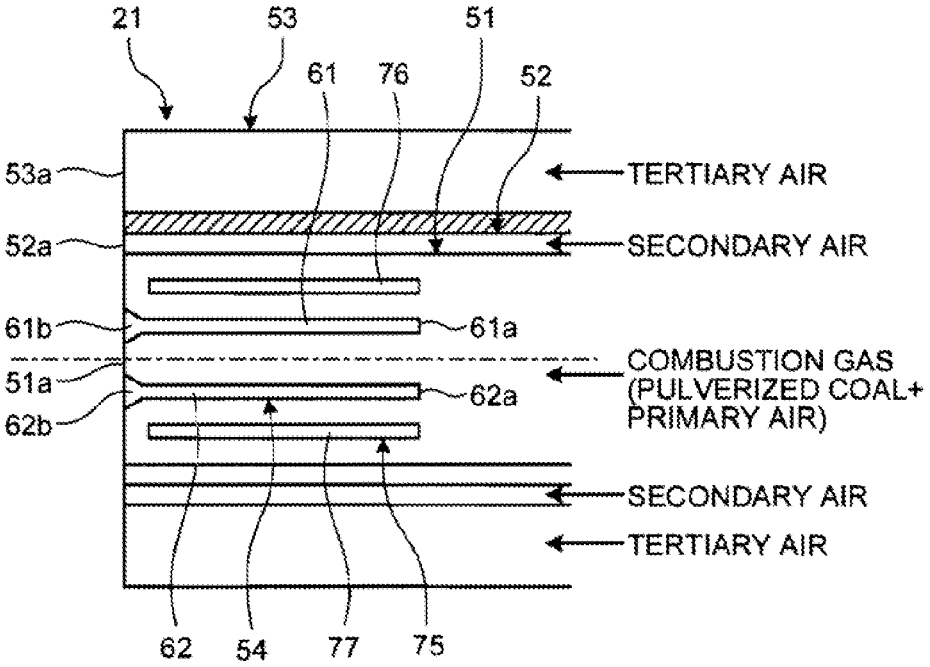
FIG. 4 is a cross-sectional view illustrating a modified example of the combustion burner of the first embodiment.
Figure 5:
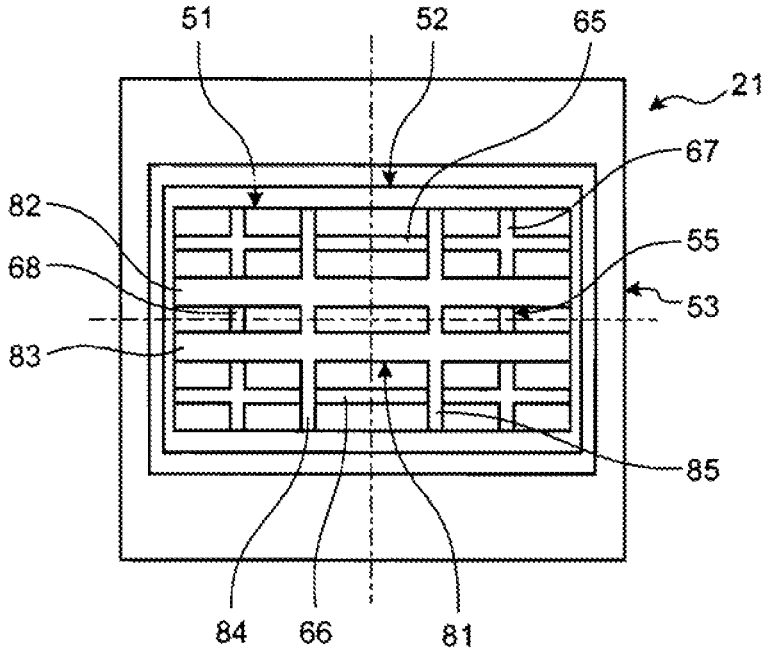
FIG. 5 is a front view illustrating a modified example of the combustion burner of the first embodiment.
Figure 6:
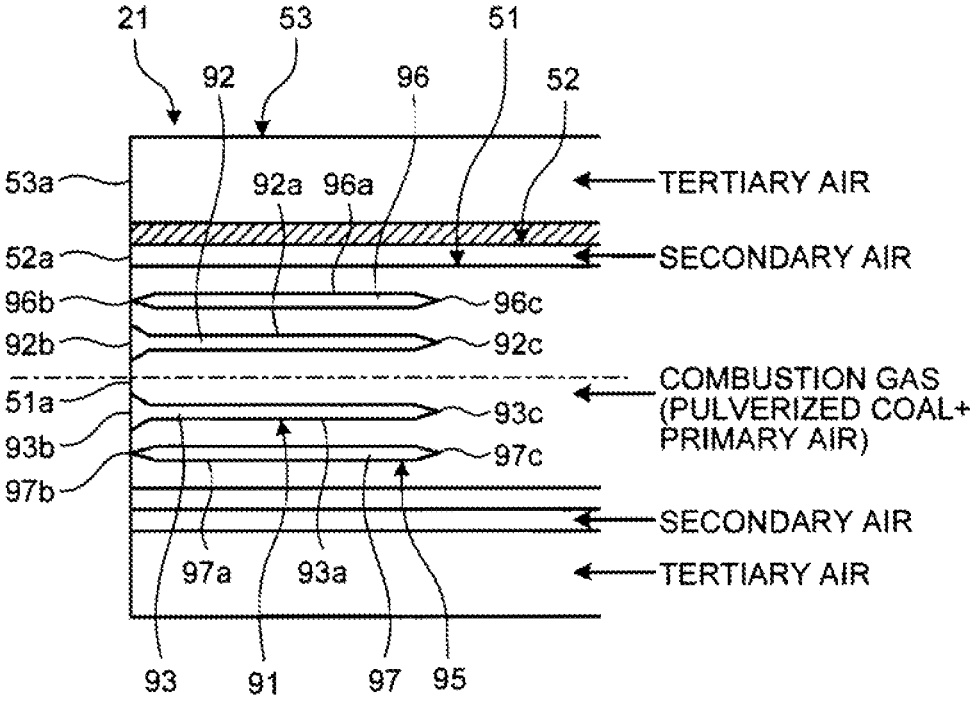
FIG. 6 is a cross-sectional view illustrating a modified example of the combustion burner of the first embodiment.
Figure 7:
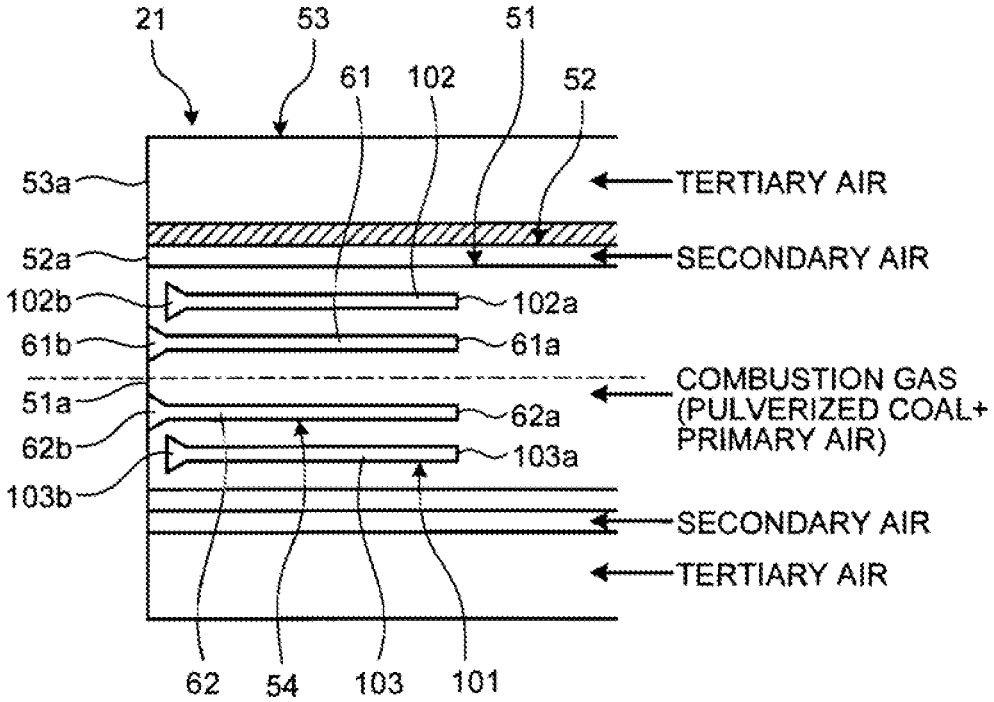
FIG. 7 is a cross-sectional view illustrating a modified example of the combustion burner of the first embodiment.
Figure 8:
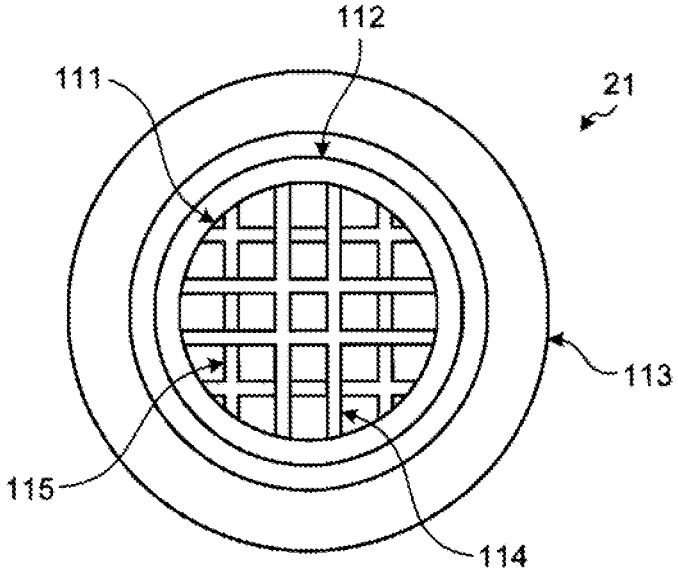
FIG. 8 is a front view illustrating a modified example of the combustion burner of the first embodiment.
Figure 9:
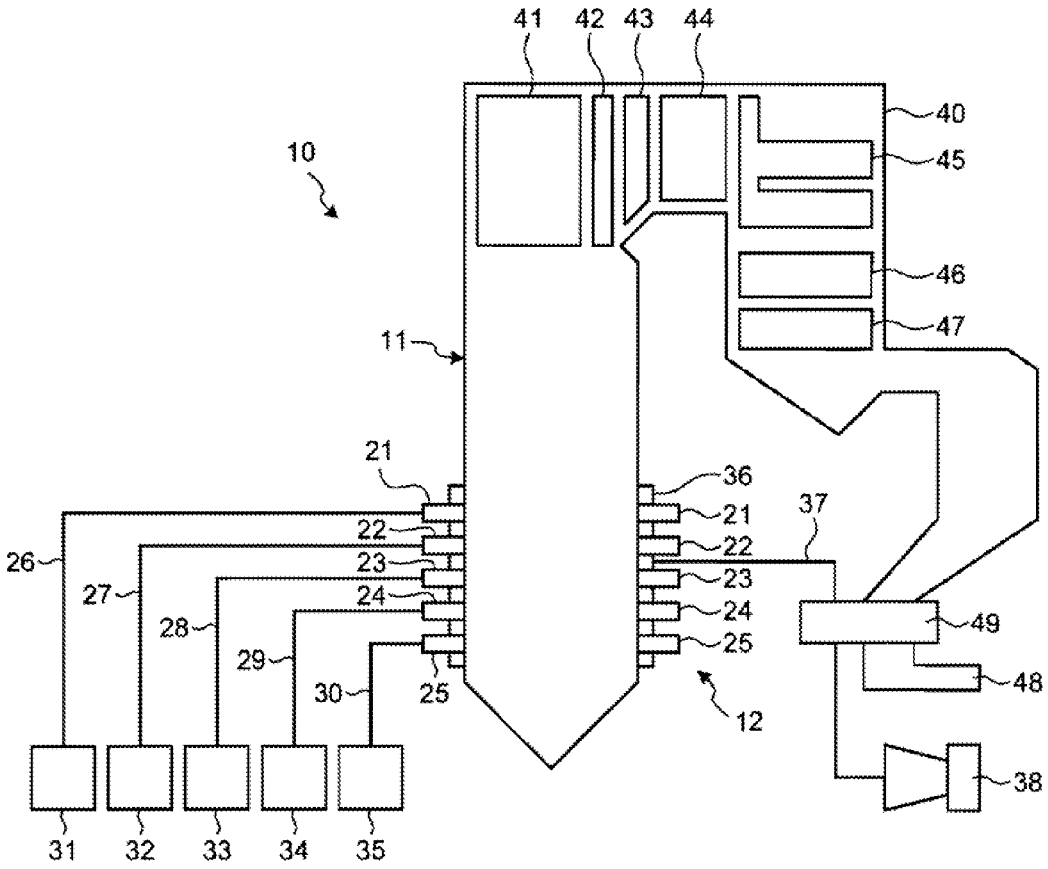
FIG. 9 is a schematic configuration diagram illustrating a pulverized-coal-combustion boiler that employs the combustion burner of the first embodiment.
Figure 10:
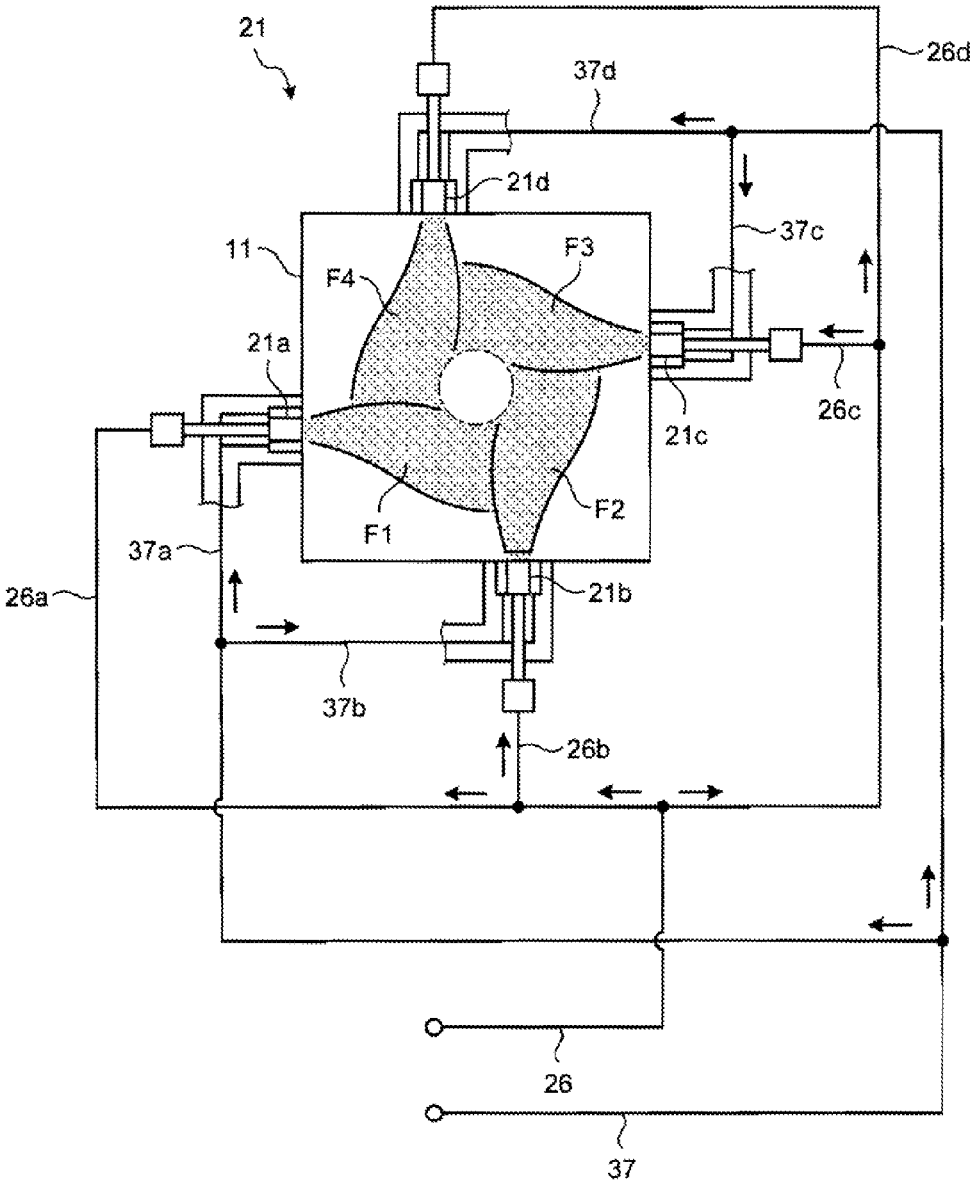
FIG. 10 is a plan view illustrating a combustion burner of the pulverized-coal-combustion boiler of the first embodiment.

FIG. 1 is a front view illustrating a combustion burner according to the first embodiment of the invention, FIG. 2 is a cross-sectional view illustrating the combustion burner of the first embodiment, FIGS. 3 and 4 are cross-sectional views illustrating modified examples of the combustion burner of the first embodiment, FIG. 5 is a front view illustrating a modified example of the combustion burner of the first embodiment, FIGS. 6 and 7 are cross-sectional views illustrating modified examples of the combustion burner of the first embodiment, FIG. 8 is a front view illustrating a modified example of the combustion burner of the first embodiment, FIG. 9 is a schematic configuration diagram illustrating a pulverized-coal-combustion boiler that employs the combustion burner of the first embodiment, and FIG. 10 is a plan view illustrating the combustion burner of the pulverized-coal-combustion boiler of the first embodiment.

The pulverized-coal-combustion boiler that employs the combustion burner of the first embodiment is a boiler which uses pulverized coal obtained by milling coal as solid fuel, burns the pulverized coal by a combustion burner, and collects heat generated by the combustion.

In the first embodiment, as illustrated in FIG. 9, a pulverized-coal-combustion boiler 10 is a conventional boiler, and includes a furnace 11 and a combustion device 12. The furnace 11 is formed in a hollow square cylindrical shape and is provided in the vertical direction, and the combustion device 12 is provided in the lower portion of the furnace wall forming the furnace 11.

The combustion device 12 includes plural combustion burners 21, 22, 23, 24, and 25 which are attached to the furnace wall. In the embodiment, the combustion burners 21, 22, 23, 24, and 25 are disposed as one set in the circumferential direction at four equal intervals therebetween, and five sets, that is, five stages are disposed in the vertical direction.

Then, the respective combustion burners 21, 22, 23, 24, and 25 are connected to coal pulverizers (mills) 31, 32, 33, 34, and 35 through pulverized coal supply pipes 26, 27, 28, 29, and 30. Although not illustrated in the drawings, the coal pulverizers 31, 32, 33, 34, and 35 have a configuration in which milling tables are supported in a rotational driving state with rotation axes along the vertical direction inside a housing and plural milling rollers are provided while facing the upper sides of the milling tables and are supported so as to be rotatable along with the rotation of the milling tables. Accordingly, when coal is input between plural milling rollers and plural milling tables, the coal is milled into a predetermined size therein. Thus, pulverized coal which is classified by transportation air (primary air) may be supplied from pulverized coal supply pipes 26, 27, 28, 29, and 30 to the combustion burners 21, 22, 23, 24, and 25.

Further, in the furnace 11, wind boxes 36 are provided at the attachment positions of the respective combustion burners 21, 22, 23, 24, and 25, where one end portion of an air duct 37 is connected to the wind box 36 and an air blower 38 is attached to the other end portion of the air duct 37. Accordingly, combustion air (secondary air and tertiary air) sent by the air blower 38 may be supplied from the air supply pipe 37 to the wind box 36, and may be supplied from the wind box 36 to each of the combustion burners 21, 22, 23, 24, and 25.

For this reason, in the combustion device 12, the respective combustion burners 21, 22, 23, 24, and 25 may blow a pulverized fuel-air mixture (fuel gas) obtained by mixing pulverized coal and primary air into the furnace 11 and may blow secondary air into the furnace 11. Then, a flame may be formed by igniting the pulverized fuel-air mixture through an ignition torch (not illustrated).

Furthermore, when generally activating the boiler, the respective combustion burners 21, 22, 23, 24, and 25 form a flame by ejecting oil fuel into the furnace 11.

A flue gas duct 40 is connected to the upper portion of the furnace 11, and the flue gas duct 40 is equipped with superheaters 41 and 42, repeaters 43 and 44, and economizers 45, 46, and 47 as convection heat transfer portions for collecting the heat of the flue gas. Accordingly, a heat exchange is performed between water and a flue gas that is produced by the combustion in the furnace 11.

The downstream side of the flue gas duct 40 is connected with a flue gas pipe 48 into which the flue gas subjected to heat exchange is discharged. An air heater 49 is provided between the flue gas pipe 48 and the air duct 37, and a heat exchange is performed between the air flowing through the air duct 37 and the flue gas flowing through the flue gas pipe 48, so that the combustion air flowing through the combustion burners 21, 22, 23, 24, and 25 may increase in temperature.

Furthermore, although not illustrated in the drawings, the flue gas pipe 48 is equipped with a denitration device, an electronic precipitator, an inducing air blower, and a desulfurization device, and the downstream end portion thereof is equipped with a stack.

Accordingly, when the coal pulverizers 31, 32, 33, 34, and 35 are driven, pulverized coal produced therein is supplied along with the transportation air to the combustion burners 21, 22, 23, 24, and 25 through pulverized coal supply pipes 26, 27, 28, 29, and 30. Further, the heated combustion air is supplied from the air duct 37 to the respective combustion burners 21, 22, 23, 24, and 25 through the wind boxes 36. Then, the combustion burners 21, 22, 23, 24, and 25 blow the pulverized fuel-air mixture obtained by mixing the pulverized coal and the transportation air to the furnace 11, blow the combustion air to the furnace 11, and ignite the pulverized fuel-air mixture and the air at this time so as to form a flame. In the furnace 11, when the flame is generated by the combustion of the pulverized fuel-air mixture and the combustion air and the flame is generated at the lower portion inside the furnace 11, the combustion gas (the flue gas) rises inside the furnace 11 so as to be discharged to the flue gas duct 40.

Furthermore, the inside of the furnace 11 is maintained at the reduction atmosphere in a manner such that the air supply amount with respect to the pulverized coal supply amount becomes smaller than the theoretical air amount. Then, when NOx produced by the combustion of the pulverized coal is reduced in the furnace 11 and additional air is additionally supplied thereto, the oxidization combustion of the pulverized coal is completed and hence the production amount of NOx caused by the combustion of the pulverized coal is reduced.

At this time, water supplied from a water feeding pump (not illustrated) is preheated by the economizers 45, 46, and 47, is supplied to a steam drum (not illustrated), and is heated while being supplied to respective water pipes (not illustrated) of the furnace wall so as to become saturated steam. Then, the saturated steam is transported to a steam drum (not illustrated). Further, the saturated steam of a steam drum (not illustrated) is introduced into the superheaters 41 and 42 and is superheated by the combustion gas. The superheated steam produced by the superheaters 41 and 42 is supplied to a power generation plant (not illustrated) (for example, a turbine or the like). Further, the steam which is extracted during the expanding process in the turbine is introduced into the repeaters 43 and 44, is superheated again, and is returned to the turbine. Furthermore, the furnace 11 of a drum type (steam drum) has been described, but the invention is not limited to the structure.

Subsequently, a harmful substance such as NOx is removed from the flue gas which passes through the economizers 45, 46, and 47 of the flue gas duct 40 by a catalyst of a denitration device (not illustrated) in the flue gas pipe 48, a particulate substance is removed therefrom by the electronic precipitator, and a sulfur content is removed therefrom by the desulfurization device. Then, the flue gas is discharged to the atmosphere through the stack.

Here, the combustion device 12 will be described in detail, but since the respective combustion burners 21, 22, 23, 24, and 25 constituting the combustion device 12 have substantially the same configuration, only the combustion burner 21 that is positioned at the uppermost stage will be described.

As illustrated in FIG. 10, the combustion burner 21 includes the combustion burners 21*a*, 21*b*, 21*c*, and 21*d* which are provided at four wall surfaces of the furnace 11. The respective combustion burners 21*a*, 21*b*, 21*c*, and 21*d* are connected with respective branch pipes 26*a*, 26*b*, 26*c*, and 26*d* which are branched from a pulverized coal supply pipe 26, and are connected with respective branch pipes 37*a*, 37*b*, 37*c*, and 37*d* branched from the air duct 37.

Accordingly, the respective combustion burners 21*a*, 21*b*, 21*c*, and 21*d* which are positioned at the respective wall surfaces of the furnace 11 blow the pulverized fuel-air mixture obtained by mixing the pulverized coal and the transportation air to the furnace 11 and blow the combustion air to the outside of the pulverized fuel-air mixture. Then, the pulverized fuel-air mixture is ignited from the respective combustion burners 21*a*, 21*b*, 21*c*, and 21*d*, so that four flames F1, F2, F3, and F4 may be formed. The flames F1, F2, F3, and F4 become a flame swirl flow that turns in the counter-clockwise direction when viewed from the upside of the furnace 11 (in FIG. 10).

As illustrated in FIGS. 1 and 2, in the combustion burner 21 (21*a*, 21*b*, 21*c*, and 21*d*) with such a configuration, the combustion burner is equipped with a fuel nozzle 51, a secondary air nozzle 52, and a tertiary air nozzle 53 which are provided from the center side thereof and is equipped with a flame stabilizer 54. The fuel nozzle 51 may blow the fuel gas (the pulverized fuel-air mixture) obtained by mixing the pulverized coal (the solid fuel) with the transportation air (the primary air). The secondary air nozzle 52 is disposed at the outside of the first nozzle 51 and may blow the combustion air (the secondary air) to the outer peripheral side of the fuel gas ejected from the fuel nozzle 51. The tertiary air nozzle 53 is disposed at the outside of the secondary air nozzle 52 and may blow the tertiary air to the outer peripheral side of the secondary air ejected from the secondary air nozzle 52.

Further, the flame stabilizer 54 is disposed inside the fuel nozzle 51 so as to be positioned at the downstream side of the fuel gas blowing direction and near the axis center, and serves to ignite and stabilize the fuel gas. The flame stabilizer 54 is formed in a so-called double cross split structure in which first flame stabilizing members 61 and 62 following the horizontal direction and second flame stabilizing members 63 and 64 following the vertical direction (the up and down direction) are disposed in a cross shape. Then, the respective first flame stabilizing members 61 and 62 include flat portions 61*a* and 62*a* each formed in a flat plate shape having a uniform thickness and widened portions 61*b* and 62*b* integrally formed with the front end portions of the flat portions 61*a* and 62*a* (the downstream end portions in the fuel gas flowing direction). Each cross-section of the widened portions 61*b* and 62*b* is formed in an isosceles triangular shape, each width of the widened portions is widened toward the downstream side in the fuel gas flowing direction, and each front end thereof is formed as a plane perpendicular to the fuel gas flowing direction. Furthermore, although not illustrated in the drawings, the respective second flame stabilizing members 63 and 64 also have the same structure.

For this reason, each of the fuel nozzle 51 and the secondary air nozzle 52 has an elongated tubular shape, the fuel nozzle 51 includes a rectangular opening portion 51*a*, and the secondary air nozzle 52 includes a rectangular annular opening portion 52*a*. Thus, the fuel nozzle 51 and the secondary air nozzle 52 are formed as a double tube structure. The tertiary air nozzle 53 is disposed as a double tube structure at the outside of the fuel nozzle 51 and the secondary air nozzle 52, and includes a rectangular annular opening portion 53*a*. As a result, the opening portion 52*a* of the secondary air nozzle 52 is disposed at the outside of the opening portion 51*a* of the fuel nozzle 51, and the opening portion 53*a* of the tertiary air nozzle 53 is disposed at the outside of the opening portion 52*a* of the secondary air nozzle 52. Furthermore, the tertiary air nozzle 53 may not be disposed as a double tube structure, and the tertiary air nozzle may be obtained by separately disposing plural nozzles at the outer peripheral side of the secondary air nozzle 52.

In the nozzles 51, 52, and 53, the opening portions 51*a*, 52*a*, and 53*a* are disposed so as to be flush with one another. Further, the flame stabilizer 54 is supported by the inner wall surface of the fuel nozzle 51 or a plate member (not illustrated) from the upstream side of the passage through which the fuel gas flows. Further, since plural flame stabilizing members 61, 62, 63, and 64 are disposed as the flame stabilizer 54 inside the fuel nozzle 51, the fuel gas passage is divided into nine segments. Then, in the flame stabilizer 54, the widened portions 61*b* and 62*b* of which the widths are wide are positioned at the front end portions thereof, and the front end surfaces of the widened portions 61*b* and 62*b* are evenly disposed so as to be flush with the opening portion 51*a*.

Further, in the combustion burner 21 of the first embodiment, a rectification member 55 is provided between the inner wall surface of the fuel nozzle 51 and the flame stabilizer 54. The rectification member 55 is disposed so as to have a predetermined gap with respect to the inner wall surface of the fuel nozzle 51 and have a predetermined gap with respect to the flame stabilizer 54.

That is, the rectification member 55 is formed in a structure in which first rectification members 65 and 66 following the horizontal direction and second rectification members 67 and 68 following the vertical direction (the up and down direction) are disposed so as to form a frame shape. That is, the first rectification member 65 is positioned between the upper wall of the fuel nozzle 51 and the first flame stabilizing member 61, and the first rectification member 66 is positioned between the lower wall of the fuel nozzle 51 and the first flame stabilizing member 62. Further, the second rectification member 67 is positioned between the side wall (in FIG. 1, the left wall) of the fuel nozzle 51 and the second flame stabilizing member 63, and the second rectification member 68 is positioned between the side wall (in FIG. 1, the right wall) of the fuel nozzle 51 and the second flame stabilizing member 64.

Then, the respective first rectification members 65 and 66 include flat portions 65*a* and 66*a* which are formed in a flat plate shape having a uniform thickness and tapered portions 65*b* and 66*b* which are integrally formed with the front end portions of the flat portions 65*a* and 66*a* (the downstream end portions in the fuel gas flowing direction). Each cross-section of the tapered portions 65*b* and 66*b* is formed in an isosceles triangular shape, each width of the tapered portions is narrowed toward the downstream side in the fuel gas flowing direction, and each front end thereof becomes an acute angle. Furthermore, although not illustrated in the drawings, the respective second rectification members 67 and 68 also have the same structure.

In this case, the respective flame stabilizing members 61, 62, 63, and 64 and the respective rectification members 65, 66, 67, and 68 have substantially the same length in the fuel gas flowing direction, and are disposed so as to face one another in a direction perpendicular to the fuel gas flowing direction. Furthermore, in the respective flame stabilizing members 61, 62, 63, and 64 and the respective rectification members 65, 66, 67, and 68, the widened portions 61*b* and 62*b* and the tapered portions 65*b* and 66*b* also have substantially the same length in the fuel gas flowing direction, and are disposed so as to face one another in a direction perpendicular to the fuel gas flowing direction.

Since the flame stabilizer 54 and the rectification member 55 are formed in a shape equipped with the widened portions 61*b* and 62*b* and the tapered portions 65*b* and 66*b*, the distance between the flame stabilizer 54 and the rectification member 55 in the fuel gas flowing direction is substantially equal in the fuel gas flowing direction.

Accordingly, in the combustion burner 21, the fuel gas obtained by mixing the pulverized coal with the primary air blows from the opening portion 51*a* of the fuel nozzle 51 into the furnace, the secondary air at the outside thereof blows from the opening portion 52*a* of the secondary air nozzle 52 into the furnace, and the tertiary air at the outside thereof blows from the opening portion 53*a* of the tertiary air nozzle 53 into the furnace. At this time, the fuel gas is divided by the flame stabilizer 54 at the opening portion 51*a* of the fuel nozzle 51, is ignited, and is burned so as to become a combustion gas. Further, since the secondary air blows to the outer periphery of the fuel gas, the combustion of the fuel gas is promoted. Further, since the tertiary air blows to the outer periphery of the combustion flame, the combustion may be optimally performed by adjusting the ratio between the secondary air and the tertiary air.

Then, since the flame stabilizer 54 is formed in a split shape in the combustion burner 21, the fuel gas is divided by the flame stabilizer 54 at the opening portion 51*a* of the fuel nozzle 51. At this time, the flame stabilizer 54 is disposed at the center zone of the opening portion 51*a* of the fuel nozzle 51, and the fuel gas is ignited and stabilized at the center zone. Thus, the inner flame stabilization (the flame stabilization at the center zone of the opening portion 51*a* of the fuel nozzle 51) of the combustion flame is realized.

For this reason, compared to the configuration in which the outer flame stabilization of the combustion flame is performed, the temperature of the outer peripheral portion of the combustion flame becomes low, and hence the temperature of the outer peripheral portion of the combustion flame under the high oxygen atmosphere by the secondary air may become low. Thus, the NOx production amount at the outer peripheral portion of the combustion flame is reduced.

Further, since the combustion burner 21 employs a configuration in which the inner flame stabilization is performed, it is desirable to supply the fuel gas and the combustion air (the secondary air and the tertiary air) as a straight flow. That is, it is desirable that the fuel nozzle 51 have a structure in which the secondary air nozzle 52 and the tertiary air nozzle 53 supply the fuel gas, the secondary air, and the tertiary air as a straight flow instead of a swirl flow. Since the fuel gas, the secondary air, and the tertiary air are ejected as the straight flow so as to form the combustion flame, the circulation of the gas inside the combustion flame is suppressed in the configuration in which the inner flame stabilization of the combustion flame is performed. Accordingly, the outer peripheral portion of the combustion flame is maintained in a low temperature, and the NOx production amount caused by the mixture with the secondary air is reduced.

Further, in the combustion burner 21, the rectification member 55 is disposed between the fuel nozzle 51 and the flame stabilizer 54 so as to have a predetermined gap therebetween. For this reason, since the fuel gas particularly flowing between the flame stabilizer 54 and the rectification member 55 is rectified, the division of the fuel gas does not occur at the rear end portion of the flame stabilizer 54, and the fuel gas flow directed to the front end portion is formed. For this reason, the flame stabilizer 54 may ensure a sufficient flame stabilization ability at the front end portion thereof.

Further, since the front end portion of the flame stabilizer 54 is equipped with the widened portions 61*b* and 62*b* and the front end portion of the rectification member 55 is equipped with the tapered portions 65*b* and 66*b*, the passage which is formed between the flame stabilizer 54 and the rectification member 55 has substantially the same passage sectional area in the longitudinal direction. Thus, the flow velocity of the fuel gas flowing through the passage becomes uniform, and the flow velocity of the fuel gas decreases on the whole. Accordingly, the flame stabilizer 54 may ensure a sufficient flame stabilization ability at the front end portion thereof. Further, in the pulverized-coal-combustion boiler, the steam temperature or the flue gas characteristics needs to be adjusted, and even at this time, the inner flame stabilization may be ensured by the rectification member 55.

Furthermore, in the combustion burner 21, the configurations of the flame stabilizer 54 and the rectification member 55 are not limited to those of the above-described embodiment.

For example, as illustrated in FIG. 3, the combustion burner 21 is equipped with the fuel nozzle 51, the secondary air nozzle 52, and the tertiary air nozzle 53 which are provided from the center side of the combustion burner, and is equipped with a flame stabilizer 71. The flame stabilizer 71 is disposed inside the fuel nozzle 51 so as to be positioned at the downstream side in the fuel gas blowing direction and near the axis center, and serves to ignite and stabilize the fuel gas. The flame stabilizer 71 is formed in a so-called double cross split structure in which first flame stabilizing members 72 and 73 following the horizontal direction and second flame stabilizing members (not illustrated) following the vertical direction are disposed in a cross shape. Then, each cross-section of the first flame stabilizing members 72 and 73 is formed in an isosceles triangular shape, each width of the first flame stabilizing members is widened toward the downstream side in the fuel gas flowing direction, and each front end thereof is formed as a plane perpendicular to the fuel gas flowing direction. Furthermore, the respective second flame stabilizing members also have the same structure.

Accordingly, since the fuel gas is divided by the flame stabilizer 71 at the opening portion 51*a* of the fuel nozzle 51, the inner flame stabilization of the combustion flame may be performed by the fuel gas going round to the front end surface side of the flame stabilizer, and the temperature of the outer peripheral portion of the combustion flame under a high oxygen atmosphere becomes low by the secondary air. Thus, the NOx production amount in the outer peripheral portion of the combustion flame is reduced. Further, at this time, since the fuel gas flowing between the rectification member 55 and the flame stabilizer 71 is rectified by the rectification member, the separation of the fuel gas disappears. Further, the flow velocity of the fuel gas flowing therethrough becomes uniform, and the flow velocity thereof is reduced. For this reason, the flame stabilizer 71 may ensure a sufficient flame stabilization ability at the front end portion thereof.

Further, as illustrated in FIG. 4, the combustion burner 21 is equipped with the fuel nozzle 51, the secondary air nozzle 52, and the tertiary air nozzle 53 which are provided from the center side of the combustion burner, and is equipped with the flame stabilizer 54 Then, a rectification member 75 is provided between the inner wall surface of the fuel nozzle 51 and the flame stabilizer 54. The rectification member 75 is disposed so as to have a predetermined gap with respect to the inner wall surface of the fuel nozzle 51 and have a predetermined gap with respect to the flame stabilizer 54. That is, the rectification member 75 is formed in a structure in which first rectification members 76 and 77 following the horizontal direction and second rectification members (not illustrated) following the vertical direction (the up and down direction) are disposed so as to form a frame shape. Then, each of the first rectification members 76 and 77 is formed in a flat plate shape of which the thickness is uniform. Furthermore, the respective second rectification members also have the same structure.

In this case, the lengths of the respective rectification members 76 and 77 are slightly shorter than those of the respective flame stabilizing members 61 and 62 in the fuel gas flowing direction, and the respective rectification members and the respective flame stabilizing members are disposed so as to face one another in a direction perpendicular to the fuel gas flowing direction. That is, the flat portions 61*a* and 62*a* of the respective flame stabilizing members 61 and 62 and the respective rectification members 76 and 77 have substantially the same length in the fuel gas flowing direction.

Since the flame stabilizer 54 and the rectification member 75 are formed in a shape equipped with the widened portions 61*b* and 62*b*, the distance between the flame stabilizer 54 and the rectification member 75 in a direction perpendicular to the fuel gas flowing direction is substantially equal in the fuel gas flowing direction. Then, in the flame stabilizer 54, the widened portions 61*b* and 62*b* are provided at the downstream side in the fuel gas flowing direction, and the rectification member 75 is provided at a position where the rectification member does not face the widened portions 61*b* and 62*b*.

Accordingly, since the fuel gas is divided by the flame stabilizer 54 at the opening portion of the fuel nozzle 51, the inner flame stabilization of the combustion flame may be performed by the fuel gas going round to the front end surface side of the flame stabilizer, and the temperature of the outer peripheral portion of the combustion flame under a high oxygen atmosphere becomes low by the secondary air. Thus, the NOx production amount of the outer peripheral portion of the combustion flame is reduced. Further, at this time, since the fuel gas flowing between the rectification member 75 and the flame stabilizer 54 is rectified by the rectification member, the separation of the fuel gas disappears. Further, the flow velocity of the fuel gas flowing therethrough becomes uniform, and the flow velocity thereof is reduced. For this reason, the flame stabilizer 54 may ensure the sufficient flame stabilization ability at the front end portion thereof.

Further, as illustrated in FIG. 5, the combustion burner 21 is equipped with the fuel nozzle 51, the secondary air nozzle 52, and the tertiary air nozzle 53, and is equipped with a flame stabilizer 81. Then, a rectification member 55 is provided between the inner wall surface of the fuel nozzle 51 and the flame stabilizer 81. The flame stabilizer 81 is disposed inside the fuel nozzle 51 so as to be positioned at the downstream side in the fuel gas blowing direction and near the axis center, and serves to ignite and stabilize the fuel gas. The flame stabilizer 81 is formed in a so-called double cross split structure in which first flame stabilizing members 82 and 83 following the horizontal direction and second flame stabilizing members 84 and 85 following the vertical direction are disposed in a cross shape. Then, the widths of the first flame stabilizing members 82 and 83 are set to be larger than those of the second flame stabilizing members 84 and 85.

Accordingly, since the fuel gas is divided by the flame stabilizer 81 at the opening portion 51*a* of the fuel nozzle 51, the inner flame stabilization of the combustion flame may be performed by the fuel gas going round to the front end surface side of the flame stabilizer, and the temperature of the outer peripheral portion of the combustion flame under a high oxygen atmosphere becomes low by the secondary air. Thus, the NOx production amount in the outer peripheral portion of the combustion flame is reduced. In this case, since the widths of the first flame stabilizing members 82 and 83 are larger than those of the second flame stabilizing members 84 and 85, the first flame stabilizing members 82 and 83 have the higher flame stabilizing abilities than those of the second flame stabilizing members 84 and 85. Since the burner 21 of the embodiment is of a turning combustion type and the air is supplied from the upper and lower sides of the fuel gas, it is effective to ensure a high flame stabilization ability in the horizontal direction for the inner flame stabilization.

Here, since the widths of the first flame stabilizing members 82 and 83 following the horizontal direction are set to be larger than those of the second flame stabilizing members 84 and 85 following the vertical direction, it is possible to improve the flame stabilizing function in the horizontal direction by the first flame stabilizing members 82 and 83 having wide widths. Meanwhile, the widths of the second flame stabilizing members 84 and 85 following the vertical direction may be set to be larger than those of the first flame stabilizing members 82 and 83 following the horizontal direction. In this case, it is possible to improve the flame stabilizing function without the adverse influence of the second flame stabilizing members 84 and 85 when the direction of the fuel nozzle 51 swings up and down for the steam temperature control or the like. This is because of the following reasons. When the fuel nozzle 51 moves up and down, the position of the flame stabilizing member with respect to the fuel gas blowing position largely changes in the first flame stabilizing members 82 and 83, but substantially does not change in the second flame stabilizing members 84 and 85.

Further, as illustrated in FIG. 6, the combustion burner 21 is equipped with the fuel nozzle 51, the secondary air nozzle 52, and the tertiary air nozzle 53 which are provided from the center side of the combustion burner, and is equipped with a flame stabilizer 91. The flame stabilizer 91 is disposed inside the fuel nozzle 51 so as to be positioned at the downstream side in the fuel gas blowing direction and near the axis center, and serves to ignite and stabilize the fuel gas. The flame stabilizer 91 is formed in a so-called double cross split structure in which first flame stabilizing members 92 and 93 following the horizontal direction and second flame stabilizing members (not illustrated) following the vertical direction are disposed in a cross shape. Then, the first flame stabilizing members 92 and 93 include flat portions 92*a* and 93*a*, widened portions 92*b* and 93*b*, and tapered portions 92*c* and 93*c*, and the tapered portions 92*c* and 93*c* are provided in the rear end portion thereof so that the widths thereof are narrowed toward the upstream side in the fuel gas flowing direction. Furthermore, the respective second flame stabilizing members also have the same structure.

Then, a rectification member 95 is provided between the inner wall surface of the fuel nozzle 51 and the flame stabilizer 91. The rectification member 95 is disposed so as to have a predetermined gap with respect to the inner wall surface of the fuel nozzle 51 and have a predetermined gap with respect to the flame stabilizer 91. That is, the rectification member 95 is formed in a structure in which first rectification members 96 and 97 following the horizontal direction and second rectification members (not illustrated) following the vertical direction (the up and down direction) are disposed so as to form a frame shape. Then, the respective first rectification members 96 and 97 include flat portions 96*a* and 97*a*, tapered portions 96*b* and 97*b*, and tapered portions 96*c* and 97*c*, and the tapered portions 96*c* and 97*c* are provided in the rear end portion so that the widths thereof are narrowed toward the upstream side in the fuel gas flowing direction. Furthermore, the respective second rectification members also have the same structure.

Accordingly, since the fuel gas is divided by the flame stabilizer 91 at the opening portion 51*a* of the fuel nozzle 51, the inner flame stabilization of the combustion flame may be performed by the fuel gas going round to the front end surface side of the flame stabilizer, and the temperature of the outer peripheral portion of the combustion flame under a high oxygen atmosphere becomes low by the secondary air. Thus, the NOx production amount in the outer peripheral portion of the combustion flame is reduced. Further, at this time, since the fuel gas flowing between the rectification member 95 and the flame stabilizer 91 is rectified by the rectification member, the separation of the fuel gas disappears. Further, the flow velocity of the fuel gas flowing therethrough becomes uniform, and the flow velocity thereof is reduced. For this reason, the flame stabilizer 91 may ensure a sufficient flame stabilization ability at the front end portion thereof. Further, since the flame stabilizer 91 and the rectification member 95 are equipped with the tapered portions 92*c*, 93*c*, 96*c*, and 97*c*, the fuel gas smoothly flows along the flame stabilizer 91 or the rectification member 95, and hence the division thereof is suppressed Further, as illustrated in FIG. 7, the combustion burner 21 is equipped with the fuel nozzle 51, the secondary air nozzle 52, and the tertiary air nozzle 53 which are provided from the center side of the combustion burner, and is equipped with the flame stabilizer 54. Then, a rectification member 101 is provided between the inner wall surface of the fuel nozzle 51 and the flame stabilizer 54. The rectification member 101 is disposed so as to have a predetermined gap with respect to the inner wall surface of the fuel nozzle 51 and have a predetermined gap with respect to the flame stabilizer 54. That is, the rectification member 101 is formed in a structure in which first rectification members 102 and 103 following the horizontal direction and second rectification members (not illustrated) following the vertical direction (the up and down direction) are disposed so as to form a frame shape. Then, the respective first rectification members 102 and 103 include flat portions 102*a* and 103*a* which are formed in a flat plate shape having a uniform thickness and widened portions 102*b* and 103*b* which are integrally formed with the front end portions (the downstream end portions in the fuel gas flowing direction). Furthermore, the respective second rectification members also have the same structure.

In this case, the lengths of the respective rectification members 102 and 103 are slightly shorter than those of the respective flame stabilizing members 61 and 62 in the fuel gas flowing direction, and the respective rectification members and the respective flame stabilizing members are disposed so as to face one another in a direction perpendicular to the fuel gas flowing direction. That is, the flat portions 61*a* and 62*a* of the respective flame stabilizing members 61 and 62 and the respective rectification members 102 and 103 have substantially the same length in the fuel gas flowing direction.

Accordingly, since the fuel gas is divided by the flame stabilizer 54 at the opening portion of the fuel nozzle 51, the inner flame stabilization of the combustion flame may be performed by the fuel gas going round to the front end surface side of the flame stabilizer, the temperature of the outer peripheral portion of the combustion flame under a high oxygen atmosphere becomes low by the secondary air, and the NOx production amount in the outer peripheral portion of the combustion flame is reduced. Further, at this time, since the fuel gas flowing between the rectification member 101 and the flame stabilizer 54 is rectified by the rectification member, the separation of the fuel gas disappears. Further, the flow velocity of the fuel gas flowing therethrough becomes uniform, and the flow velocity thereof is reduced. Thus, the flame stabilizer 54 may ensure a sufficient flame stabilization ability at the front end portion thereof. Further, since the rectification member 101 is shorter than the flame stabilizer 54, even when the widened portions 102*b* and 103*b* are provided at the front end portions thereof so as to have a flame stabilizing function, the flame stabilization ability may be improved without extremely narrowing the passage sectional area of the fuel nozzle 51, and hence even a flame-resistant fuel may be stably burned.

Further, as illustrated in FIG. 8, the combustion burner 21 is equipped with a fuel nozzle 111, a secondary air nozzle 112, and a tertiary air nozzle 113 which are provided from the center side of the combustion burner, and is equipped with a flame stabilizer 114. Then, a rectification member 115 is provided between the inner wall surface of the fuel nozzle 111 and the flame stabilizer 114. In this case, the fuel nozzle 111 includes a circular opening portion, and the secondary air nozzle 112 and the tertiary air nozzle 113 also have the same cylindrical shape. Such a configuration is particularly applied to a configuration in which the combustion burner 21 is disposed in an opposing manner.

The flame stabilizer 114 is disposed inside the fuel nozzle 111 so as to be positioned at the downstream side in the fuel gas blowing direction and near the axis center, and serves to ignite and stabilize the fuel gas. The flame stabilizer 114 is disposed so that two flame stabilizing members following the horizontal direction intersect two flame stabilizing members following the vertical direction. Further, the rectification member 115 is disposed so as to have a predetermined gap with respect to the inner wall surface of the fuel nozzle 111 and have a predetermined gap with respect to the flame stabilizer 114. That is, the rectification member 115 is formed in a structure in which two rectification members following the horizontal direction and two rectification members following the vertical direction are disposed so as to form a frame shape.

Accordingly, since the fuel gas is divided by the flame stabilizer 114 at the opening portion of the fuel nozzle 111, the inner flame stabilization of the combustion flame may be performed by the fuel gas going round to the front end surface side of the flame stabilizer, the temperature of the outer peripheral portion of the combustion flame under a high oxygen atmosphere becomes low by the secondary air, and the NOx production amount in the outer peripheral portion of the combustion flame is reduced. Further, at this time, since the fuel gas flowing between the rectification member 115 and the flame stabilizer 114 is rectified by the rectification member, the separation of the fuel gas disappears. Further, the flow velocity of the fuel gas flowing therethrough becomes uniform, and the flow velocity thereof is reduced. Thus, the flame stabilizer 114 may ensure a sufficient flame stabilization ability at the front end portion thereof.

In this way, the combustion burner of the first embodiment includes the fuel nozzle 51 which may blow the fuel gas obtained by mixing the pulverized coal with the primary air and the secondary air nozzle 52 which may blow the secondary air from the outside of the fuel nozzle 51, the flame stabilizer 54 is provided at the front end portion of the fuel nozzle 51 so as to be near the axis center, and the rectification member 55 is provided between the inner wall surface of the fuel nozzle 51 and the flame stabilizer 54.

Accordingly, since the rectification member 55 is provided between the inner wall surface of the fuel nozzle 51 and the flame stabilizer 54, the flow of the fuel gas flowing through the fuel nozzle 51 is rectified by the rectification member 55, and hence the division of the flow of the fuel gas at the rear end portion of the flame stabilizer 54 is suppressed. Also, since the flow velocity becomes substantially uniform, the deposit (or the attachment) of the pulverized coal fuel to the inner wall surface of the fuel nozzle 51 is suppressed. Thus, the appropriate flow of the fuel gas may be realized.

Further, in the combustion burner of the first embodiment, the rectification member 55 is disposed so as to have a predetermined gap with respect to the flame stabilizer 54. Accordingly, since a predetermined gap is ensured between the rectification member 55 and the flame stabilizer 54, the flow of the fuel gas flowing between the rectification member 55 and the flame stabilizer 54 is rectified, and the fuel gas is appropriately introduced into the flame stabilizer 54. Thus, the flame stabilizing function may be sufficiently exhibited by the flame stabilizer 54.

Further, in the combustion burner of the first embodiment, the distance between the flame stabilizer 54 and the rectification member 55 in the fuel gas flowing direction becomes substantially uniform by the rectification member 55. Accordingly, since the distance between the rectification member 55 and the flame stabilizer 54 in the fuel gas flowing direction becomes substantially uniform by the rectification member, the flow velocity of the fuel gas flowing between the rectification member 55 and the flame stabilizer 54 becomes substantially uniform, and hence the deposit of the pulverized coal fuel of the fuel nozzle 51 or the attachment of the pulverized coal fuel to the flame stabilizer 54 may be suppressed.

Further, in the combustion burner of the first embodiment, the widened portions 61*b* and 62*b* are provided at the downstream side in the fuel gas flowing direction of the flame stabilizer 54, and the tapered portions 65*b* and 66*b* are provided at the downstream side in the fuel gas flowing direction of the rectification member 55. Accordingly, since the front end portion of the flame stabilizer 54 is equipped with the widened portions 61*b* and 62*b*, the flame may be reliably stabilized. Then, since the front end portion of the rectification member 55 is equipped with the tapered portions 65*b* and 66*b*, the distance between the flame stabilizer 54 and the rectification member 55 in the fuel gas flowing direction may become substantially uniform.

Further, in the combustion burner of the first embodiment, the flame stabilizer 54 is formed in a structure in which two first flame stabilizing members 61 and 62 provided in the horizontal direction while being parallel to each other in the vertical direction with a predetermined gap therebetween and two second flame stabilizing members 63 and 64 provided in the vertical direction while being parallel to each other in the horizontal direction with a predetermined gap therebetween are disposed so as to intersect one another. Accordingly, since the flame stabilizer 54 is formed in a double cross structure, a sufficient flame stabilizing function may be ensured.

Further, in the combustion burner of the first embodiment, the widened portions 61*b* and 62*b* are provided at the downstream side in the fuel gas flowing direction of the flame stabilizer 54, and the rectification member 75 is provided at a position where the rectification member does not face the widened portions 61*b* and 62*b*. Accordingly, since the rectification member 75 is provided at a position where the rectification member does not face the widened portions 61*b* and 62*b* of the flame stabilizer 54, the flow velocity of the fuel gas becomes substantially uniform without narrowing the fuel gas passages between the fuel nozzle 51 and the widened portions 61*b* and 62*b* of the flame stabilizer 54, and hence the deposit of the pulverized coal fuel of the fuel nozzle 51 or the attachment of the pulverized coal fuel to the flame stabilizer 54 may be suppressed.

Second Embodiment

Figure 11:
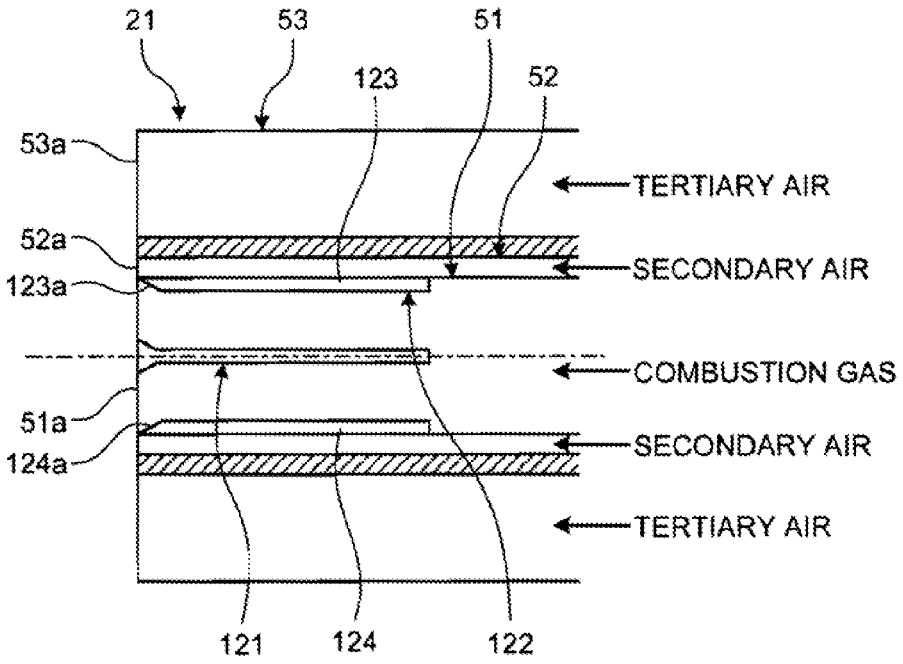
FIG. 11 is a cross-sectional view illustrating a combustion burner according to a second embodiment of the invention.

FIG. 11 is a cross-sectional view illustrating a combustion burner according to a second embodiment of the invention. Furthermore, the same reference sign will be given to the component having the same function as that of the above-described embodiment, and the detailed description thereof will not be repeated.

In the combustion burner of the second embodiment, as illustrated in FIG. 11, the combustion burner 21 is equipped with the fuel nozzle 51, the secondary air nozzle 52, and the tertiary air nozzle 53 which are provided from the center side of the combustion burner, and is equipped with a flame stabilizer 121. Then, a rectification member 122 is provided between the inner wall surface of the fuel nozzle 51 and the flame stabilizer 121.

The flame stabilizer 121 is disposed at the axis center of the fuel nozzle 51 so as to follow the horizontal direction, and the configuration is substantially the same as those of the first flame stabilizing members 61 and 62 described in the first embodiment. That is, the flame stabilizer 121 includes a widened portion of which the width is widened toward the downstream side in the fuel gas flowing direction, and the front end thereof becomes a plane perpendicular to the fuel gas flowing direction.

Since the rectification member 122 is fixed along the inner wall surface of the fuel nozzle 51, the rectification member has a predetermined gap with respect to the flame stabilizer 121. That is, the rectification member 122 includes first rectification members 123 and 124 following the horizontal direction, and the downstream end portion in the fuel gas flowing direction is equipped with inclined portions 123*a* and 124*a* which face the upper and lower sides of the widened portion of the flame stabilizer 121. In this case, the first rectification members 123 and 124 are directly fixed to the inner wall surface of the fuel nozzle 51, but a support member may extend from the upstream portion of the fuel nozzle 51 so as to support the first rectification members 123 and 124.

For this reason, the flame stabilizer 121 and the rectification member 122 are formed in a shape in which the widened portion faces the inclined portions 123*a* and 124*a*, and the distance between the flame stabilizer 121 and the rectification member 122 in a direction perpendicular to the fuel gas flowing direction is substantially equal in the fuel gas flowing direction.

Accordingly, since the fuel gas is divided by the flame stabilizer 121 at the opening portion 51*a* of the fuel nozzle 51, the inner flame stabilization of the combustion flame may be performed by the fuel gas going round to the front end surface side of the flame stabilizer, the temperature of the outer peripheral portion of the combustion flame under a high oxygen atmosphere becomes low by the secondary air, and the NOx production amount in the outer peripheral portion of the combustion flame is reduced. Further, at this time, since the flow of the fuel gas flowing between the rectification member 122 and flame stabilizer 121 is rectified by the rectification member, the separation of the fuel gas disappears. Further, the flow velocity of the fuel gas flowing therethrough becomes uniform, and the flow velocity thereof is reduced. Thus, the flame stabilizer 121 may ensure a sufficient flame stabilization ability at the front end portion thereof.

In this way, in the combustion burner of the second embodiment, the rectification member 122 is provided in the inner wall surface of the fuel nozzle 51. Accordingly, since the rectification member 122 is provided in the inner wall surface of the fuel nozzle 51, a separate attachment member or the like is not needed. Accordingly, the rectification member 122 may be simply supported. Thus, the assembling workability of the rectification member 122 may be improved, and the manufacturing cost may be reduced. Further, the mixing of the secondary air may be delayed, and hence the outer peripheral zone with a high temperature and a high oxygen concentration may be reduced.

Third Embodiment

Figure 12:
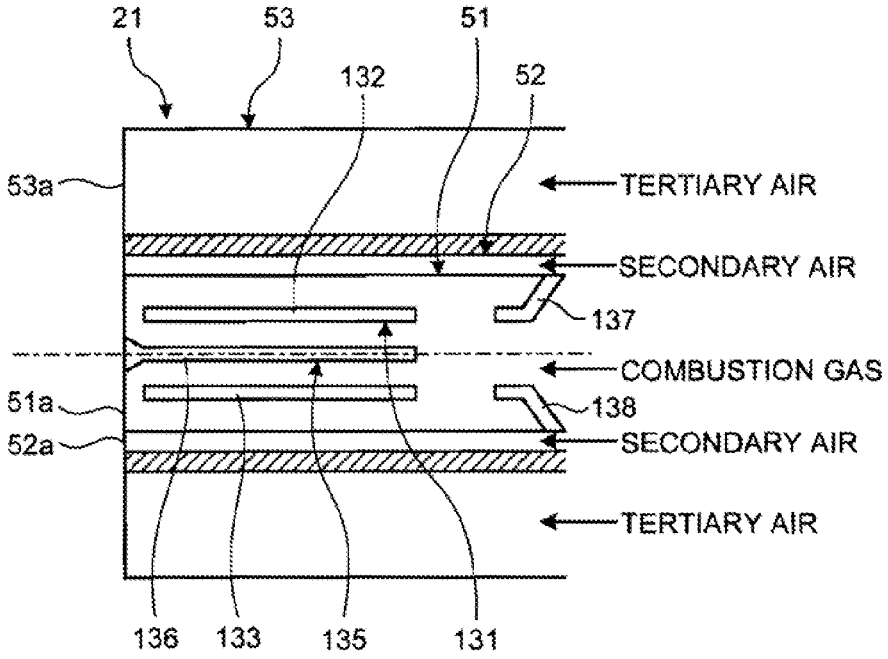
FIG. 12 is a cross-sectional view illustrating a combustion burner according to a third embodiment of the invention.

FIG. 12 is a cross-sectional view illustrating a combustion burner according to a third embodiment of the invention. Furthermore, the same reference sign will be given to the component having the same function as that of the above-described embodiment, and the detailed description thereof will not be repeated.

In the combustion burner of the third embodiment, as illustrated in FIG. 12, the combustion burner 21 is equipped with the fuel nozzle 51, the secondary air nozzle 52, and the tertiary air nozzle 53 which are provided from the center side of the combustion burner, and is equipped with a flame stabilizer 131. Then, a rectification member 135 is provided inside the flame stabilizer 131.

The flame stabilizer 131 is disposed at the axis center of the fuel nozzle 51 so as to follow the horizontal direction, and two flame stabilizing members following the horizontal direction and two flame stabilizing members following the vertical direction are disposed so as to intersect one another. Further, the rectification member 135 includes a first rectification member 136 which is positioned between the respective flame stabilizing members of the flame stabilizer 131 so as to be formed in a cross shape by the intersection in the horizontal direction and the vertical direction and second rectification members 137 and 138 which are positioned at the upstream side in relation to the flame stabilizer 131 and the rectification member 136 and are fixed to the inner wall surface of the fuel nozzle 51.

Since the first rectification member 136 is fixed to the inner wall surface of the fuel nozzle 51, the first rectification member has a predetermined gap with respect to the flame stabilizer 131. Further, the second rectification members 137 and 138 are fixed to the inner wall surface of the fuel nozzle 51 at the upstream side of the fuel gas in relation to the flame stabilizer 131, and hence the fuel gas flowing through the fuel nozzle 51 may be guided to the center side thereof.

Accordingly, since the fuel gas is divided by flame stabilizers 132 and 133 at the fuel nozzle 51, the inner flame stabilization of the combustion flame may be performed by the fuel gas going round to the front end surface side of the flame stabilizer, the temperature of the outer peripheral portion of the combustion flame under a high oxygen atmosphere becomes low by the secondary air, and the NOx production amount in the outer peripheral portion of the combustion flame is reduced. Further, at this time, since the fuel gas is guided toward the center side of the fuel nozzle 51 by the second rectification members 137 and 138 and the fuel gas flowing between the first rectification member 136 and the flame stabilizer 132 is rectified by the first rectification member, the separation of the fuel gas disappears, and in addition, the flow velocity of the fuel gas flowing therethrough becomes uniform and is reduced. Thus, the flame stabilizer 132 may ensure a sufficient flame stabilization ability at the front end portion thereof.

In this way, in the combustion burner of the third embodiment, as the rectification member 135, there are provided the first rectification member 136 which is positioned inside the flame stabilizer 131 so as to form a cross shape and the second rectification members 137 and 138 which are positioned at the upstream side in relation to the flame stabilizer 131. Accordingly, the fuel gas flowing through the fuel nozzle 51 is guided to the center side of the fuel nozzle 51 by the second rectification members 137 and 138, and the flow thereof is rectified by the first rectification member 136, so that the appropriate flow of the fuel gas may be realized.

Fourth Embodiment

Figure 13:
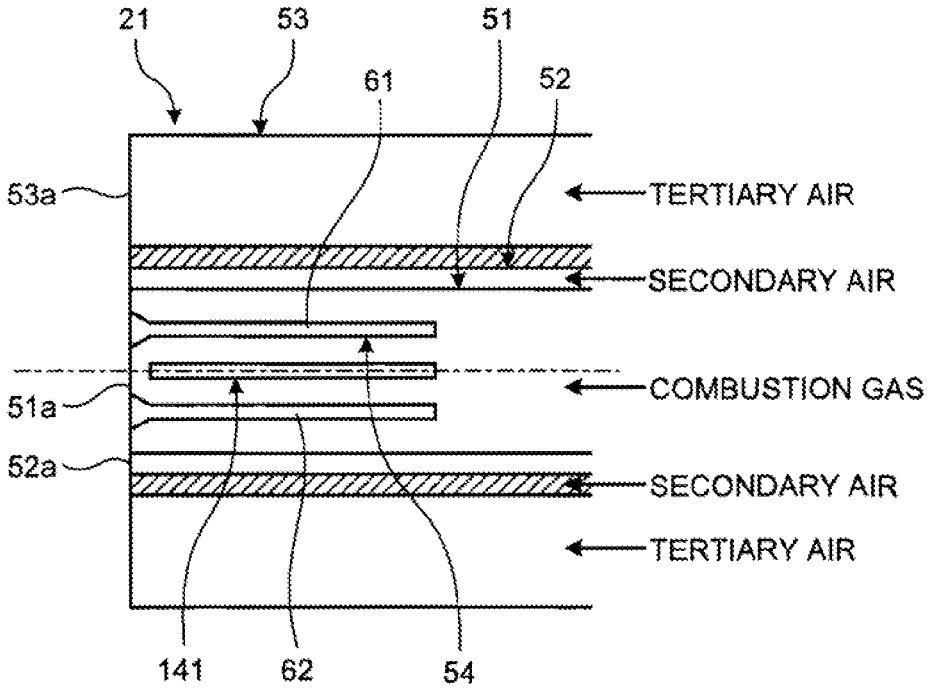
FIG. 13 is a cross-sectional view illustrating a combustion burner according to a fourth embodiment of the invention.

FIG. 13 is a cross-sectional view illustrating a combustion burner according to a fourth embodiment of the invention. Furthermore, the same reference sign will be given to the component having the same function as that of the above-described embodiment, and the detailed description thereof will not be repeated.

In the combustion burner of the fourth embodiment, as illustrated in FIG. 13, the combustion burner 21 is equipped with the fuel nozzle 51, the secondary air nozzle 52, and the tertiary air nozzle 53 which are provided from the center side of the combustion burner, and is equipped with the flame stabilizer 54. Then, a rectification member 141 is provided inside the flame stabilizer 54. The flame stabilizer 131 is disposed at the axis center of the fuel nozzle 51 so as to follow the horizontal direction. The rectification member 141 forms a cross shape by the intersection of the horizontal direction and the vertical direction inside the flame stabilizer 54. In this case, the front end portion of the rectification member 141 is positioned at the upstream side in relation to the flame stabilizer 54.

Accordingly, since the fuel gas is divided by the flame stabilizer 54 at the fuel nozzle 51, the inner flame stabilization of the combustion flame may be performed by the fuel gas going round to the front end surface side of the flame stabilizer, the temperature of the outer peripheral portion of the combustion flame under a high oxygen atmosphere becomes low by the secondary air, and the NOx production amount in the outer peripheral portion of the combustion flame is reduced. Further, at this time, since the fuel gas flowing between the rectification member 141 and the flame stabilizer 54 is rectified by the rectification member, the separation of the fuel gas disappears. Further, the flow velocity of the fuel gas flowing therethrough becomes uniform, and the flow velocity thereof is reduced. Thus, the flame stabilizer 54 may ensure a sufficient flame stabilization ability at the front end portion thereof.

In this way, in the combustion burner of the fourth embodiment, the rectification member 141 is provided inside the flame stabilizer 54 so as to be fixed to the inner wall surface of the fuel nozzle 51. Accordingly, the flow of the fuel gas flowing through the fuel nozzle 51 is rectified by the rectification member 141, so that the appropriate flow of the fuel gas may be realized.

Fifth Embodiment

Figure 14:
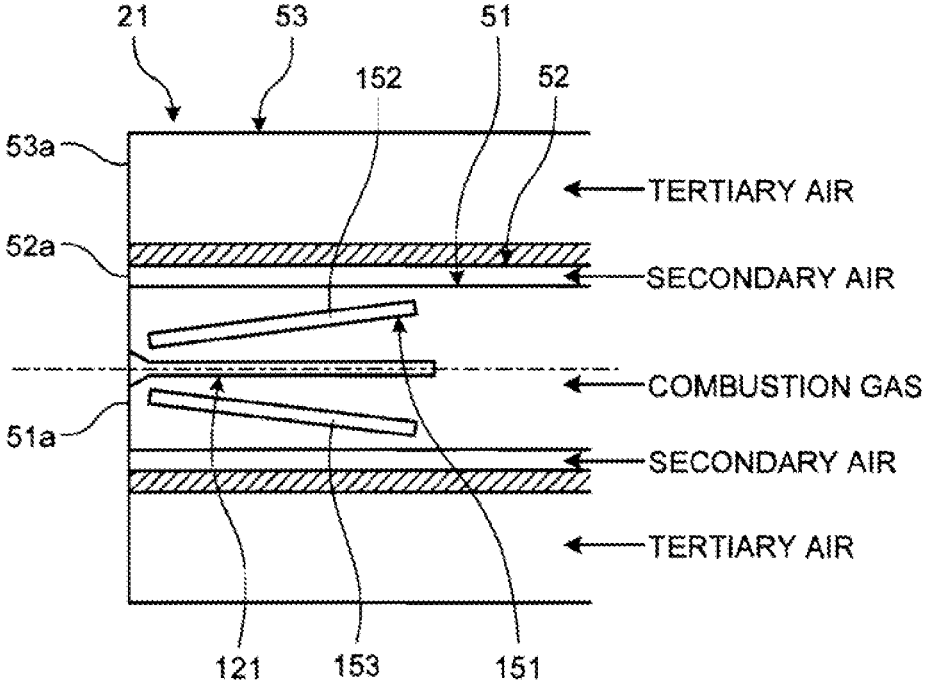
FIG. 14 is a cross-sectional view illustrating a combustion burner according to a fifth embodiment of the invention.

FIG. 14 is a cross-sectional view illustrating a combustion burner according to a fifth embodiment of the invention. Furthermore, the same reference sign will be given to the component having the same function as that of the above-described embodiment, and the detailed description thereof will not be repeated.

In the combustion burner of the fifth embodiment, as illustrated in FIG. 14, the combustion burner 21 is equipped with the fuel nozzle 51, the secondary air nozzle 52, and the tertiary air nozzle 53 which are provided from the center side of the combustion burner, and is equipped with the flame stabilizer 121. Then, a rectification member 151 is provided between the inner wall surface of the fuel nozzle 51 and the flame stabilizer 121.

The flame stabilizer 121 is disposed at the axis center of the fuel nozzle 51 so as to follow the horizontal direction, and the configuration is substantially the same as those of the first flame stabilizing members 61 and 62 described in the first embodiment. The rectification member 151 is disposed so as to have a predetermined gap with respect to the inner wall surface of the fuel nozzle 51 and have a predetermined gap with respect to the flame stabilizer 121. That is, the rectification member 151 is formed in a structure in which first rectification members 152 and 153 following the horizontal direction and second rectification members (not illustrated) following the vertical direction (the up and down direction) are disposed so as to form a frame shape. Then, the respective first rectification members 152 and 153 are disposed so that the front end portions thereof approach the flame stabilizer 121 and the rear end portions thereof are separated from the flame stabilizer 121. Furthermore, the respective second rectification members also have the same structure.

In this case, since the front end portions of the respective rectification members 152 and 153 approach the flame stabilizer 121, the gap between the rectification members 152 and 153 and the flame stabilizer 121 is narrowed as it goes toward the downstream side.

Accordingly, since the fuel gas is divided by the flame stabilizer 121 at the opening portion of the fuel nozzle 51, the inner flame stabilization of the combustion flame may be performed by the fuel gas going round to the front end surface side of the flame stabilizer, the temperature of the outer peripheral portion of the combustion flame under a high oxygen atmosphere becomes low by the secondary air, and the NOx production amount in the outer peripheral portion of the combustion flame is reduced. Further, at this time, since the fuel gas flowing between the rectification member 151 and the flame stabilizer 121 is rectified by the rectification member, the separation of the fuel gas disappears. Further, the flow velocity of the fuel gas flowing therethrough becomes uniform, and the flow velocity thereof is reduced. Thus, the flame stabilizer 121 may ensure a sufficient flame stabilization ability at the front end portion thereof.

In this way, in the combustion burner of the fifth embodiment, the rectification member 151 is provided outside the flame stabilizer 121 so as to be fixed to the inner wall surface of the fuel nozzle 51, and the front end portion thereof is inclined so as to approach the flame stabilizer 121. Accordingly, the flow of the fuel gas flowing through the fuel nozzle 51 is rectified by the rectification member 151, so that the appropriate flow of the fuel gas may be realized.

Sixth Embodiment

Figure 15:
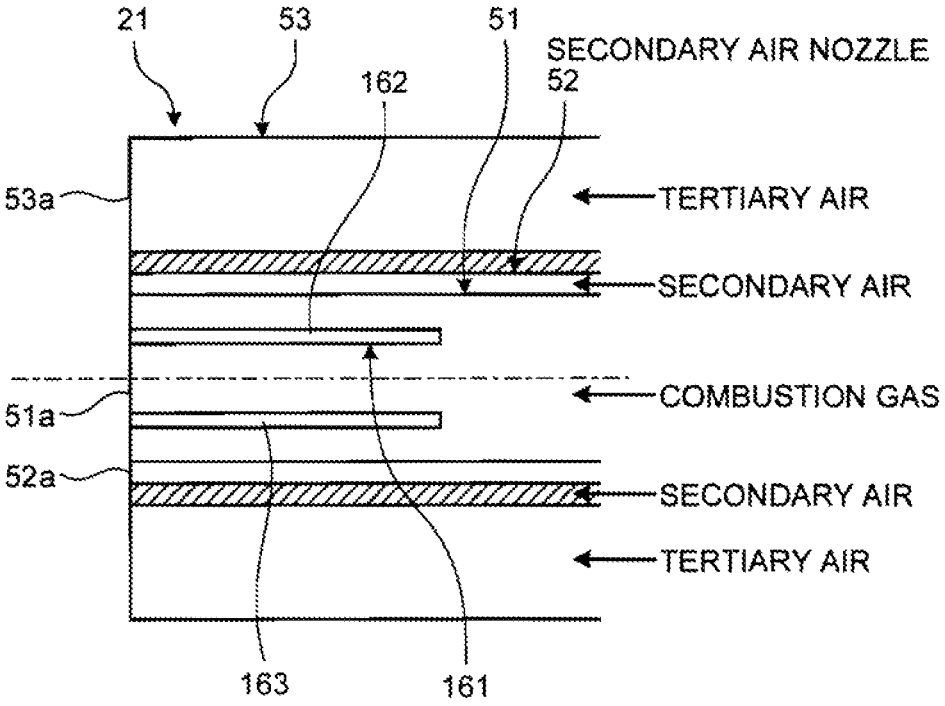
FIG. 15 is a cross-sectional view illustrating a combustion burner according to a sixth embodiment of the invention.

FIG. 15 is a cross-sectional view illustrating a combustion burner according to a sixth embodiment of the invention. Furthermore, the same reference sign will be given to the component having the same function as that of the above-described embodiment, and the detailed description thereof will not be repeated.

In the combustion burner of the sixth embodiment, as illustrated in FIG. 15, the combustion burner 21 is equipped with the fuel nozzle 51, the secondary air nozzle 52, and the tertiary air nozzle 53 which are provided from the center side of the combustion burner, and is equipped with a flame stabilizer 161. The flame stabilizer 161 is formed in a so-called double cross split structure in which first flame stabilizing members 162 and 163 following the horizontal direction and second flame stabilizing members (not illustrated) following the vertical direction are disposed in a cross shape. Then, the first flame stabilizing members 162 and 163 are formed in a plate shape with a predetermined thickness. Furthermore, the respective second flame stabilizing members also have the same structure.

In the embodiment, the outer surfaces of the respective flame stabilizing members 162 and 163 in the flame stabilizer 161 serve as the rectification members.

Accordingly, since the fuel gas is divided by the flame stabilizer 161 at the opening portion 51*a* of the fuel nozzle 51, the inner flame stabilization of the combustion flame may be performed by the fuel gas going round to the front end surface side of the flame stabilizer, the temperature of the outer peripheral portion of the combustion flame under a high oxygen atmosphere becomes low by the secondary air, and the NOx production amount in the outer peripheral portion of the combustion flame is reduced. Further, at this time, since the fuel gas flowing between the fuel nozzle 51 and the flame stabilizer 161 is rectified by the outer surface of the flame stabilizer 161, the separation of the fuel gas disappears. Further, the flow velocity of the fuel gas flowing therethrough becomes uniform, and the flow velocity thereof is reduced. Thus, the flame stabilizer 161 may ensure a sufficient flame stabilization ability at the front end portion thereof.

Furthermore, in the above-described respective embodiments, the configurations of the respective flame stabilizers have been described by various examples, but the configuration is not limited to the above-described configuration. That is, the burner of the invention is used to realize the inner flame stabilization. Then, the flame stabilizer may be provided near the axis of the fuel nozzle instead of the inner wall surface of the fuel nozzle, the number or the position of the flame stabilizing members may be appropriately set, and the flame stabilizing member may be separated from the inner wall surface of the fuel nozzle. Further, the configuration of the rectification member has been described by various examples, but the configuration is not limited to the above-described configuration. That is, the rectification member may be provided between the inner wall surface of the fuel nozzle and the flame stabilizer. In a case where plural flame stabilizers are provided, the rectification member may be provided between the flame stabilizers.

Further, in the above-described respective embodiments, as the combustion device 12, four combustion burners 21, 22, 23, 24, and 25 respectively provided in the wall surface of the furnace 11 are disposed as a five stages in the vertical direction, but the configuration is not limited thereto. That is, the combustion burner may be disposed at the corner instead of the wall surface. Further, the combustion device is not limited to the turning combustion type, and may be a front combustion type in which the combustion burner is disposed in one wall surface or an opposed combustion type in which the combustion burners are disposed in two wall surfaces so as to be opposed to each other.

Further, the flame stabilizer of the invention is equipped with the widened portion having a triangular cross-sectional shape, but the shape is not limited thereto. That is, the shape may be a square shape or the widened portion may not be provided.

Seventh Embodiment

As the combustion burner of the conventional pulverized-coal-combustion boiler, for example, the combustion burner disclosed in Patent Literature 1 is known. In the combustion device disclosed in Patent Literature 1, the flame stabilizer is provided between the center inside the pulverized coal ejecting hole (the primary passage) and the outer peripheral portion, and thus the pulverized coal condensed flow is made to collide with the flame stabilizer. Thus, the low NOx combustion may be stably performed in a wide load range.

However, in the conventional combustion device, when the combustion gas obtained by mixing the pulverized coal and the air collides with the flame stabilizer, the separation of the flow occurs at the rear end portion of the flame stabilizer, and hence it is difficult to sufficiently exhibit the flame stabilization ability at the front end portion of the flame stabilizer. Thus, there is a problem in which NOx is produced by the ignition occurring at the outside of the flame stabilizer.

The invention is made to solve the above-described problems, and it is an object of the invention to provide a combustion burner capable of reducing a NOx production amount by realizing an appropriate flow of a fuel gas obtained by mixing solid fuel and air.

Figure 16:
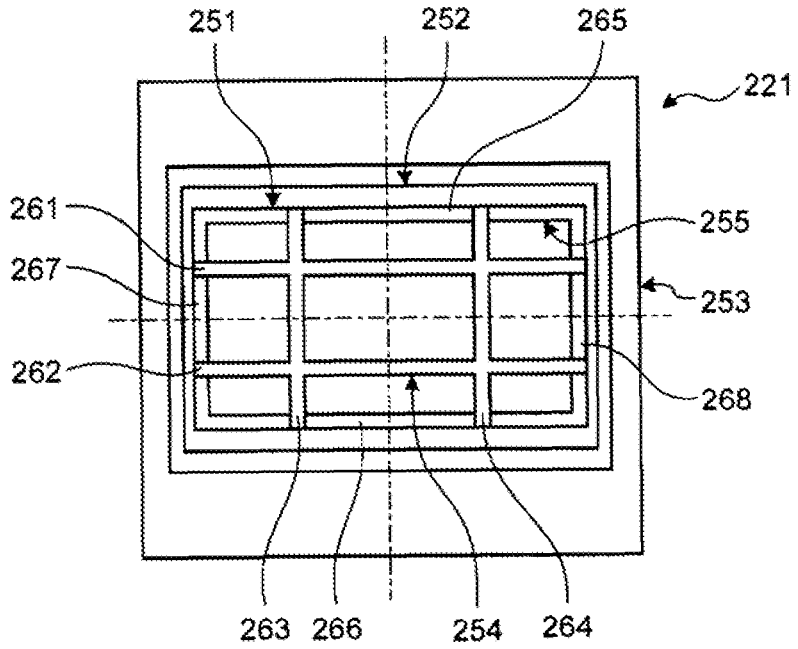
FIG. 16 is a front view illustrating a combustion burner according to a seventh embodiment of the invention.
Figure 17:
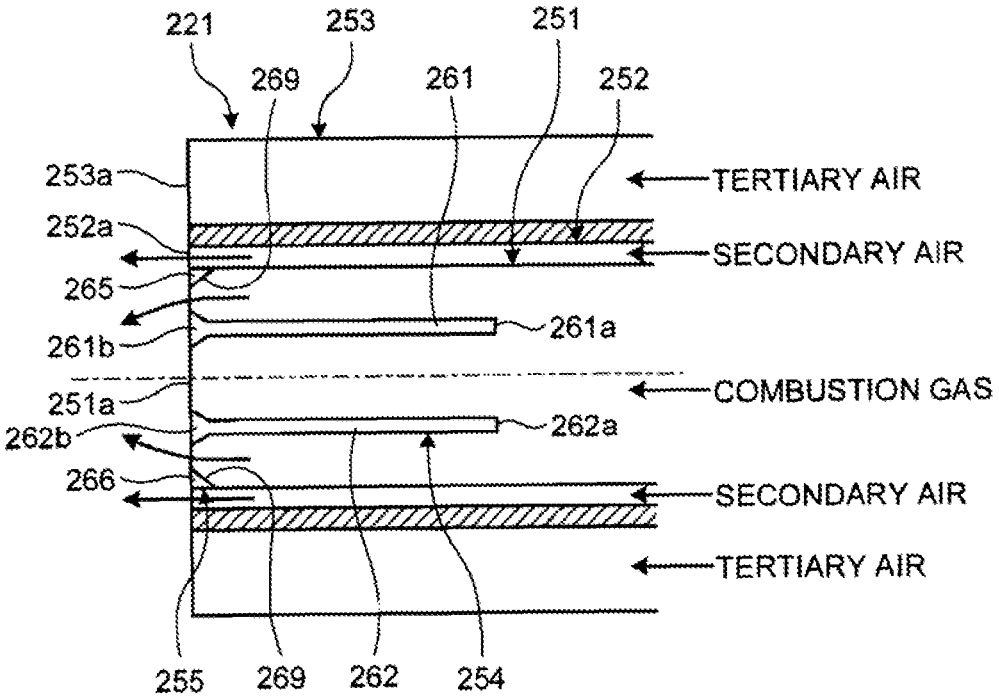
FIG. 17 is a cross-sectional view illustrating the combustion burner of the seventh embodiment.
Figure 18:
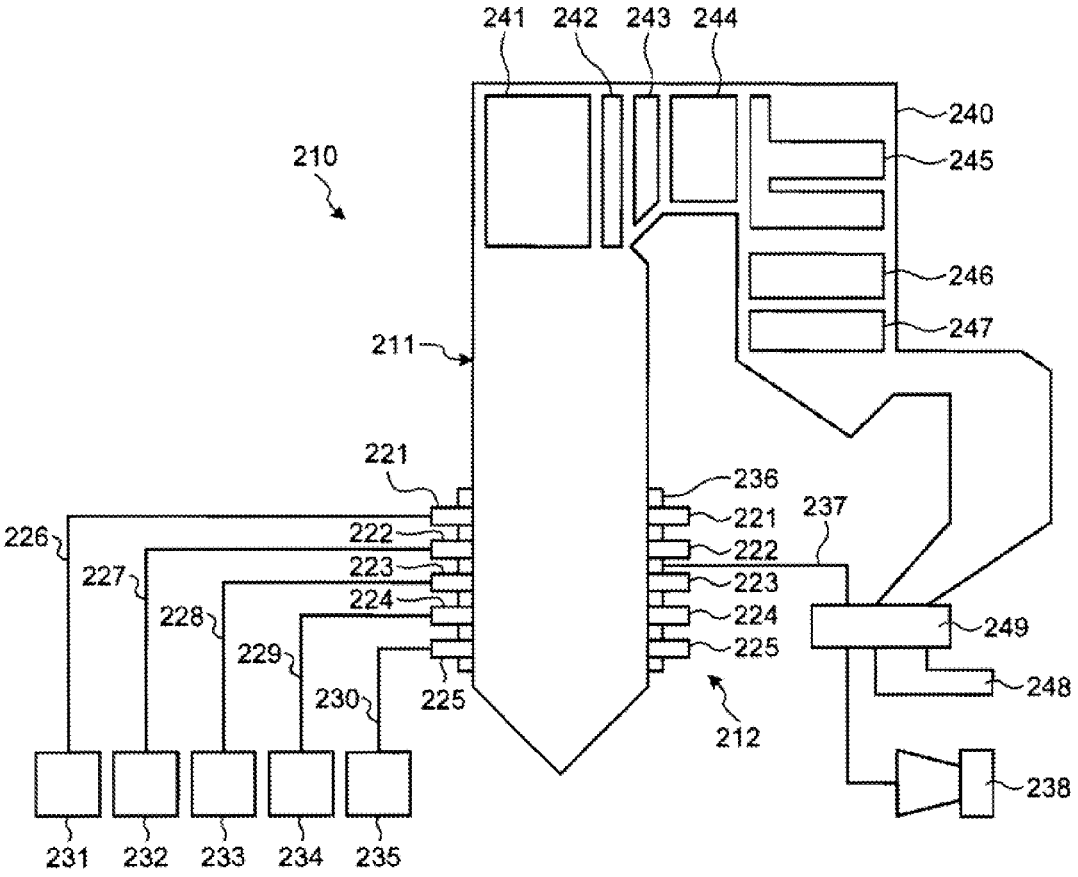
FIG. 18 is a schematic configuration diagram illustrating a pulverized-coal-combustion boiler that employs the combustion burner of the seventh embodiment.
Figure 19:
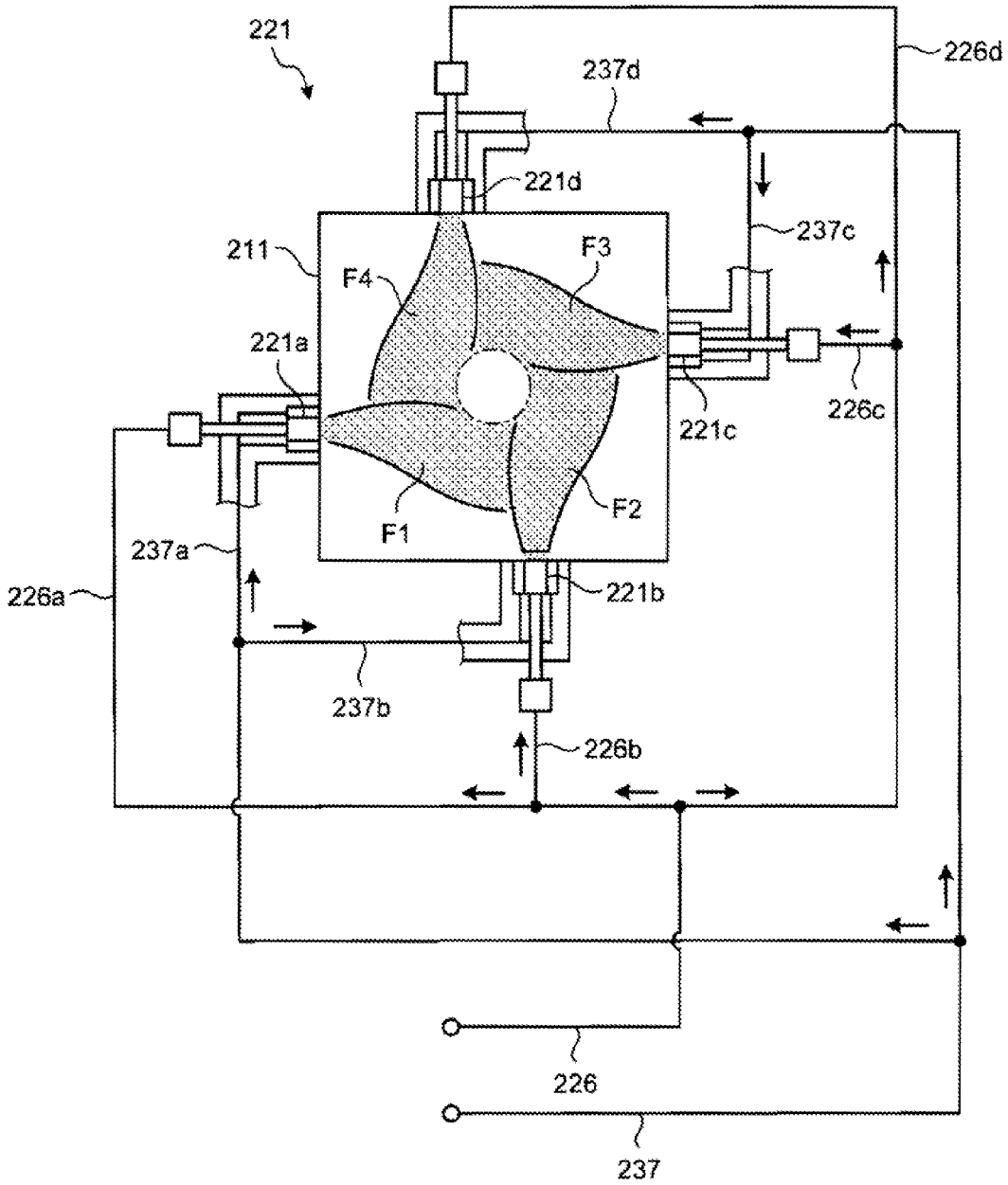
FIG. 19 is a plan view illustrating a combustion burner of the pulverized-coal-combustion boiler of the seventh embodiment.

FIG. 16 is a front view illustrating a combustion burner according to a seventh embodiment of the invention, FIG. 17 is a cross-sectional view illustrating the combustion burner of the seventh embodiment, FIG. 18 is a schematic configuration diagram illustrating a pulverized-coal-combustion boiler that employs the combustion burner of the seventh embodiment, and FIG. 19 is a plan view illustrating the combustion burner of the pulverized-coal-combustion boiler of the seventh embodiment.

The pulverized-coal-combustion boiler that employs the combustion burner of the seventh embodiment is a boiler which burns pulverized coal by the combustion burner using pulverized coal obtained by milling coal as the solid fuel and collects heat generated by the combustion.

In the seventh embodiment, as illustrated in FIG. 18, a pulverized-coal-combustion boiler 210 is the conventional boiler, and includes a furnace 211 and a combustion device 212. The furnace 211 is formed in a hollow square cylindrical shape and is provided in the vertical direction, and the combustion device 212 is provided in the lower portion of the furnace wall forming the furnace 211.

The combustion device 212 includes plural combustion burners 221, 222, 223, 224, and 225 which are attached to the furnace wall. In the embodiment, the combustion burners 221, 222, 223, 224, and 225 are disposed as one set in the circumferential direction at four equal intervals therebetween, and five sets, that is, five stages are disposed in the vertical direction.

Then, the respective combustion burners 221, 222, 223, 224, and 225 are connected to coal pulverizers (mills) 231, 232, 233, 234, and 235 through pulverized coal supply pipes 226, 227, 228, 229, and 230. Although not illustrated in the drawings, the coal pulverizers 231, 232, 233, 234, and 235 have a configuration in which milling tables are supported in a rotational driving state with rotation axes along the vertical direction inside a housing and plural milling rollers are provided while facing the upper sides of the milling tables and are supported so as to be rotatable along with the rotation of the milling tables. Accordingly, when coal is input between plural milling rollers and plural milling tables, the coal is milled into a predetermined size therein. Thus, pulverized coal which is classified by transportation air (primary air) may be supplied from pulverized coal supply pipes 226, 227, 228, 229, and 230 to the combustion burners 221, 222, 223, 224, and 225.

Further, in the furnace 211, wind boxes 236 are provided at the attachment positions of the respective combustion burners 221, 222, 223, 224, and 225, where one end portion of an air duct 237 is connected to the wind box 236 and an air blower 238 is attached to the other end portion of the air duct 237. Accordingly, combustion air (secondary air and tertiary air) sent by the air blower 238 may be supplied from the air duct 237 to the wind box 236, and may be supplied from the wind box 236 to each of the respective combustion burners 221, 222, 223, 224, and 225.

For this reason, in the combustion device 212, the respective combustion burners 221, 222, 223, 224, and 225 may blow the pulverized fuel-air mixture (fuel gas) obtained by mixing the pulverized coal and the primary air into the furnace 211 and may blow the secondary air into the furnace 211. Then, a flame may be formed by igniting the pulverized fuel-air mixture through an ignition torch (not illustrated).

Furthermore, when generally activating the boiler, the respective combustion burners 221, 222, 223, 224, and 225 form a flame by ejecting oil fuel into the furnace 211.

A flue gas duct 240 is connected to the upper portion of the furnace 211, and the flue gas duct 240 is equipped with superheaters 241 and 242, repeaters 243 and 244, and economizers 245, 246, and 247 as convection heat transfer portions for collecting the heat of the flue gas. Accordingly, a heat exchange is performed between water and a flue gas that is produced by the combustion in the furnace 211.

The downstream side of the flue gas duct 240 is connected with a flue gas pipe 248 into which the flue gas subjected to heat exchange is discharged. An air heater 249 is provided between the flue gas pipe 248 and the air duct 237, and a heat exchange is performed between the air flowing through the air duct 237 and the flue gas flowing through the flue gas pipe 248, so that the combustion air flowing through the combustion burners 221, 222, 223, 224, and 225 may increase in temperature.

Furthermore, although not illustrated in the drawings, the flue gas pipe 248 is equipped with a denitration device, an electronic precipitator, an inducing air blower, and a desulfurization device, and the downstream end portion thereof is equipped with a stack.

Accordingly, when the coal pulverizers 231, 232, 233, 234, and 235 are driven, pulverized coal produced therein is supplied along with the transportation air to the combustion burners 221, 222, 223, 224, and 225 through pulverized coal supply pipes 226, 227, 228, 229, and 230. Further, the heated combustion air is supplied from the air duct 237 to the respective combustion burners 221, 222, 223, 224, and 225 through the wind boxes 236. Then, the combustion burners 221, 222, 223, 224, and 225 blow the pulverized fuel-air mixture obtained by mixing the pulverized coal and the transportation air to the furnace 211, blow the combustion air to the furnace 211, and ignite the pulverized fuel-air mixture and the air at this time so as to form a flame. In the furnace 211, when the flame is generated by the combustion of the pulverized fuel-air mixture and the combustion air and the flame is generated at the lower portion inside the furnace 211, the combustion gas (the flue gas) rises inside the furnace 211 so as to be discharged to the flue gas duct 240.

Furthermore, the inside of the furnace 211 is maintained at the reduction atmosphere in a manner such that the air supply amount with respect to the pulverized coal supply amount becomes smaller than the theoretical air amount. Then, when NOx produced by the combustion of the pulverized coal is reduced in the furnace 211 and additional air is additionally supplied thereto, the oxidization combustion of the pulverized coal is completed and hence the production amount of NOx caused by the combustion of the pulverized coal is reduced.

At this time, water supplied from a water feeding pump (not illustrated) is preheated by the economizers 245, 246, and 247, is supplied to a steam drum (not illustrated), and is heated while being supplied to respective water pipes (not illustrated) of the furnace wall so as to become saturated steam. Then, the saturated steam is transported to a steam drum (not illustrated). Further, the saturated steam of a steam drum (not illustrated) is introduced into the superheaters 241 and 242 and is superheated by the combustion gas. The superheated steam produced by the superheaters 241 and 242 is supplied to a power generation plant (not illustrated) (for example, a turbine or the like). Further, the steam which is extracted during the expanding process in the turbine is introduced into the repeaters 243 and 244, is superheated again, and is returned to the turbine. Furthermore, the furnace 211 of a drum type (steam drum) has been described, but the invention is not limited to the structure.

Subsequently, a harmful substance such as NOx is removed from the flue gas which passes through the economizers 245, 246, and 247 of the flue gas duct 240 by a catalyst in the flue gas pipe 248, a particulate substance is removed therefrom by the electronic precipitator, and a sulfur content is removed therefrom by the desulfurization device. Then, the flue gas is discharged to the atmosphere through the stack.

Here, the combustion device 212 will be described in detail, but since the respective combustion burners 221, 222, 223, 224, and 225 constituting the combustion device 212 have substantially the same configuration, only the combustion burner 221 that is positioned at the uppermost stage will be described.

As illustrated in FIG. 19, the combustion burner 221 includes the combustion burners 221*a*, 221*b*, 221*c*, and 221*d* which are provided at four wall surfaces of the furnace 211. The respective combustion burners 221*a*, 221*b*, 221*c*, and 221*d* are connected with respective branch pipes 226*a*, 226*b*, 226*c*, and 226*d* which are branched from a pulverized coal supply pipe 226, and are connected with respective branch pipes 237*a*, 237*b*, 237*c*, and 237*d* branched from the air duct 237.

Accordingly, the respective combustion burners 221*a*, 221*b*, 221*c*, and 221*d* which are positioned at the respective wall surfaces of the furnace 211 blow the pulverized fuel-air mixture obtained by mixing the pulverized coal and the transportation air to the furnace 211 and blow the combustion air to the outside of the pulverized fuel-air mixture. Then, the pulverized fuel-air mixture is ignited from the respective combustion burners 221*a*, 221*b*, 221*c*, and 221*d*, so that four flames F1, F2, F3, and F4 may be formed. The flames F1, F2, F3, and F4 become a flame swirl flow that turns in the counter-clockwise direction when viewed from the upside of the furnace 211 (in FIG. 19).

As illustrated in FIGS. 16 and 17, in the combustion burner 221 (221*a*, 221*b*, 221*c*, and 221*d*) with such a configuration, the combustion burner is equipped with a fuel nozzle 251, a secondary air nozzle 252, and a tertiary air nozzle 253 which are provided from the center side thereof and is equipped with a flame stabilizer 254. The fuel nozzle 251 may blow the fuel gas (the pulverized fuel-air mixture) obtained by mixing the pulverized coal (the solid fuel) with the transportation air (the primary air). The secondary air nozzle 252 is disposed at the outside of the first nozzle 251 and may blow the combustion air (the secondary air) to the outer peripheral side of the fuel gas ejected from the fuel nozzle 251. The tertiary air nozzle 253 is disposed at the outside of the secondary air nozzle 252 and may blow the tertiary air to the outer peripheral side of the secondary air ejected from the secondary air nozzle 252.

Further, the flame stabilizer 254 is disposed inside the fuel nozzle 51 so as to be positioned at the downstream side of the fuel gas blowing direction and near the axis center, and serves to ignite and stabilize the fuel gas. The flame stabilizer 254 is formed in a so-called double cross split structure in which first flame stabilizing members 261 and 262 following the horizontal direction and second flame stabilizing members 263 and 264 following the vertical direction (the up and down direction) are disposed in a cross shape. Then, the respective first flame stabilizing members 261 and 262 include flat portions 261*a* and 262*a* each formed in a flat plate shape having a uniform thickness and widened portions 61*b* and 262*b* integrally formed with the front end portions of the flat portions 261*a* and 262*a* (the downstream end portions in the fuel gas flowing direction). Each cross-section of the widened portions 261*b* and 262*b* is formed in an isosceles triangular shape, each width of the widened portions is widened toward the downstream side in the fuel gas flowing direction, and each front end thereof is formed as a plane perpendicular to the fuel gas flowing direction. Furthermore, although not illustrated in the drawings, the respective second flame stabilizing members 263 and 264 also have the same structure.

For this reason, each of the fuel nozzle 251 and the secondary air nozzle 252 has an elongated tubular shape, the fuel nozzle 251 includes a rectangular opening portion 251*a*, and the secondary air nozzle 252 includes a rectangular annular opening portion 252*a*. Thus, the fuel nozzle 251 and the secondary air nozzle 252 are formed as a double tube structure. The tertiary air nozzle 253 is disposed as a double tube structure at the outside of the fuel nozzle 251 and the secondary air nozzle 252, and includes a rectangular annular opening portion 253*a*. As a result, the opening portion 252*a* of the secondary air nozzle 252 is disposed at the outside of the opening portion 251*a* of the fuel nozzle 251, and the opening portion 253*a* of the tertiary air nozzle 253 is disposed at the outside of the opening portion 252*a* of the secondary air nozzle 252. Furthermore, the tertiary air nozzle 253 may not be disposed as a double tube structure, and the tertiary air nozzle may be obtained by separately disposing plural nozzles at the outer peripheral side of the secondary air nozzle 252.

In the nozzles 251, 252, and 253, the opening portions 251*a*, 252*a*, and 253*a* are disposed so as to be flush with one another. Further, the flame stabilizer 254 is supported by the inner wall surface of the fuel nozzle 251 or a plate member (not illustrated) from the upstream side of the passage through which the fuel gas flows. Further, since plural flame stabilizing members 261, 262, 263, and 264 are disposed as the flame stabilizer 254 inside the fuel nozzle 251, the fuel gas passage is divided into nine segments. Then, in the flame stabilizer 254, the widened portions 261*b* and 262*b* of which the widths are wide are positioned at the front end portions thereof, and the front end surfaces of the widened portions 261*b* and 262*b* are evenly disposed so as to be flush with the opening portion 251*a*.

Further, in the combustion burner 221 of the seventh embodiment, a guide member 255 is provided so as to guide the fuel gas flowing through the fuel nozzle 251 toward the axis center side. The guide member 255 guides the fuel gas in a direction in which the fuel gas is separated from the secondary air blowing from the secondary air nozzle 252.

The guide member 255 is disposed in the inner wall surface of the front end portion of the fuel nozzle 251 in the circumferential direction. That is, the guide member 255 includes an upper guide member 265 that is disposed along the upper wall surface of the fuel nozzle 251, a lower guide member 266 that is disposed along the lower wall surface of the fuel nozzle 251, and left and right guide members 267 and 268 that are disposed along the left and right wall surfaces of the fuel nozzle 251. Then, the guide member 255 is disposed at the front end portion of the fuel nozzle 251 so as to face the widened portions 261*b* and 262*b* of the flame stabilizer 254. Then, the guide member 255 is provided with an inclined surface 269 of which the cross-section is formed in a triangular shape and the width is widened toward the downstream side in the fuel gas flowing direction, the front end thereof is formed as a plane perpendicular to the fuel gas flowing direction. Then, the inclined surface is flush with the opening portions 251*a* and 252*a*. Furthermore, the guide member 55 is formed by notching a position intersecting the respective flame stabilizing members 261, 262, 263, and 264.

Accordingly, in the combustion burner 221, the fuel gas obtained by mixing the pulverized coal with the primary air blows from the opening portion 251*a* of the fuel nozzle 251 into the furnace, the secondary air at the outside thereof blows from the opening portion 252*a* of the secondary air nozzle 252 into the furnace, and the tertiary air at the outside thereof blows from the opening portion 253*a* of the tertiary air nozzle 253 into the furnace. At this time, the fuel gas is divided by the flame stabilizer 254 at the opening portion 251*a* of the fuel nozzle 251, and is ignited so as to become the combustion gas. Further, since the secondary air blows to the outer periphery of the fuel gas, the combustion of the fuel gas is promoted. Further, since the tertiary air blows to the outer periphery of the combustion flame, the combustion may be optimally performed by adjusting the ratio between the secondary air and the tertiary air.

Then, since the flame stabilizer 254 is formed in a split shape in the combustion burner 221, the fuel gas is divided by the flame stabilizer 254 at the opening portion 251*a* of the fuel nozzle 251. At this time, the flame stabilizer 254 is disposed at the center zone of the opening portion 251*a* of the fuel nozzle 251, and the fuel gas is ignited and stabilized at the center zone. Thus, the inner flame stabilization (the flame stabilization at the center zone of the opening portion 251*a* of the fuel nozzle 251) of the combustion flame is realized.

For this reason, compared to the configuration in which the outer flame stabilization of the combustion flame is performed, the temperature of the outer peripheral portion of the combustion flame becomes low, and hence the temperature of the outer peripheral portion of the combustion flame under the high oxygen atmosphere by the secondary air may become low. Thus, the NOx production amount at the outer peripheral portion of the combustion flame is reduced.

Further, since the combustion burner 221 employs a configuration in which the inner flame stabilization is performed, it is desirable to supply the fuel gas and the combustion air (the secondary air and the tertiary air) as a straight flow. That is, it is desirable that the fuel nozzle 251 have a structure in which the secondary air nozzle 252 and the tertiary air nozzle 253 supply the fuel gas, the secondary air, and the tertiary air as a straight flow instead of a swirl flow. Since the fuel gas, the secondary air, and the tertiary air are ejected as the straight flow so as to form the combustion flame, the circulation of the gas inside the combustion flame is suppressed in the configuration in which the inner flame stabilization of the combustion flame is performed. Accordingly, the outer peripheral portion of the combustion flame is maintained in a low temperature, and the NOx production amount caused by the mixture with the secondary air is reduced.

Further, in the combustion burner 221, since the guide member 255 is disposed so as to be positioned in the entire circumference of the front end portion of the fuel nozzle 251, the fuel gas flowing through the fuel nozzle 251 is guided toward the center side thereof, that is, the flame stabilizer 254 by the inclined surface 269 of the guide member 255. Then, the fuel gas blowing into the furnace by the fuel nozzle 251 is guided in a direction in which the fuel gas is separated from the secondary air blowing from the secondary air nozzle 252. For this reason, since the fuel gas is separated from the secondary air of which the speed is faster than that of the fuel gas, the inner flame stabilization is appropriately performed by the flame stabilizer 254. Further, since the fuel gas is separated from the secondary air and the NOx production amount caused by the mixture with the secondary air is reduced in the fuel gas. Furthermore, the pulverized coal may be appropriately supplied toward the flame stabilizer 254.

In this way, in the combustion burner of the seventh embodiment, there are provided the fuel nozzle 251 which may blow the fuel gas obtained by mixing the pulverized coal with the primary air and the secondary air nozzle 252 which may blow the secondary air from the outside of the fuel nozzle 251. Also, the flame stabilizer 254 is provided at the front end portion of the fuel nozzle 251 so as to be near the axis center, and the guide member 255 is provided so as to guide the fuel gas flowing through the fuel nozzle 251 toward the axis center side.

Accordingly, the fuel gas flowing through the fuel nozzle 251 is guided toward the axis center side of the fuel nozzle 251, that is, the flame stabilizer 254 by the guide member 255, and the appropriate flow of the fuel gas inside the fuel nozzle 251 may be realized. As a result, the inner flame stabilization performance using the flame stabilizer 254 may be improved.

Further, in the combustion burner of the seventh embodiment, the guide member 255 guides the fuel gas in a direction in which the fuel gas is separated from the secondary air blowing from the secondary air nozzle 252. Accordingly, the fuel gas is guided by the guide member 255 in a direction in which the fuel gas is separated from the secondary air and the mixing of the fuel gas and the secondary air is suppressed, the inner flame stabilization performance using the flame stabilizer 254 may be improved, and the outer peripheral portion of the combustion flame is maintained at the low temperature. Thus, the NOx production amount caused by the mixing of the combustion gas and the secondary air may be reduced.

Further, in the combustion burner of the seventh embodiment, the guide member 255 is disposed along the inner wall surface of the fuel nozzle 251. Accordingly, the fuel gas flowing through the fuel nozzle 251 may be effectively guided to the flame stabilizer 254 throughout the entire area of the fuel nozzle 251, and the fuel gas may be guided in a direction in which the fuel gas is separated from the secondary air. The inner flame stabilization performance using the flame stabilizer 254 may be improved.

Further, in the combustion burner of the seventh embodiment, the guide member 255 is disposed at the front end portion of the fuel nozzle 251 so as to face the flame stabilizer 254. In this case, the guide member 255 is disposed in the flame stabilizer 254 so as to face the widened portions 261*b* and 262*b*. Accordingly, since the fuel gas is guided toward the widened portions 261*b* and 262*b* of the flame stabilizer 254 by the guide member 255, the sufficient flame stabilizing function may be ensured, and the inner flame stabilization performance may be improved.

Eighth Embodiment

Figure 20:
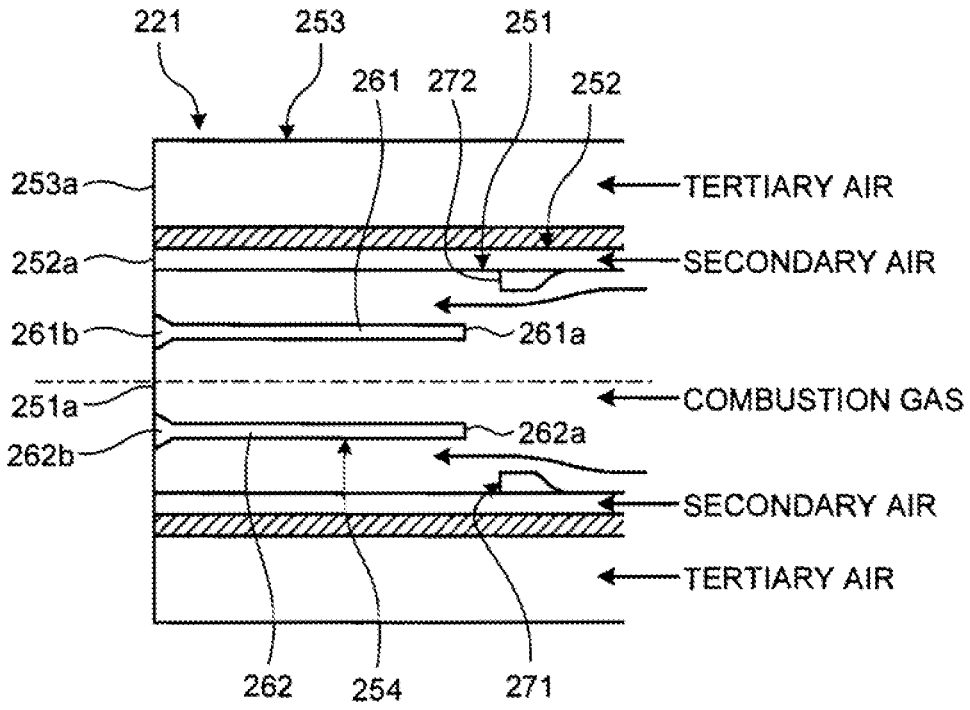
FIG. 20 is a cross-sectional view illustrating a combustion burner according to an eighth embodiment of the invention.

FIG. 20 is a cross-sectional view illustrating a combustion burner according to an eighth embodiment of the invention. Furthermore, the same reference sign will be given to the component having the same function as that of the above-described embodiment, and the detailed description thereof will not be repeated.

In the combustion burner of the eighth embodiment, as illustrated in FIG. 20, the combustion burner 221 is equipped with the fuel nozzle 251, the secondary air nozzle 252, and the tertiary air nozzle 253 which are provided from the center side of the combustion burner, and is equipped with the flame stabilizer 254. Then, since the fuel gas flowing through the fuel nozzle 251 is guided to the axis center side, a guide member 271 is provided so as to guide the fuel gas in a direction in which the fuel gas is separated from the secondary air blowing from the secondary air nozzle 252.

The guide member 271 is disposed in the inner wall surface of the fuel nozzle 251 along the circumferential direction so as to be positioned at a position where the guide member does not face the flame stabilizer 254 disposed inside the fuel nozzle 251, that is, the upstream side of the flame stabilizer 254 in the fuel gas flowing direction. The guide member 271 is formed in the inner wall surface of the fuel nozzle 251 in an annular shape which protrudes toward the flame stabilizer 254, and is equipped with a guide surface (an inclined surface or a curved surface) 272 which guides the fuel gas inside the fuel nozzle 251 toward the axis center side.

Accordingly, since the guide member 271 is disposed so as to be positioned at the entire circumference of the front end portion of the fuel nozzle 251 in the combustion burner 221, the fuel gas flowing through the fuel nozzle 251 is guided toward the axis center side of the fuel nozzle, that is, the flame stabilizer 254 by the guide surface 272 of the guide member 271. Then, the fuel gas flowing from the fuel nozzle 251 into the furnace is guided in a direction in which the fuel gas is separated from the secondary air blowing from the secondary air nozzle 252. For this reason, since the fuel gas is separated from the secondary air of which the speed is faster than that of the fuel gas, the inner flame stabilization using the flame stabilizer 254 may be performed. Further, since the fuel gas is separated from the secondary air and the NOx production amount caused by the mixture with the secondary air is reduced in the fuel gas.

In this way, in the combustion burner of the eighth embodiment, there are provided the fuel nozzle 251 which may blow the fuel gas obtained by mixing the pulverized coal with the primary air and the secondary air nozzle 252 which may blow the secondary air from the outside of the fuel nozzle 251. Also, the flame stabilizer 254 is provided at the front end portion of the fuel nozzle 251 so as to be near the axis center, and the guide member 271 which guides the fuel gas flowing through the fuel nozzle 251 toward the axis center side is provided at the upstream side of the flame stabilizer 254 in the fuel gas flowing direction.

Accordingly, the fuel gas flowing through the fuel nozzle 251 is guided toward the axis center side of the fuel nozzle 251, that is, the flame stabilizer 254 by the guide member 271, and the appropriate flow of the fuel gas inside the fuel nozzle 251 may be realized. As a result, the inner flame stabilization performance using the flame stabilizer 254 may be improved. Further, since the guide member 271 is provided at the upstream side in relation to the flame stabilizer 254, the fuel gas may be effectively guide to the flame stabilizer 254, and the inner flame stabilization performance using the flame stabilizer 254 may be improved. Further, since the guide member 271 is not provided at the front end side inside the fuel nozzle 251, the guide member 271 does not serve as the flame stabilizer.

Ninth Embodiment

Figure 21:
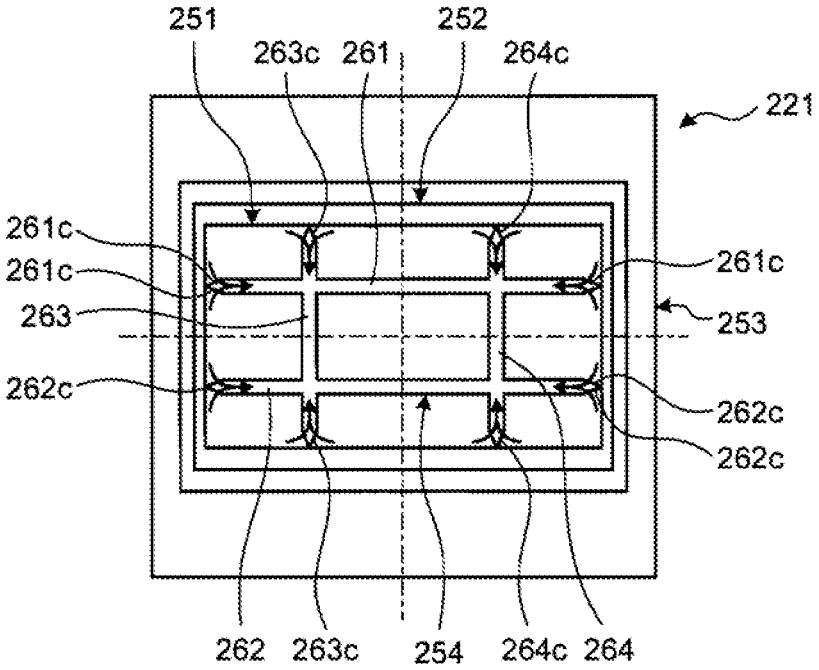
FIG. 21 is a front view illustrating a combustion burner according to a ninth embodiment of the invention.

FIG. 21 is a front view illustrating a combustion burner according to a ninth embodiment of the invention. Furthermore, the same reference sign will be given to the component having the same function as that of the above-described embodiment, and the detailed description thereof will not be repeated.

In the combustion burner of the ninth embodiment, as illustrated in FIG. 21, the combustion burner 221 is equipped with the fuel nozzle 251, the secondary air nozzle 252, and the tertiary air nozzle 253 which are provided from the center side of the combustion burner, and is equipped with the flame stabilizer 254. Then, since the fuel gas flowing through the fuel nozzle 251 is guided toward the axis center side of the fuel nozzle, a guide member is provided so as to guide the fuel gas in a direction in which the fuel gas is separated from the secondary air blowing from the secondary air nozzle 252.

The guide member is disposed at the widened portions 261*b* and 262*b* of the flame stabilizer 254 so as to face the inner wall surface of the fuel nozzle 251. That is, in the flame stabilizer 254, the first flame stabilizing members 261 and 262 following the horizontal direction and the second flame stabilizing members 263 and 264 following the vertical direction are disposed so as to intersect one another, and the guide member is formed as notched surfaces 261*c*, 262*c*, 263*c*, and 264*c* formed in the end portions of the widened portions 261*b* and 262*b* of the respective flame stabilizing members 261, 262, 263, and 264. The respective notched surfaces 261*c*, 262*c*, 263*c*, and 264*c* are formed in a tapered shape in which an inclined surface is formed at both sides of each end portion when viewed from the front sides of the respective flame stabilizing members 261, 262, 263, and 264.

Accordingly, in the combustion burner 221, since the notched surfaces 261*c*, 262*c*, 263*c*, and 264*c* are formed as the guide member at the end portions of the respective flame stabilizing members 261, 262, 263, and 264 of the flame stabilizer 254, the fuel gas flowing through the fuel nozzle 251 is guided by the respective notched surfaces 261*c*, 262*c*, 263*c*, and 264*c* toward the axis center side of the fuel nozzle, that is, the inside of the respective flame stabilizing members 261, 262, 263, and 264 in the longitudinal direction. That is, when the fuel gas passes through the vicinity of the notched surfaces 261*c*, 262*c*, 263*c*, and 264*c* of the respective flame stabilizing members 261, 262, 263, and 264, the front end surface sides of the respective flame stabilizing members 261, 262, 263, and 264 have a negative pressure. Accordingly, the fuel gas is guided to the negative pressure zone, and hence the flow indicated by the arrow of FIG. 21 occurs.

Then, the fuel gas blowing into the furnace by the fuel nozzle 251 is guided in a direction in which the fuel gas is separated from the secondary air blowing from the secondary air nozzle 252. For this reason, since the fuel gas is separated from the secondary air of which the speed is faster than that of the fuel gas, the inner flame stabilization using the flame stabilizer 254 may be performed. Further, since the fuel gas is separated from the secondary air and the NOx production amount caused by the mixture with the secondary air is reduced in the fuel gas.

In this way, in the combustion burner of the ninth embodiment, there are provided the fuel nozzle 251 which may blow the fuel gas obtained by mixing the pulverized coal with the primary air and the secondary air nozzle 252 which may blow the secondary air from the outside of the fuel nozzle 251. Also, the flame stabilizer 254 is provided at the front end portion of the fuel nozzle 251 so as to be near the axis center, and as the guide member that guides the fuel gas flowing through the fuel nozzle 251 toward the axis center side of the fuel nozzle, the notched surfaces 261*c*, 262*c*, 263*c*, and 264*c* are provided at the end portions of the respective flame stabilizing members 261, 262, 263, and 264 of the flame stabilizer 254.

Accordingly, the fuel gas flowing through the fuel nozzle 251 is guided by the notched surfaces 261*c*, 262*c*, 263*c*, and 264*c* toward the axis center side of the fuel nozzle 251, that is, the center side of the flame stabilizer 254, and hence the appropriate flow of the fuel gas inside the fuel nozzle 251 may be realized. As a result, the inner flame stabilization performance using the flame stabilizer 254 may be improved. Further, since the guide member is formed by forming the notched surfaces 261*c*, 262*c*, 263*c*, and 264*c* at the end portion of the flame stabilizer 254, the apparatus may be simplified.

Furthermore, in the ninth embodiment, the guide member is formed as the notched surfaces 261*c*, 262*c*, 263*c*, and 264*c* which are formed at the end portions of the flame stabilizing members 261, 262, 263, and 264 in the longitudinal direction so as to have a tapered shape, but the invention is not limited to the shape. For example, the notched surfaces may be formed by notching only one side of the end portions of the flame stabilizing members 261, 262, 263, and 264 in the longitudinal direction or the notched portions may be formed by cutting the flame stabilizing members 261, 262, 263, and 264 in a direction perpendicular to the longitudinal direction thereof so as to be separated from the inner wall surface of the fuel nozzle 251. Further, the respective notched surfaces 261*c*, 262*c*, 263*c*, and 264*c* may be formed in a shape in which the widths thereof are widened at the downstream side in the fuel gas flowing direction as in the widened portions 261*b* and 262*b*.

Tenth Embodiment

Figure 22:
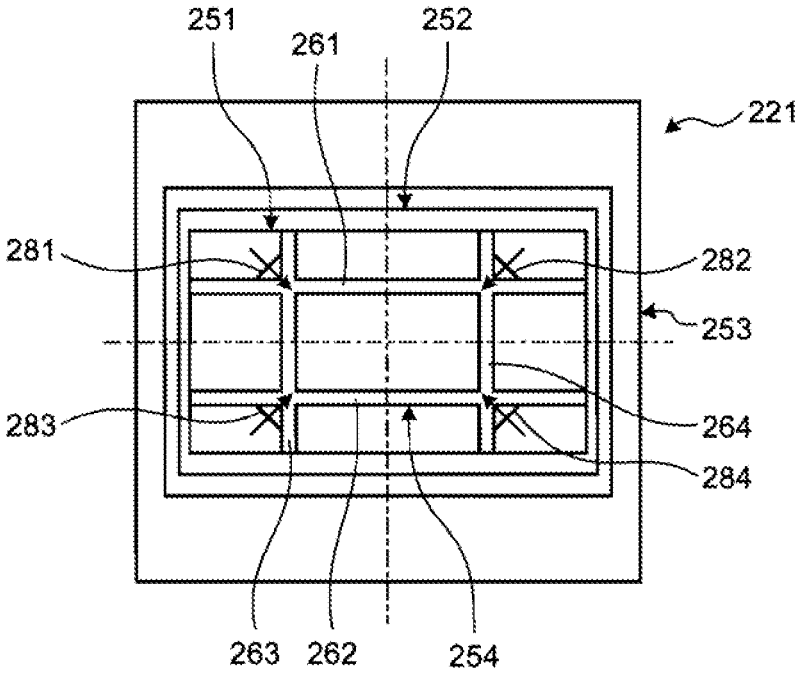
FIG. 22 is a front view illustrating a combustion burner according to a tenth embodiment of the invention.

FIG. 22 is a front view illustrating a combustion burner according to a tenth embodiment of the invention. Furthermore, the same reference sign will be given to the component having the same function as that of the above-described embodiment, and the detailed description thereof will not be repeated.

In the combustion burner of the tenth embodiment, as illustrated in FIG. 22, the combustion burner 221 is equipped with the fuel nozzle 251, the secondary air nozzle 252, and the tertiary air nozzle 253 which are provided from the center side of the combustion burner, and is equipped with the flame stabilizer 254. Then, since the fuel gas flowing through the fuel nozzle 251 is guided toward the axis center side of the fuel nozzle, a guide member is provided so as to guide the fuel gas in a direction in which the fuel gas is separated from the secondary air blowing from the secondary air nozzle 252.

The guide member is disposed as triangular plates 281, 282, 283, and 284 so as to be positioned at a position where the first flame stabilizing members 261 and 262 intersect the second flame stabilizing members 263 and 264. Specifically, the guide member is disposed at the outside of the position where the widened portions 261*b* and 262*b* of the first flame stabilizing members 261 and 262 intersect the widened portions (not illustrated) of the second flame stabilizing members 263 and 264, that is, the opposite side to the axis center of the fuel nozzle 251. The respective triangular plates 281, 282, 283, and 284 are formed in a triangular shape by forming an inclined surface at the outside of each intersected corner when viewed from the front sides of the respective flame stabilizing members 261, 262, 263, and 264.

Accordingly, since the triangular plates 281, 282, 283, and 284 are disposed at the outside of the intersection points of the respective flame stabilizing members 261, 262, 263, and 264 of the flame stabilizer 54 in the combustion burner 221, the fuel gas flowing through the fuel nozzle 251 is guided by the respective triangular plates 281, 282, 283, and 284 toward the axis center side of the fuel nozzle, that is, the center portions of the respective flame stabilizing members 261, 262, 263, and 264. That is, when the fuel gas passes through the vicinity of the respective triangular plates 281, 282, 283, and 284, the front surface sides of the respective triangular plates 281, 282, 283, and 284 have a negative pressure. Accordingly, the fuel gas is guided to the negative pressure zone, and hence the flow indicated by the arrow of FIG. 22 occurs.

Then, the fuel gas blowing into the furnace by the fuel nozzle 251 is guided in a direction in which the fuel gas is separated from the secondary air blowing from the secondary air nozzle 252. For this reason, since the fuel gas is separated from the secondary air of which the speed is faster than that of the fuel gas, the inner flame stabilization using the flame stabilizer 254 may be performed. Further, since the fuel gas is separated from the secondary air and the NOx production amount caused by the mixture with the secondary air is reduced in the fuel gas.

In this way, in the combustion burner of the tenth embodiment, there are provided the fuel nozzle 251 which may blow the fuel gas obtained by mixing the pulverized coal with the primary air and the secondary air nozzle 252 which may blow the secondary air from the outside of the fuel nozzle 251. Also, the flame stabilizer 254 is provided at the front end portion of the fuel nozzle 251 so as to be near the axis center, and as the guide member that guides the fuel gas flowing through the fuel nozzle 251 toward the axis center side of the fuel nozzle, the triangular plates 281, 282, 283, and 284 are disposed at the intersection positions of the respective flame stabilizing members 261, 262, 263, and 264 of the flame stabilizer 254.

Accordingly, the fuel gas flowing through the fuel nozzle 251 is guided by the triangular plates 281, 282, 283, and 284 toward the axis center side of the fuel nozzle 251, that is, the center side the flame stabilizer 254, and hence the appropriate flow of the fuel gas inside the fuel nozzle 251 may be realized. As a result, the inner flame stabilization performance using the flame stabilizer 254 may be improved. Further, the flame stabilizer 254 is formed in a structure in which two first flame stabilizing members 261 and 262 provided in the horizontal direction while being parallel to each other in the vertical direction with a predetermined gap therebetween and two second flame stabilizing members 263 and 264 provided in the vertical direction while being parallel to each other in the horizontal direction with a predetermined gap therebetween are disposed so as to intersect one another. Accordingly, since the flame stabilizer 254 is formed in a double cross structure, the sufficient flame stabilizing function may be ensured. Further, since the guide member is formed as the triangular plates 281, 282, 283, and 284, the fuel gas flowing through the fuel nozzle 251 may be effectively guided toward the axis center side.

Furthermore, in the tenth embodiment, the guide member is formed as the triangular plates 281, 282, 283, and 284, but the invention is not limited to the shape. For example, the respective triangular plates 281, 282, 283, and 284 may be formed in a shape in which the widths thereof at the downstream side in the fuel gas flowing direction are widened as in the widened portions 261*b* and 262*b*.

Eleventh Embodiment

Figure 23:
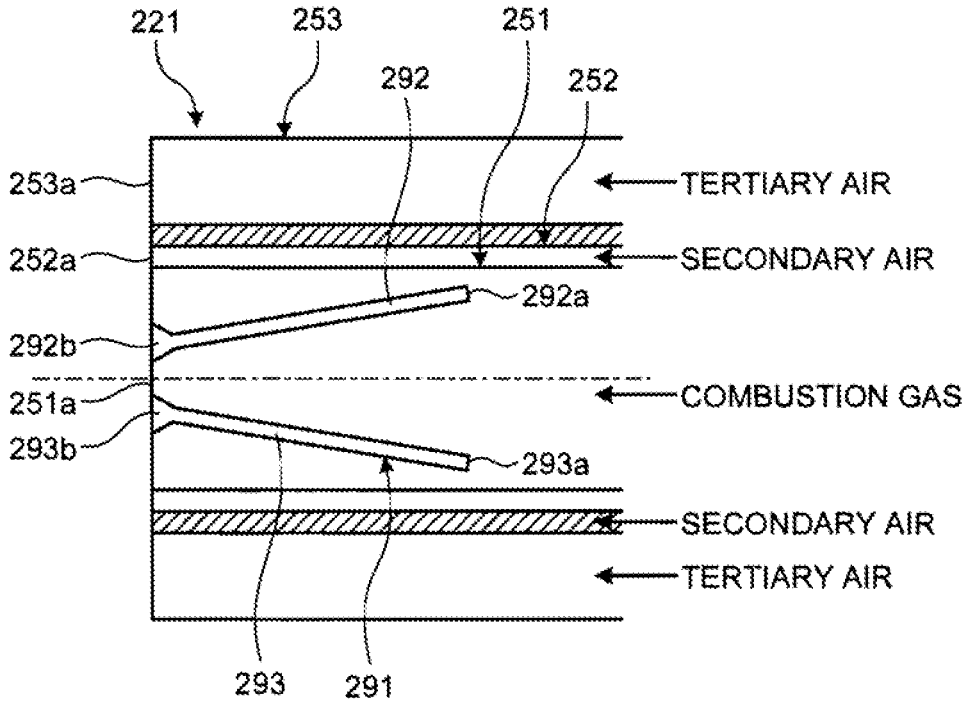
FIG. 23 is a cross-sectional view illustrating a combustion burner according to an eleventh embodiment of the invention.
Figure 24:
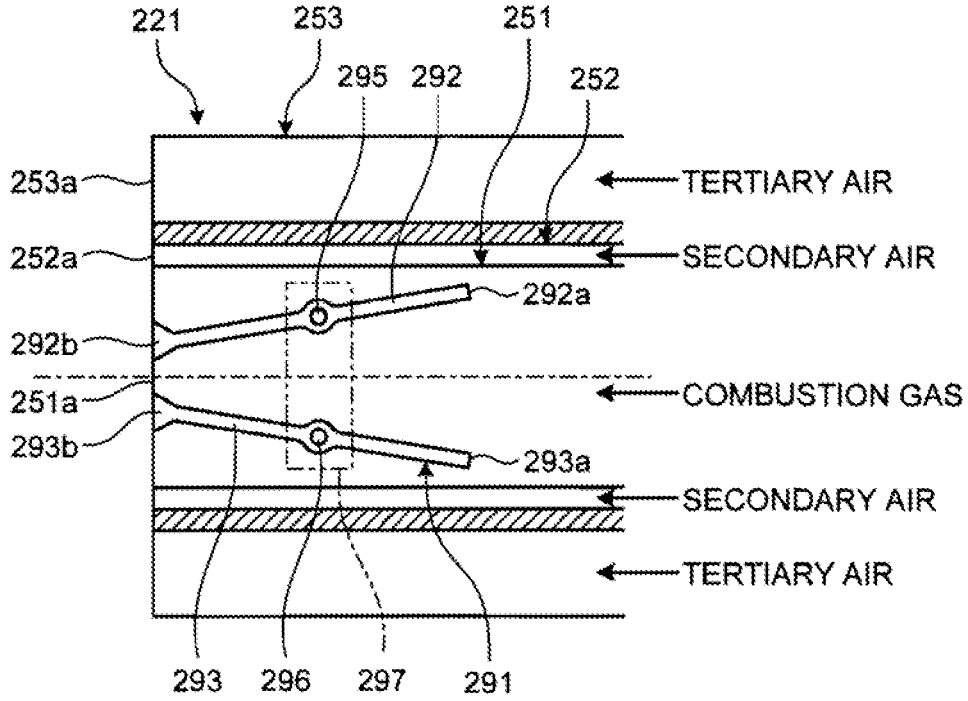
FIG. 24 is a cross-sectional view illustrating a modified example of the combustion burner of the eleventh embodiment.

FIG. 23 is a cross-sectional view illustrating a combustion burner according to an eleventh embodiment of the invention, and FIG. 24 is a cross-sectional view illustrating a modified example of the combustion burner of the eleventh embodiment. Furthermore, the same reference sign will be given to the component having the same function as that of the above-described embodiment, and the detailed description thereof will not be repeated.

In the combustion burner of the eleventh embodiment, as illustrated in FIG. 23, the combustion burner 221 is equipped with the fuel nozzle 251, the secondary air nozzle 252, and the tertiary air nozzle 253 which are provided from the center side of the combustion burner, and is equipped with a flame stabilizer 291. Then, since the fuel gas flowing through the fuel nozzle 251 is guided toward the axis center side of the fuel nozzle, a guide member is provided so as to guide the fuel gas in a direction in which the fuel gas is separated from the secondary air blowing from the secondary air nozzle 252.

That is, the flame stabilizer 291 includes flame stabilizing members 292 and 293 following the horizontal direction, and the flame stabilizing members 292 and 293 include flat portions 292*a* and 293*a* which are formed in a flat plate shape having a uniform thickness and widened portions 292*b* and 293*b* which are integrally formed with the front end portions of the flat portions 292*a* and 293*a* (the downstream end portions in the fuel gas flowing direction). Each cross-section of the widened portions 292*b* and 293*b* is formed in an isosceles triangular shape, each width of the widened portions is widened toward the downstream side in the fuel gas flowing direction, and each front end thereof is formed as a plane perpendicular to the fuel gas flowing direction.

Then, the guide member is formed by directing the front end portions of the flame stabilizing members 292 and 293 toward the axis center side of the fuel nozzle 251. That is, the flame stabilizing members 292 and 293 are inclined with respect to the axis center of the fuel nozzle 251 in a manner such that the widened portions 292*b* and 293*b* formed at the front end portion thereof are disposed so as to be close to each other compared to the rear end portions of the flat portions 292*a* and 293*a*.

Accordingly, since the front end portions of the flame stabilizing members 292 and 293 are disposed so as to be close to each other at the flame stabilizer 291 inside the fuel nozzle 251 in the combustion burner 221, the fuel gas flowing through the fuel nozzle 251 is guided by the flame stabilizing members 292 and 293 toward the axis center side. That is, since the front end portions of the flame stabilizing members 292 and 293 are close to each other, the fuel gas becomes fast between the flame stabilizing members 292 and 293 and becomes low between the fuel nozzle 251 and the flame stabilizing members 292 and 293. Thus, the fuel gas is guided toward the axis center of the fuel nozzle 251 on the whole.

Then, the fuel gas blowing into the furnace by the fuel nozzle 251 is guided in a direction in which the fuel gas is separated from the secondary air blowing from the secondary air nozzle 252. For this reason, since the fuel gas is separated from the secondary air of which the speed is faster than that of the fuel gas, the inner flame stabilization using the flame stabilizer 291 is appropriately performed. Further, since the fuel gas is separated from the secondary air and the NOx production amount caused by the mixture with the secondary air is reduced in the fuel gas.

In this case, the inclination angles of the flame stabilizing members 292 and 293 constituting the flame stabilizer 291 may be adjusted. That is, as illustrated in FIG. 24, the flame stabilizing members 292 and 293 are supported so as to be rotatable up and down by support shafts 295 and 296 following the horizontal direction perpendicular to the fuel gas flowing direction of the fuel nozzle 251, and are rotatable by a driving device 297. That is, the inclination angles of the flame stabilizing members 292 and 293 may be individually adjusted by the driving device 297.

Accordingly, the optimal blowing state of the fuel gas may be maintained in a manner such that the driving device 297 individually adjusts the angles of the flame stabilizing members 292 and 293 based on, for example, the characteristics or the speed of the fuel gas, the speed of the secondary air, and the combustion state inside the furnace 211.

In this way, in the combustion burner of the eleventh embodiment, there are provided the fuel nozzle 251 which may blow the fuel gas obtained by mixing the pulverized coal with the primary air and the secondary air nozzle 252 which may blow the secondary air from the outside of the fuel nozzle 251. Also, the flame stabilizer 291 is provided at the front end portion of the fuel nozzle 251 so as to be near the axis center, and as the guide member that guides the fuel gas flowing through the fuel nozzle 251 toward the axis center side of the fuel nozzle, the flame stabilizing members 292 and 293 of the flame stabilizer 291 are disposed so that the front end portions thereof face the axis center side of the fuel nozzle 251.

Accordingly, the fuel gas flowing through the fuel nozzle 251 is guided by the inclined flame stabilizing members 292 and 293 toward the axis center side of the fuel nozzle 251, that is, the center side of the flame stabilizer 291, and hence the appropriate flow of the fuel gas inside the fuel nozzle 251 may be realized. As a result, the inner flame stabilization performance using the flame stabilizer 291 may be improved. Further, since the guide member is formed by the arrangement of the flame stabilizing members 292 and 293 of the flame stabilizer 291, the structure may be simplified.

Further, in the combustion burner of the eleventh embodiment, it is possible to individually adjust the inclination angles of the flame stabilizing members 292 and 293 by the driving device 297. Accordingly, the optimal blowing state of the fuel gas may be maintained by changing the angles of the flame stabilizing members 292 and 293 based on, for example, the characteristics or the speed of the fuel gas, the speed of the secondary air, and the combustion state inside the furnace 211.

Furthermore, in the above-described respective embodiments, the configurations of the flame stabilizers 254 and 291 have been described by various examples, but the invention is not limited to the above-described configurations. That is, the burner of the invention is used to realize the inner flame stabilization. Then, the flame stabilizer may be provided toward the axis center side of the fuel nozzle 251 instead of the inner wall surface of the fuel nozzle 251, the number or the position of the flame stabilizing members may be appropriately set, and the flame stabilizing member may be separated from the inner wall surface of the fuel nozzle 251. Further, the configuration of the guide member has been described by various examples, but the configuration is not limited to the above-described configuration. That is, the fuel gas inside the fuel nozzle may be guided toward the axis center side by the guide member.

Further, the flame stabilizer of the invention is equipped with the widened portion having a triangular cross-sectional shape, but the invention is not limited to the shape. That is, the shape may be a square shape and the widened portion may not be provided.

Further, in the above-described respective embodiments, the guide member of the invention is provided in the inner wall surface of the fuel nozzle or the flame stabilizer, but a separate member may be provided between the inner wall surface of the fuel nozzle and the flame stabilizer. For example, the guide member may be formed in a square or argyle frame shape by providing the guide member between the inner wall surface of the fuel nozzle and the flame stabilizer in a direction parallel to or intersecting the flame stabilizer.

Further, in the above-described respective embodiments, four combustion burners 221, 222, 223, 224, and 225 provided in the wall surface of the furnace 211 are disposed at five stages in the vertical direction as the combustion device 212, but the invention is not limited to the configuration. That is, the combustion burner may be disposed at the corner instead of the wall surface. Further, the combustion device is not limited to the turning combustion type, but may be a front combustion type in which the combustion burner is disposed in one wall surface or an opposed combustion type in which the combustion burners are disposed in two wall surfaces so as to be opposed to each other.

Twelfth Embodiment

Hitherto, as the solid-fuel-combustion boiler, there is known, for example, a pulverized-coal-combustion boiler which burns pulverized coal (coal) as solid fuel. In such a pulverized-coal-combustion boiler, two kinds of combustion types, the turning combustion boiler and the wall-combustion boiler are known.

Among these, in the pulverized-coal-combustion turning combustion boiler, secondary air input ports for inputting the secondary air are provided at the upper and lower sides of the primary air input from the coal-combustion burner (the solid-fuel-combustion burner) along with pulverized coal as fuel so as to adjust the flow rate of the secondary air around the coal-combustion burner. Since the air amount of the primary air is needed to transport the pulverized coal as fuel, the air amount is defined in the roller milling device that obtains the pulverized coal by milling coal. Then, since the secondary air blows by the amount necessary for forming the entire flame inside the turning combustion boiler, the secondary air amount of the turning combustion boiler is substantially obtained by subtracting the primary air amount from the entire air amount necessary for the combustion of the pulverized coal. Further, in the burner of the turning combustion boiler, the outer flame stabilization is performed which strengths the ignition of the outer periphery of the flame by the separation of the pulverized coal according to the lean and rich levels.

On the contrary, in the burner of the opposed wall-fired boiler, for example, as disclosed in Patent Literature 2, the secondary air and the tertiary air are introduced to the outer peripheral side of the primary air (the supply of the pulverized coal) so as to finely adjust the air introduction amount. That is, generally, a burner with an outer flame stabilization structure is provided in which a flame stabilizing mechanism (for a front end angle adjustment operation, a turning operation, or the like) is provided at the outer periphery of the burner formed in a circular shape when viewed from the inside of the furnace and an input port for the secondary air or the tertiary air is concentrically provided so as to be near the outer periphery of the burner.

Further, in the conventional pulverized-coal-combustion burner, for example, as disclosed in Patent Literature 3, the ignition of the outer periphery of the flame is further strengthened by the separation of the pulverized coal to the outer periphery according to the lean and rich levels. Further, even in Patent Literature 4, the outer peripheral flame stabilizer and the flame stabilizer formed in a split structure are disclosed. In this case, the outer peripheral flame stabilizer is used for a primary function and the split structure is used for a secondary function.

Incidentally, in the conventional turning combustion boiler, since the secondary air input ports for inputting the secondary air are respectively integrally formed at the upper and lower sides of the coal-combustion burner, the amount of the secondary air input from the secondary air input port may not be finely adjusted. For this reason, a hot oxygen remaining zone is formed at the outer periphery of the flame. Thus, the hot oxygen remaining zone is particularly wide in a zone where the secondary air concentrates, and hence the NOx production amount increases.

Further, in the conventional coal-combustion burner, generally, the outer periphery of the burner is equipped with the flame stabilizing mechanism (for a front end angle adjustment operation, a turning operation, or the like), and a port for inputting the secondary air (or the tertiary air) is provided near the outer periphery. For this reason, the ignition occurs at the outer periphery of the flame, so that a large amount of oxygen is mixed with the outer periphery of the flame. As a result, the combustion at the outer periphery of the flame occurs in a state where the oxygen concentration in the hot oxygen remaining zone of the outer periphery of the flame is high, so that NOx is produced at the outer periphery of the flame. In this way, the NOx produced in the hot oxygen remaining zone of the outer periphery of the flame passes through the outer periphery of the flame, the reduction is later than that of the inside of the flame, which causes NOx from the coal-combustion boiler.

Meanwhile, even in the opposed wall-fired boiler, since the ignition occurs at the outer periphery of the flame by the swirl, NOx is produced as in the outer periphery of the flame.

Due to these circumstances, in the solid-fuel-combustion burner and the solid-fuel-combustion boiler that burns the pulverized solid fuel as in the conventional coal-combustion burner and the conventional coal-combustion boiler, it is desirable to reduce the finally NOx production amount of NOx discharged from the additional air input unit by suppressing the hot oxygen remaining zone formed at the outer periphery of the flame.

The invention is made in view of the above-described circumstances, and it is an object of the invention to provide a solid-fuel-combustion burner and a solid-fuel-combustion boiler capable of reducing a final NOx production amount of NOx discharged from an additional air input unit by suppressing (weakening) a hot oxygen remaining zone formed in an outer periphery of a flame.

Hereinafter, one embodiment of the solid-fuel-combustion burner and the solid-fuel-combustion boiler according to the invention will be described by referring to the drawings. Furthermore, in the embodiment, a turning combustion boiler with a solid-fuel-combustion burner that uses pulverized coal (coal as pulverized solid fuel) will be described as an example of the solid-fuel-combustion burner and the solid-fuel-combustion boiler, but the invention is not limited thereto.

Figure 27:
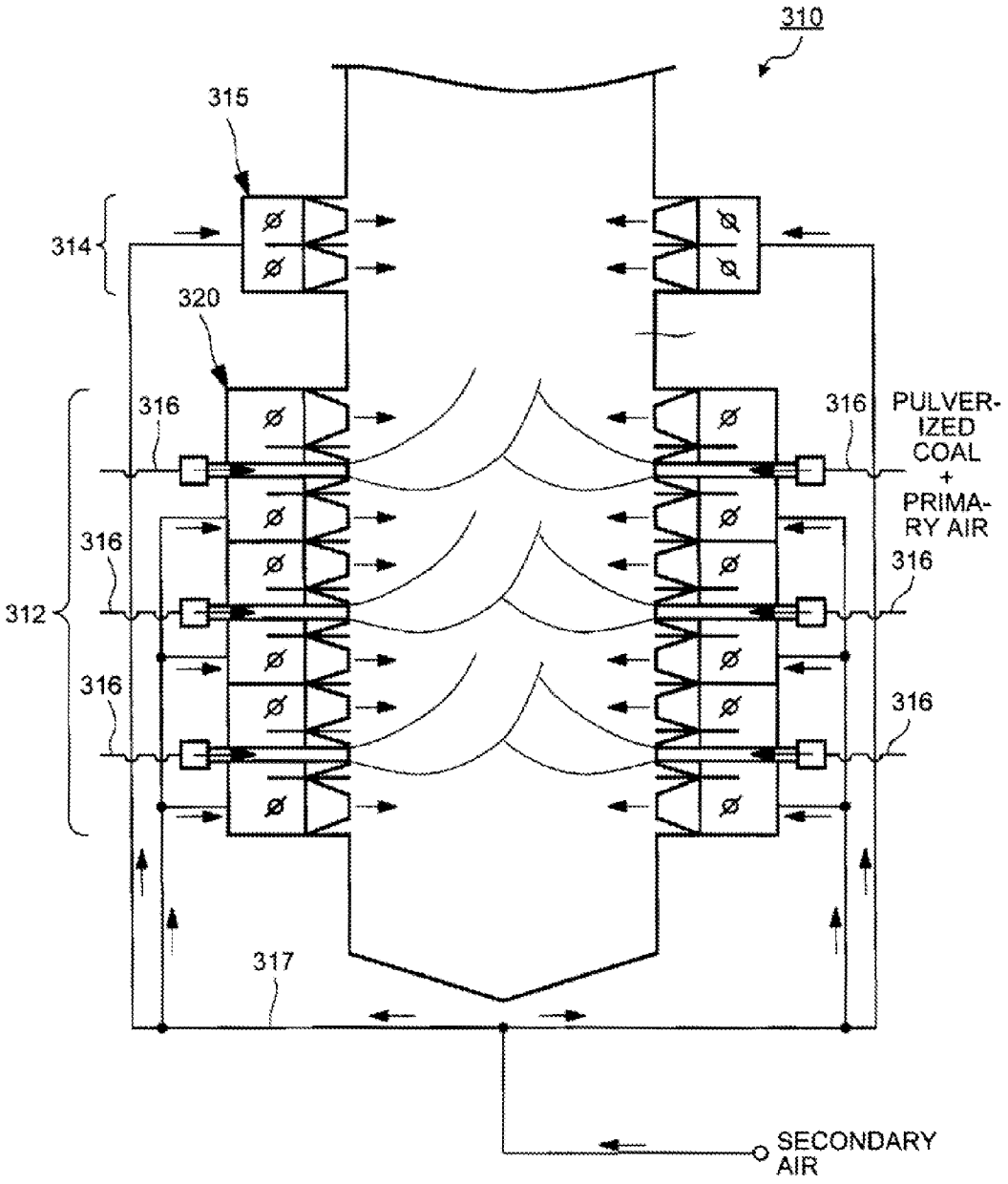
FIG. 27 is a longitudinal sectional view illustrating a configuration example of a solid-fuel-combustion (coal-combustion) boiler according to the invention.
Figure 28:
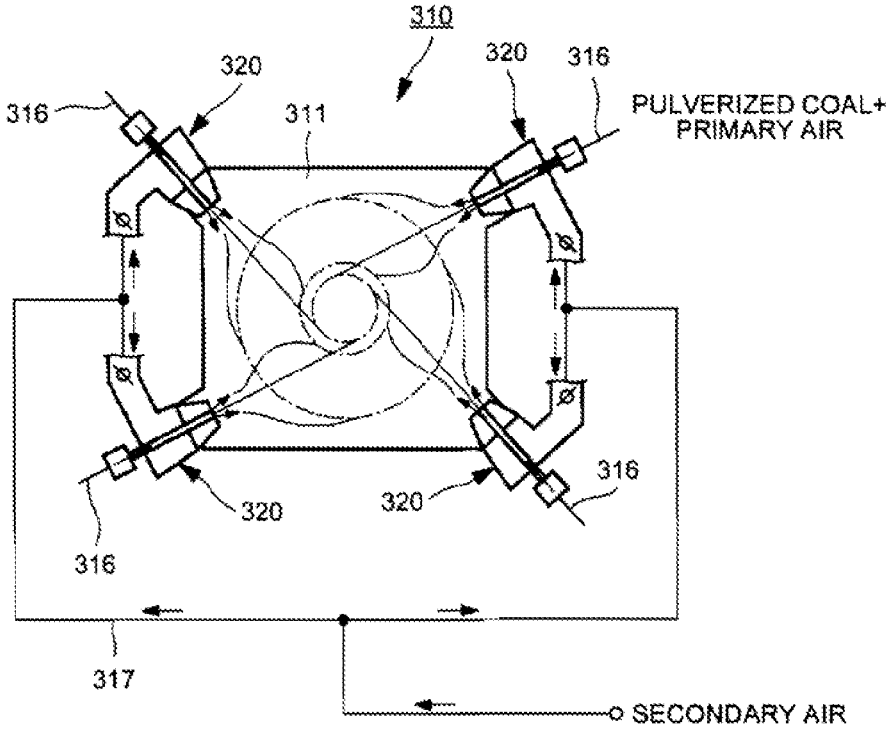
FIG. 28 is a transverse (horizontal) cross-sectional view of FIG. 24.
Figure 29:
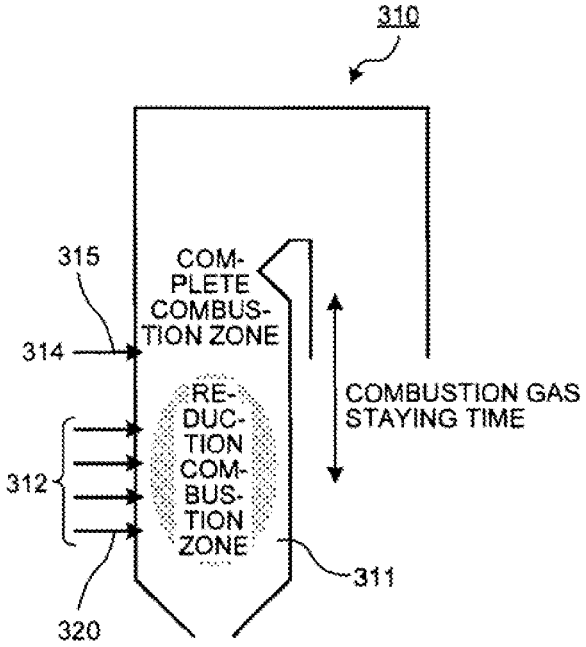
FIG. 29 is a diagram illustrating an outline of a solid-fuel-combustion boiler which includes an additional air input unit so as to input air through plural stages.

A turning combustion boiler 310 illustrated in FIGS. 27 to 29 inputs air into a furnace 311 in plural stages so as to set a zone from a burner 312 to an additional air input unit (hereinafter, referred to as a "AA part") 314 as a reduction atmosphere, whereby the NOx of the flue gas decreases.

The reference sign 320 of the drawings indicates a solid-fuel-combustion burner that inputs the pulverized coal (the pulverized solid fuel) and the air, and the reference sign 315 indicates an additional air input nozzle that ejects additional air. For example, as illustrated in FIG. 27, the solid-fuel-combustion burner 320 is connected with a pulverized coal fuel-air mixture transportation pipe 316 that transports the pulverized coal by the primary air and an air blowing duct 317 that supplies the secondary air, and the additional air input nozzle 315 is connected with the air blowing duct 317 that supplies the secondary air.

In this way, the turning combustion boiler 310 employs a turning combustion type in which the solid-fuel-combustion burner 320 for inputting the air and the pulverized coal (coal) of the pulverized fuel into the furnace 311 is formed as the turning combustion type burner 312 disposed at each corner of each stage.

Figure 25:
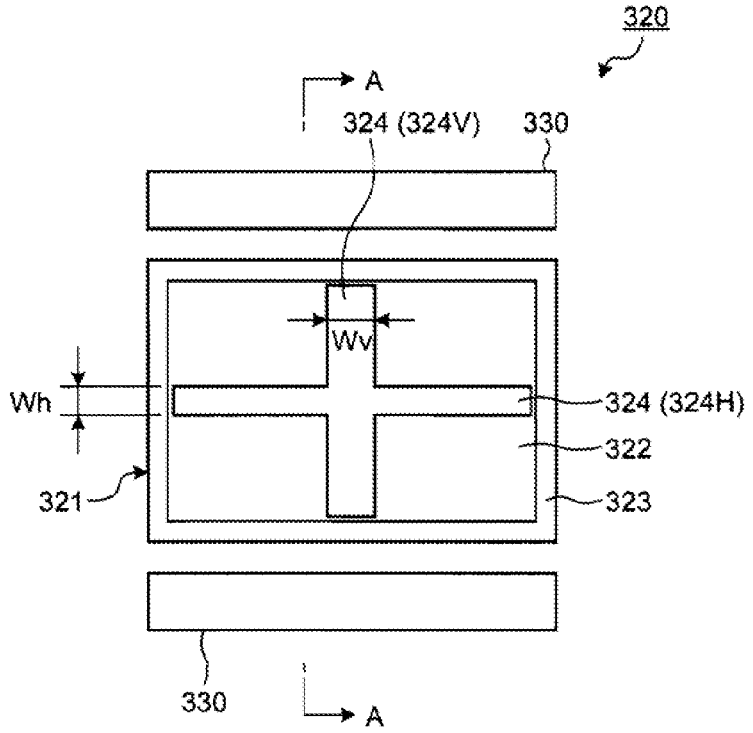
FIG. 25 is a diagram illustrating a twelfth embodiment relating to a solid-fuel-combustion (coal-fuel-combustion) burner according to the invention, where FIG. 25(*a*) is a front view in which the solid-fuel-combustion burner is seen from the inside of a furnace and FIG. 25(*b*) is a cross-sectional view taken along the line A-A of the solid-fuel-combustion burner illustrated in FIG. 25(*a*) (a longitudinal sectional view of the solid-fuel-combustion burner).
Figure 25:
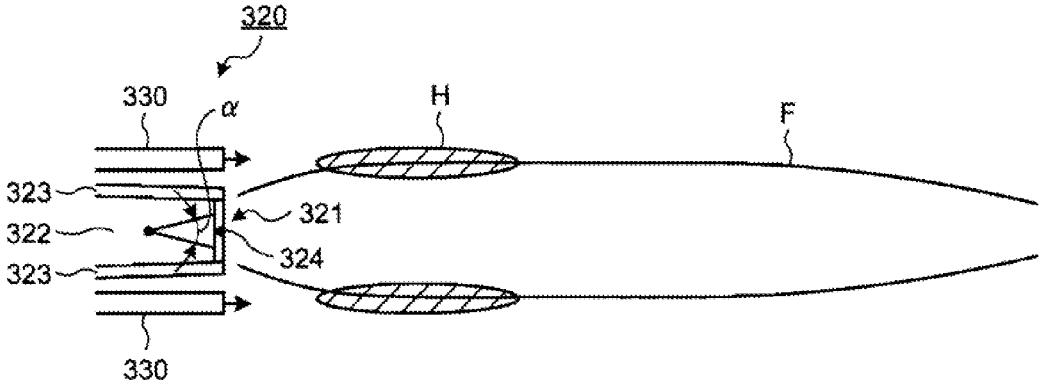

The solid-fuel-combustion burner 320 illustrated in FIG. 25 includes a pulverized coal burner (fuel burner) 321 which inputs the pulverized coal and the air and secondary air input ports 330 which are respectively disposed at the upper and lower sides of the pulverized coal burner 321.

Figure 26:
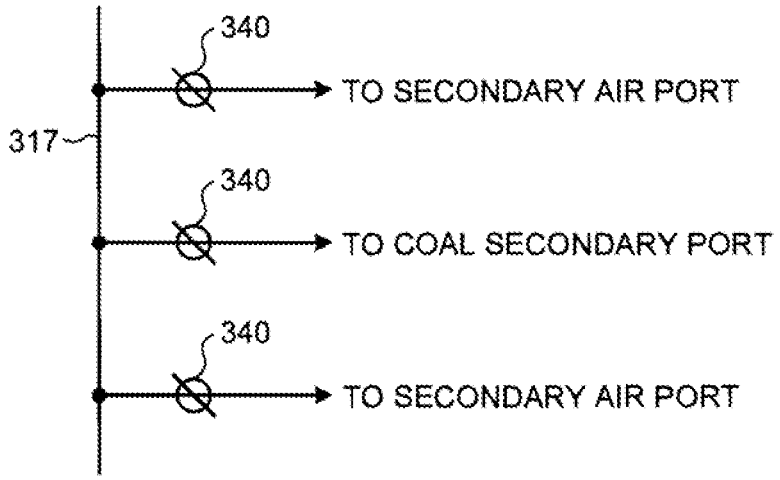
FIG. 26 is a diagram illustrating an air supply system which supplies air to the solid-fuel-combustion burner of FIG. 25.

For example, as illustrated in FIG. 26, each secondary air input port 330 includes a damper 340 capable of adjusting an opening degree as a flow rate adjusting unit provided for each of the secondary air supply lines branched from the air blowing duct 317 in order to adjust the air flow amount for each port.

The pulverized coal burner 321 includes a rectangular coal primary port 322 which inputs the pulverized coal transported by the primary air and a coal secondary port 323 which is provided so as to surround the coal primary port 322 and inputs a part of the secondary air. Furthermore, as illustrated in FIG. 26, the coal secondary port 323 also includes a damper 340 capable of adjusting an opening degree as a flow rate adjusting unit. Furthermore, the coal primary port 322 may have a circular shape or an oval shape.

Split members 324 are disposed in a plurality of directions at the front side of the passage of the pulverized coal burner 321, that is, the front side of the passage of the coal primary port 322, and are fixed by support members (not illustrated). For example, as illustrated in FIG. 25(*a*), two split members 324 are disposed in a lattice shape with a predetermined gap therebetween so that one split member is positioned in each of the up and down direction and the left and right direction at the outlet opening portion of the coal primary port 322.

That is, two split members 324 are formed in a cross type in a manner such that the split members are disposed in two different directions of the up and down direction and the left and right direction. Here, the outlet opening portion of the coal primary port 322 of the pulverized coal burner 321 is finely divided (divided into four segments), but the number of the split members 324 may be plural numbers in each of the up and down direction and the left and right direction.

Further, a pressure loss is large in a portion sandwiched by the split members 324, and the flow velocity of the ejection port decreases, so that the inner ignition is further promoted.

The split members 324 with such a configuration suppress the hot oxygen remaining zone H formed in the outer periphery of the flame F, and effectively reduces the final NOx production amount of NOx discharged from the AA part 314.

Figure 30:
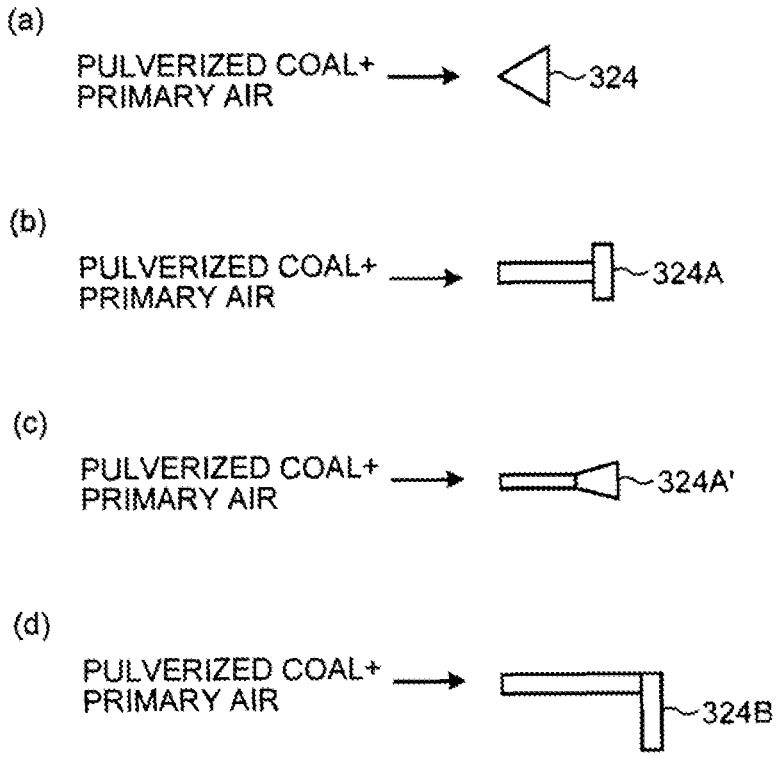
FIG. 30 is a diagram illustrating a split member of the solid-fuel-combustion burner illustrated in FIG. 25, where FIG. 30(*a*) is a diagram illustrating an example of a cross-sectional shape of the split member, FIG. 30(*b*) is a diagram illustrating a first modified example of the cross-sectional shape, FIG. 30(*c*) is a diagram illustrating a second modified example of the cross-sectional shape, and FIG. 30(*d*) is a diagram illustrating a third modified example of the cross-sectional shape.

The split members 324 employ, for example, the cross-sectional shape illustrated in FIGS. 30(*a*) to 30(*d*), and hence smoothly divide the flow of the pulverized coal and the air so that the flow is disturbed.

Each split member 324 illustrated in FIG. 30(*a*) has a triangular cross-sectional shape. The triangular shape illustrated in the drawing is an equilateral-triangular shape or an isosceles triangular shape, and one outlet-side edge facing the inside of the furnace 311 is disposed so as to intersect the direction in which the pulverized coal and the air flow. In other words, an arrangement is employed in which one corner forming the triangular cross-section is disposed so as to face the direction in which the pulverized coal and the air flow.

A split member 324A illustrated in FIG. 30(*b*) has a substantially T-shaped cross-section, and a surface substantially perpendicular to the direction in which the pulverized coal and the air flow is disposed at the outlet side facing the inside of the furnace 311. Furthermore, for example, as illustrated in FIG. 30(*c*), a split member 324A' having a trapezoidal cross-sectional shape may be provided by deforming the substantially T-shaped cross-section.

Further, a split member 324B illustrated in FIG. 30(*d*) has a substantially L-shaped cross-section. That is, in a case where a cross-section obtained by cutting out a part of the substantial T-shape is particularly disposed in the left and right (horizontal) direction, when a substantial L-shape is formed by removing an upper convex portion, it is possible to prevent the deposit of the pulverized coal to the split member 324B. Furthermore, when a lower convex portion increases in size by the removable amount of the upper convex portion, the separation performance necessary for the split member 324B may be ensured.

However, the cross-sectional shape of the split member 324 or the like is not limited to the example illustrated in the drawings, and may be substantially formed in, for example, a Y-shape.

In the solid-fuel-combustion burner 320 with such a configuration, the split member 324 which is provided near the center of the outlet opening of the pulverized coal burner 321 divides the passage of the pulverized coal and the air so as to disturb the flow therein, and forms a recirculation zone at the front side (the downstream side) of the split member 324. Thus, the split member serves as an inner flame stabilization mechanism.

In general, the conventional solid-fuel-combustion burner 320 ignites the pulverized coal of the fuel by the radiation of the outer periphery of the flame. When the pulverized coal is ignited by the outer periphery of the flame, NOx is produced in the hot oxygen remaining zone H (see FIG. 25(*b*)) of the outer periphery of the flame where hot oxygen remains, and hence the NOx discharge amount increase while the reduction is not sufficiently performed.

However, since the split member 324 serving as the inner flame stabilization mechanism is provided, the pulverized coal is ignited at the inside of the flame. For this reason, NOx is produced at the inside of the flame, and the NOx produced at the inside of the flame contains a large amount of hydrocarbons having a reduction action. For this reason, the reduction is promptly performed inside the flame which does not have sufficient air. Accordingly, the solid-fuel-combustion burner 320 is provided in a structure in which the flame stabilization performed by the flame stabilizer at the outer periphery of the flame is stopped, that is, the flame stabilizing mechanism is not provided at the outer periphery of the burner, and hence the production of NOx at the outer periphery of the flame may be suppressed.

Particularly, when a cross type is employed in which the split members 324 are disposed in a plurality of directions, the intersection portion obtained by intersecting the split members 324 in different directions may be easily provided near the center of the outlet opening of the pulverized coal burner 321. When the intersection portion exists near the center of the outlet opening of the pulverized coal burner 321, the passage of the pulverized coal and the air is divided into plural segments near the center of the outlet opening of the pulverized coal burner 321, and hence the flow is disturbed when the flow is divided into plural flows.

That is, when the split members 324 exist in one direction of the left and right direction, the dispersion or the ignition of the air at the center portion is delayed, so that a zone exists in which air is locally and extremely insufficient. Thus, the unburned combustible content increases. However, in a cross type in which the intersection portion is formed by disposing the split members 324 in a plurality of directions, the mixing of the air at the inside of the flame is promoted and the ignition surface is finely divided. As a result, the unburned combustible content may be reduced.

In other words, when the split members 324 are disposed so as to form the intersection portion, the mixing and the dispersion of the air are promoted to the inside of the flame, so that the ignition surface is finely divided. Thus, the ignition position exists near the center portion (the axis center portion) of the flame, and hence the unburned combustible content of the pulverized coal is reduced. That is, since oxygen easily enters the center portion of the flame, the inner ignition is effectively performed. Accordingly, the reduction is promptly performed at the inside of the flame, and hence the NOx production amount is reduced.

As a result, it is possible to more easily suppress the production of NOx at the outer periphery of the flame by using the solid-fuel-combustion burner 320 that does not have the flame stabilizer at the outer periphery of the flame by stopping the flame stabilization using the flame stabilizer provided at the outer periphery of the flame.

In the split members 324 disposed in a plurality of directions, in the embodiment, when the width of the split member 324 viewed from the inside of the furnace is set as the splitter width W, the split members having different splitter widths W for the respective directions are disposed in a cross type.

For example, in configuration example of the cross type illustrated in FIG. 25(*a*), the outlet opening portion of the coal primary port 322 is equipped with one split member (hereinafter, referred to as a "vertical splitter") 324V disposed in the up and down direction and one split member (hereinafter, referred to as a "horizontal splitter") 324H disposed in the left and right direction.

Then, the splitter width Wv of the vertical splitter 324V is larger and wider than the splitter width Wh of the horizontal splitter 324H (Wv>Wh), but an inverse configuration may be set.

That is, the split member 324 illustrated in the drawings strengthens the vertical splitter function, but relatively degrades the horizontal splitter function. For this reason, a structure is used in which the splitter width Wv of the vertical splitter 324V is set to be larger than the splitter width Wh of the horizontal splitter 324H.

This configuration is prepared to handle a change in the angle of the fuel burner 321 of which the angle may be changed.

For example, as illustrated in FIG. 25(*b*), the fuel burner 321 may appropriately change the burner angle (the nozzle angle) α in the up and down direction so as to adjust the temperature of the steam produced by the turning combustion boiler 310 to a desired value.

However, even when the burner angle α changes, the angle of the split member 324 that is fixed and supported to an appropriate position does not change while being interlocked with the fuel burner 321. For this reason, the positional relation between the fuel burner 321 and the split member 324 changes in response to a change in the burner angle α.

When the burner angle α changes in the up and down direction, the positional relation between the pulverized coal flow and the horizontal splitter 324H changes when inputting the pulverized coal and the primary air. Since a change in the positional relation is largely influenced as the splitter width Wh of the horizontal splitter 324H increases, the burner performance is eventually influenced, and hence it is difficult to uniformly maintain the burner performance. Accordingly, it is desirable to prevent the burner performance from being influenced even when the burner angle α of the fuel burner 321 changes.

Therefore, in the embodiment, the split member 324 that strengthens the vertical splitter function by relatively increasing the splitter width Wv of the vertical splitter 324V may narrow the splitter width Wh of the horizontal splitter 324H to the minimally necessary width, and hence suppress a change in the positional relation caused by a change in the burner angle α to the minimal value.

Accordingly, since the split member 324 is formed in a cross type in which the splitters exist in both directions of the up and down direction and the left and right direction by remaining the horizontal splitter 324H having a small splitter width W, it is possible to maintain a state where the mixing of the air is promoted and the ignition surface is finely divided. For this reason, in the split member 324, the air may easily enter the center portion of the flame. As a result, it is possible to minimally suppress a change in the positional relation caused by a change in the burner angle α while keeping the advantage of the cross type in which the unburned combustible content may be reduced by the promotion of the ignition of the center portion, and to substantially uniformly maintain the burner performance.

Further, in a case of the turning combustion type in which the secondary air input port 330 is disposed in the up and down direction of the pulverized coal burner 321, the splitter width Wh of the horizontal splitter 324H is set to be larger and wider than the splitter width Wv of the vertical splitter 324V (Wh>Wv).

This is because the splitter function is strengthened when the splitter width Wv of the vertical splitter 324V is larger than the necessary value and the splitter easily becomes the ignition source of the pulverized coal.

Moreover, regarding the ignition in the vicinity of both upper and lower end portions of the vertical splitter 324V, since the ignition source is close to the secondary air input port 330, the ignition at the outer periphery of the flame easily and directly interferes with the secondary air. As a result, a large amount of air is mixed with the pulverized coal that is ignited at the outer periphery of the flame using the vertical splitter 324V as the ignition source. Accordingly, NOx is produced at the hot oxygen remaining zone H of the outer periphery of the flame where hot oxygen remains. The NOx remains without sufficient reduction, and increases the final NOx discharge amount.

However, when the splitter width Wh of the horizontal splitter 324H is set to a large width so as to strengthen the splitter function of the horizontal splitter 324H, the ignition source in the vicinity of the secondary air input port 330 existing at the upper and lower sides of the pulverized coal burner 321 decreases in size. That is, the downstream side of the wide horizontal splitter 324H is equipped with a negative pressure zone as a large recirculation zone, and hence a strong splitter function is exhibited. For this reason, the flow of the pulverized coal and the primary air may easily concentrate on the center portion in the up and down direction.

As a result, the ignition occurs at the outer periphery of the flame by using the vicinity of both end portions of the vertical splitter 324V as the ignition source, and the amount of the pulverized coal mixed with a large amount of air largely decreases. Meanwhile, the mixing and the dispersion of the pulverized coal and the primary air are promoted to the inside of the flame, so that the air (oxygen) may easily enter the center portion of the flame. As a result, since the inner ignition is effectively performed, the prompt reduction occurs at the inside of the flame, and hence the NOx production amount is reduced.

In this case, since the cross type split members 324 exist in the up and down direction and the left and right direction by leaving the vertical splitter 324V, that is, forming the vertical splitter 324V with the small splitter width Wv, the mixing of the air is promoted and the ignition surface is finely divided. For this reason, in the solid-fuel-combustion burner 320 with the cross type split members 324, the air may easily enter the center portion of the flame, and hence the unburned combustible content may be reduced by the promotion of the ignition of the center portion.

Thirteenth Embodiment

Next, a solid-fuel-combustion burner according to a thirteenth embodiment of the invention will be described.

In the embodiment, the split members 324 provided in the solid-fuel-combustion burner 320 are formed as the split members 324 that are disposed in a plurality of directions and having different splitter widths W. Furthermore, the splitter width W of the center portion of three or more split members disposed in the same direction is set to a large width, and the widths of the peripheral portions are relatively narrowed.

In the split members 324 with such a configuration, since the splitter with a large width is disposed at the center portion of the solid-fuel-combustion burner 320, the splitter function of the center portion is strengthened, and hence the inner ignition may be strengthened while preventing the outer ignition.

That is, since the solid-fuel-combustion burner 320 of the embodiment includes the cross type split members 324 of which the center portion has a large width, the existence of the splitter serving as the ignition source at the outer peripheral portion of the pulverized coal burner 321 is suppressed as minimal as possible, so that the outer ignition may be prevented or suppressed. Further, since the splitter function of the center portion is strengthened, the air easily enters the center portion of the flame. As a result, the unburned combustible content may be reduced by the promotion of the ignition of the center portion.

Incidentally, in the above-described configuration example, three splitters are disposed in each of the up and down direction and the left and right direction, and only one splitter disposed at the center portion in the up and down direction and the left and right direction has a large width. However, not only the number of the splitters but also the number or the position of the wide splitter is not limited to the invention.

For example, a configuration may be employed in which four splitters are disposed in the up and down direction and the left and right direction and two splitters disposed at the center portions in the up and down direction and the left and right direction have a large width. Further, both splitters disposed at the center portions in the up and down direction and the left and right direction do not have a large width. For example, only the splitter member disposed at the center portion in the up and down direction or the left and right direction may have a large width. Accordingly, a configuration is also included in which three or more splitters are disposed in one of a plurality of directions so as to have a large width at the center portion and one splitter having a wide width or a narrow width or one splitter having a narrow width is disposed in the other direction.

Fourteenth Embodiment

Figure 31:
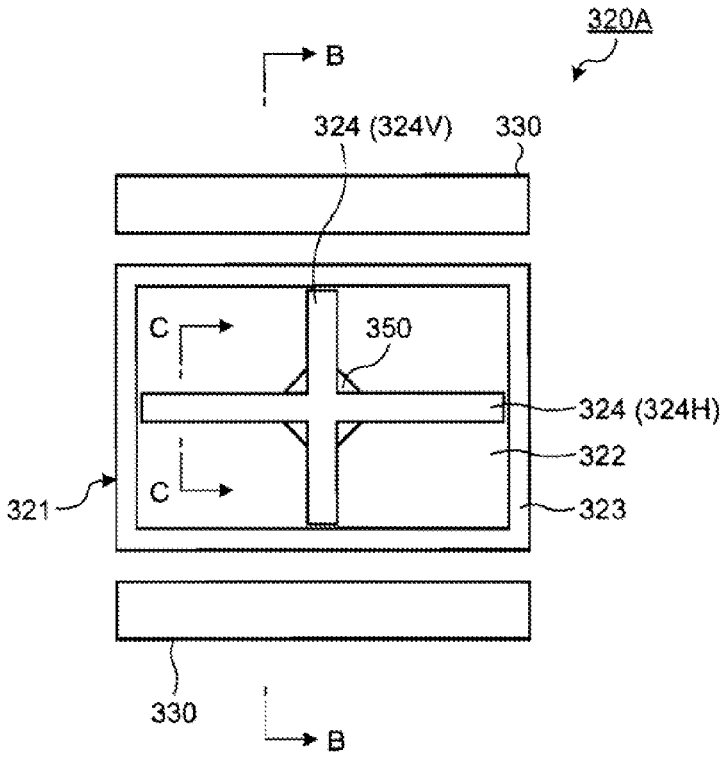
FIG. 31 is a diagram illustrating a fourteenth embodiment relating to a solid-fuel-combustion (coal-fuel-combustion) burner according to the invention, FIG. 31(*a*) is a front view in which the solid-fuel-combustion burner is seen from the inside of a furnace and FIG. 31(*b*) is a cross-sectional view taken along the line B-B of the solid-fuel-combustion burner illustrated in FIG. 31(*a*) (a longitudinal sectional view of the solid-fuel-combustion burner).
Figure 31:
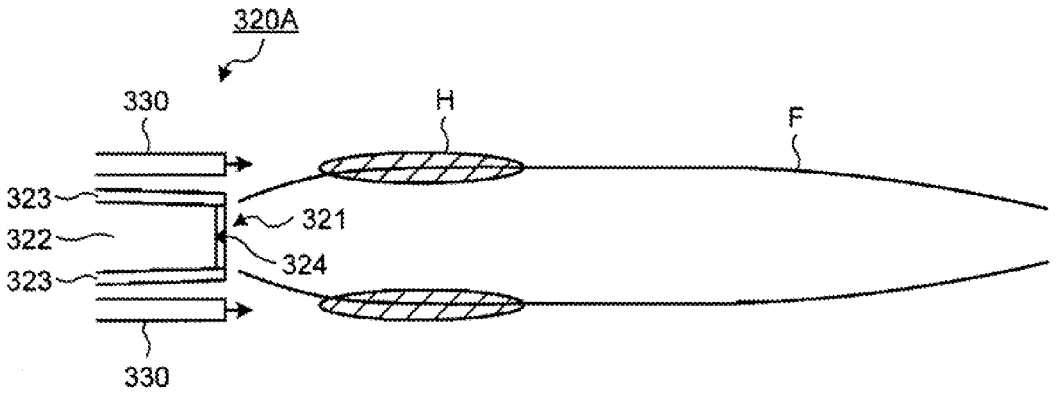

Next, a solid-fuel-combustion burner according to a fourteenth embodiment of the invention will be described by referring to FIG. 31. Furthermore, the same reference sign will be given to the same component as that of the above-described embodiment, and the repetitive description thereof will not be repeated. In the embodiment, the split members 324 that are provided in the solid-fuel-combustion burner 320A so as to guide the flow of the pulverized coal and the primary air to the inside of the center portion of the flame (the axis center side) include a shielding member that is attached to the intersection corner between the splitters disposed in a plurality of directions. That is, in order to strengthen the inner flame stabilization or to increase the ignition surface of the inside of the flame by further improving the function of the split members 324, the shielding member that reduces the passage sectional area is provided in at least one position of the intersection corner formed by intersecting the split members 324 as the function strengthening member of the split members 324.

As the shielding member, for example, a triangular plate 350 is desirable which is attached to the split members 324 so as to block the intersection center portion side of the intersection corner. Then, the opening area of the coal primary port 322 viewed from the inside of the furnace, that is, the passage sectional area of the pulverized coal and the primary air decreases by the amount corresponding to the area of the triangular plate 350. The triangular plate 350 decreases the passage sectional area of the pulverized coal and the primary air, and increases the ignition surface of the inside of the flame. Also, the triangular plate has a function of guiding the flow of the pulverized coal and the primary air toward the center portion.

In other words, the triangular plate 350 is a shielding member that is formed at the downstream side of the split member 324 so as to increase a negative pressure zone as a recirculation zone, and may strengthen the flame stabilization effect of the split member 324.

Accordingly, the shielding member may be provided in at least one position of four intersection corners formed at the intersection portions of the splitters 324H and 324V intersecting each other in the up and down direction and the left and right direction.

Figure 32:
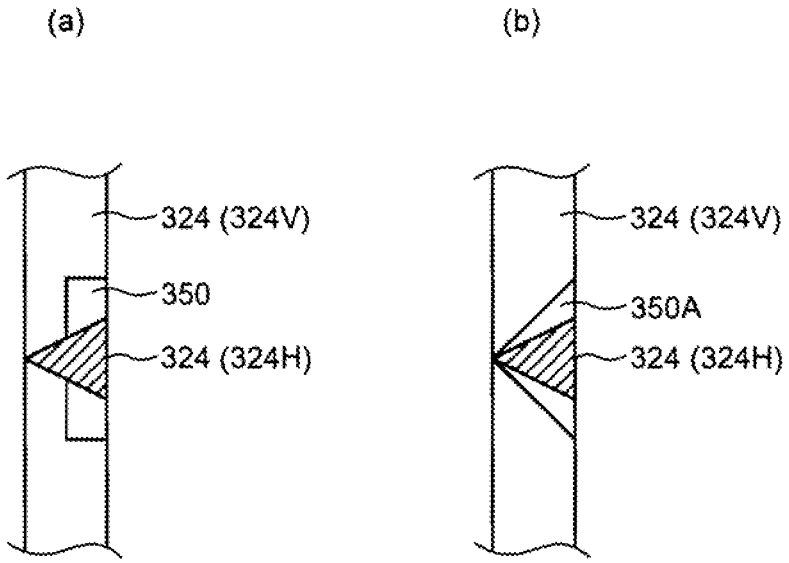
FIG. 32(*a*) is a cross-sectional view taken along the line C-C illustrating an example of one shape of a shielding member and FIG. 32(*b*) is a cross-sectional view illustrating an example of the other shape of the shielding member illustrated in FIG. 32(*a*).

Further, the shielding member is not limited to the triangular plate (the triangular plate member) 350 illustrated in FIG. 32(*a*). For example, a plate member may be formed with a shape formed by ¼ of the circular or oval shape. Moreover, for example, as in a triangular pyramid 350A illustrated in FIG. 32(*b*), an inclined surface may be provided so as to guide a flow outward and form a recirculation zone.

In this way, when the shielding member such as the triangular plate 350 or the triangular pyramid 350A is provided at the intersection portions of the splitters 324H and 324V, the function of the split member 324 is further improved. Accordingly, the ignition surface of the inside of the flame may be increased or the inner flame stabilization may be strengthened.

According to the solid-fuel-combustion burner and the solid-fuel-combustion boiler of the above-described embodiments, it is possible to reduce the final NOx production amount of NOx discharged from the AA part 314 by suppressing the hot oxygen remaining zone H formed at the outer periphery of the flame F.

Furthermore, the invention is not limited to the above-described embodiments. For example, the pulverized solid fuel is not limited to the pulverized coal, and may be appropriately modified without departing from the spirit of the invention.

Fifteenth Embodiment

Incidentally, in the conventional coal-combustion burner, generally, the outer periphery of the burner is equipped with the flame stabilizing mechanism (for a front end angle adjustment operation, a turning operation, or the like), and the secondary air (or tertiary air) input port is provided near the outer periphery. For this reason, the ignition occurs at the outer periphery of the flame, and hence a large amount of air is mixed at the outer periphery of the flame. As a result, the combustion at the outer periphery of the flame occurs at a high temperature state in which the oxygen concentration at the hot oxygen remaining zone of the outer periphery of the flame is high. Accordingly, NOx is produced at the outer periphery of the flame. In this way, since the NOx produced at the hot oxygen remaining zone of the outer periphery of the flame passes through the outer periphery of the flame, the reduction is later than that of the inside of the flame, which causes the production of the NOx from the coal-combustion boiler.

Meanwhile, even in the opposed wall-fired boiler, the ignition occurs at the outer periphery of the flame by the swirl, and hence NOx is produced as in the outer periphery of the flame.

Due to these circumstances, in the solid-fuel-combustion burner and the solid-fuel-combustion boiler that burns the pulverized solid fuel as in the conventional coal-combustion burner and the conventional coal-combustion boiler, it is desirable to reduce the final NOx production amount of NOx discharged from the additional air input unit by suppressing the hot oxygen remaining zone formed at the outer periphery of the flame.

The invention is made in view of the above-described circumstance, and it is an object of the invention to provide a solid-fuel-combustion burner and a solid-fuel-combustion boiler capable of reducing a final NOx production amount of NOx discharged from an additional air input unit by suppressing (weakening) the hot oxygen remaining zone formed at the outer periphery of the flame.

Hereinafter, one embodiment of the solid-fuel-combustion burner and the solid-fuel-combustion boiler according to the invention will be described by referring to the drawings. Furthermore, in the embodiment, a turning combustion boiler with a solid-fuel-combustion burner using pulverized coal (coal as pulverized solid fuel) as fuel will be described as an example of the solid-fuel-combustion burner and the solid-fuel-combustion boiler, but the invention is not limited thereto.

Figure 35:
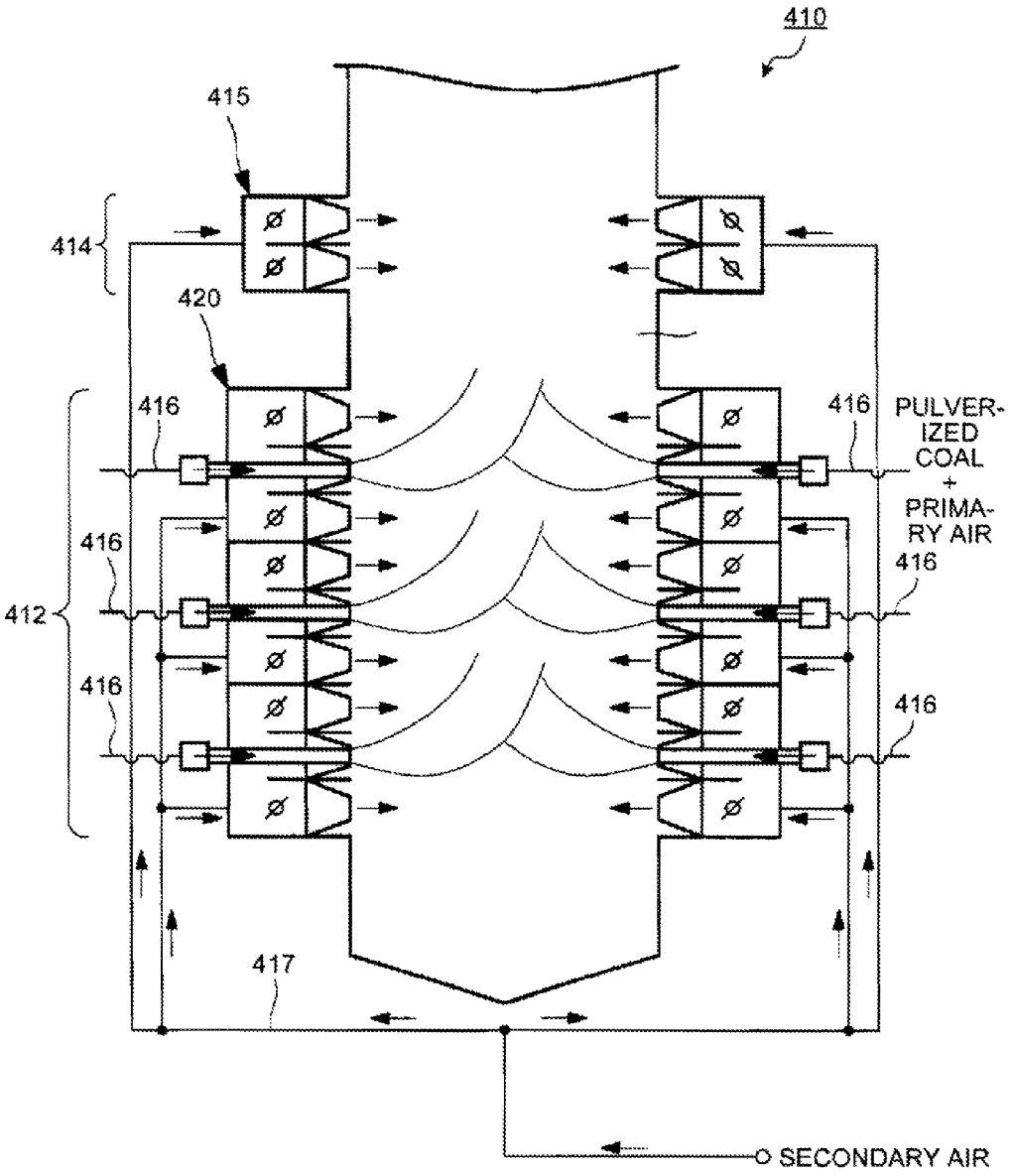
FIG. 35 is a longitudinal sectional view illustrating a configuration example of the solid-fuel-combustion boiler (coal-combustion boiler) according to the invention.
Figure 36:
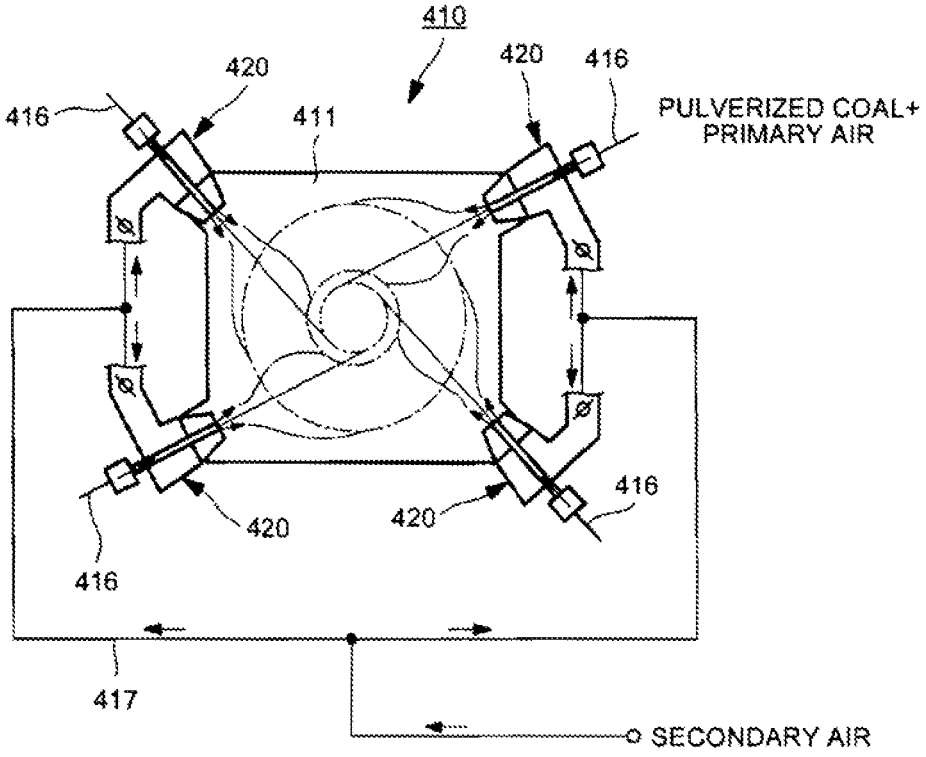
FIG. 36 is a transverse (horizontal) cross-sectional view of FIG. 35.
Figure 37:
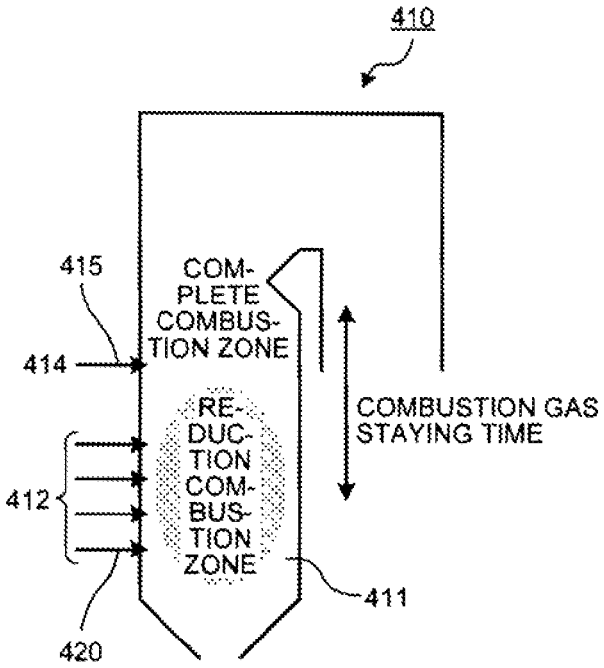
FIG. 37 is a diagram illustrating an outline of a solid-fuel-combustion boiler which includes an additional air input unit so as to input air through plural stages.

A turning combustion boiler 410 illustrated in FIGS. 35 to 37 inputs air into the furnace 411 in plural stages so that the zone from the burner 412 to the additional air input unit (hereinafter, referred to as an "AA part") 414 becomes a reduction atmosphere. In this way, NOx in the flue gas may be decreased.

The reference sign 420 of the drawings indicate a solid-fuel-combustion burner that inputs pulverized coal (pulverized solid fuel) and air, and the reference sign 415 indicates an additional air input nozzle that inputs additional air. For example, as illustrated in FIG. 35, the solid-fuel-combustion burner 420 is connected with a pulverized coal fuel-air mixture transportation pipe 416 that transports the pulverized coal by the primary air and an air blowing duct 417 that supplies the secondary air, and an additional air input nozzle 415 is connected with the air blowing duct 417 that supplies the secondary air.

In this way, the turning combustion boiler 410 employs a turning combustion type in which the solid-fuel-combustion burner 420 that inputs the air and the pulverized coal (coal) of the pulverized fuel into the furnace 411 is formed as the turning combustion type burner 412 that is disposed at each corner of each stage and one or plural swirl flames are generated at each stage.

Figure 33:
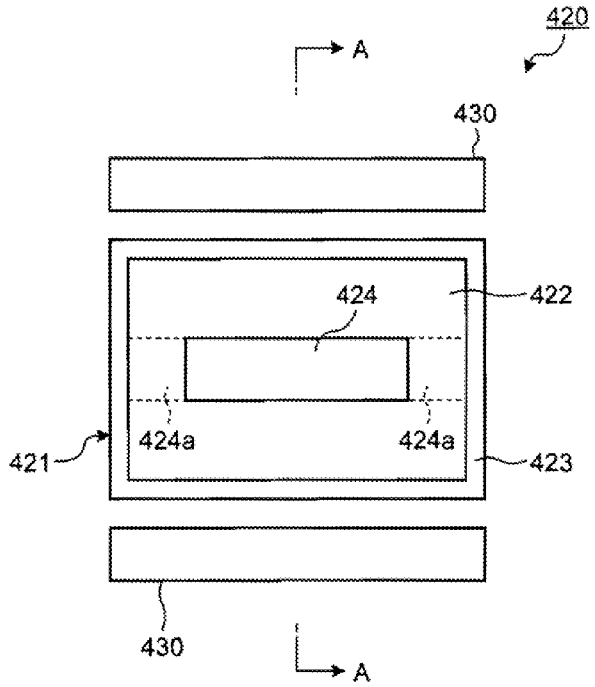
FIG. 33 is a diagram illustrating a fifteenth embodiment relating to a solid-fuel-combustion (coal-fuel-combustion) burner for a turning combustion boiler according to the invention, where FIG. 33(*a*) is a front view in which the solid-fuel-combustion burner is seen from the inside of a furnace and FIG. 33(*b*) is a cross-sectional view taken along the line A-A of the solid-fuel-combustion burner illustrated in FIG. 33(*a*) (a longitudinal sectional view of the solid-fuel-combustion burner).
Figure 33:
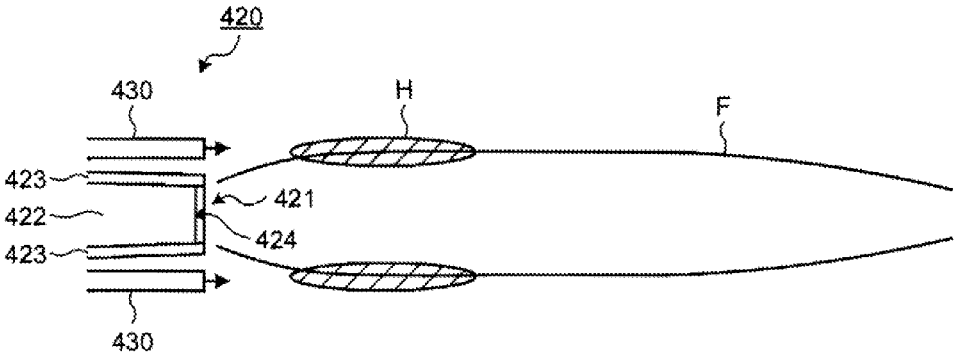

The solid-fuel-combustion burner 420 illustrated in FIG. 33 includes a pulverized coal burner (fuel burner) 421 that inputs the pulverized coal and the air and a coal secondary port that ejects the secondary air from the outer periphery of the pulverized coal burner 421. In the embodiment, the secondary air port that ejects the secondary air from the outer periphery of the pulverized coal burner 421 includes secondary air input ports 430 respectively disposed at the upper and lower sides of the pulverized coal burner 421 and a coal secondary port 423.

Figure 34:
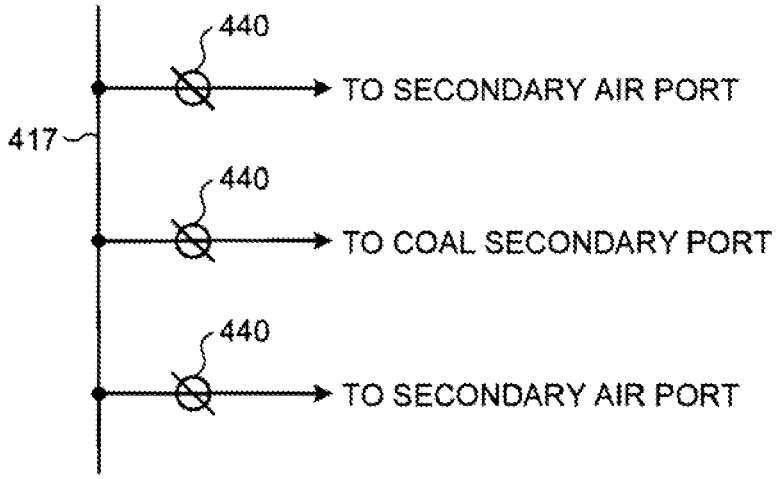
FIG. 34 is a diagram illustrating an air supply system which supplies air to the solid-fuel-combustion burner of FIG. 33.

For example, as illustrated in FIG. 34, in order to adjust the air flow rate for each port, the secondary air input port 430 includes a damper 440 which is provided as a flow rate adjusting unit for each secondary air supply line branched from the air blowing duct 417 so as to adjust the opening degree thereof.

The pulverized coal burner 421 includes a rectangular coal primary port 422 which inputs the pulverized coal transported by the primary air and a coal secondary port 423 which is provided so as to surround the coal primary port 422 and inputs a part of the secondary air. Furthermore, as illustrated in FIG. 34, even the coal secondary port 423 includes the damper 440 as the flow rate adjusting unit capable of adjusting the opening degree. Furthermore, the coal primary port 422 may be formed in a circular or oval shape.

A split member 424 is disposed at the front side of the passage of the pulverized coal burner 421, that is, the front side of the passage of the coal primary port 422, and is fixed by a support member (not illustrated). For example, as illustrated in FIG. 33(*a*), one split member 424 is disposed in the horizontal direction so as to be substantially positioned at the center position in the up and down direction at the outlet opening portion of the coal primary port 422, and both end portions thereof in the horizontal (left and right) direction are partially removed so as to be formed as removing portions 424*a*. Furthermore, in FIG. 33(*a*), the removing portions 424*a* are depicted by a dashed line.

In this case, as illustrated in FIG. 33, when the passage width of the pulverized coal burner 421, that is, the passage width (the passage width from the axis center) of the coal primary port 422 is denoted by L1, the length (the length from the axis center) L2 of the split member 424 obtained by removing a part of the end portion adjacent to the coal secondary port 423 from the split member 424 is set so that the dimensional ratio L2/L1 satisfies the inequation of L2/L1>0.2. Further, the dimension ratio L2/L1 more desirably satisfies the inequation of L2/L1>0.6. That is, it is desirable to form the removing portion 424*a* which is formed by removing a part of the end portion from the split member 424 so that the dimension ratio satisfies the condition of L2/L1>0.2. Then, it is more desirable to form the removing portion to satisfy the condition of L2/L1>0.6.

Figure 38:
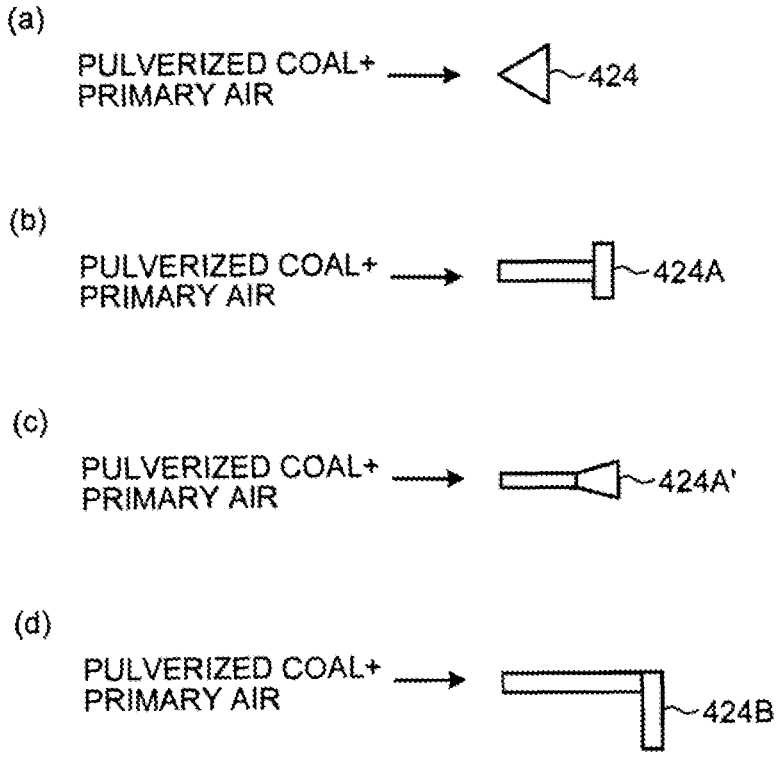
FIG. 38 is a diagram illustrating a split member of the solid-fuel-combustion burner illustrated in FIG. 33, where FIG. 38(*a*) is a diagram illustrating an example of a cross-sectional shape, FIG. 38(*b*) is a diagram illustrating a first modified example of the cross-sectional shape, FIG. 38(*c*) is a diagram illustrating a second modified example of the cross-sectional shape, and FIG. 38(*d*) is a diagram illustrating a third modified example of the cross-sectional shape.

The split member 424 employs, for example, the cross-sectional shape illustrated in FIGS. 38(*a*) to 38(*d*), and may smoothly divide the flow of the pulverized coal and the air so as to be disturbed.

The split member 424 illustrated in FIG. 38(*a*) has a triangular cross-sectional shape. The triangular shape illustrated in the drawings is an equilateral-triangular or isosceles triangle, and the outlet side edge facing the inside of the furnace 411 is disposed so as to be substantially perpendicular to the direction in which the pulverized coal and the air flow. In other words, an arrangement is employed in which one corner forming the triangular cross-section faces the direction in which the pulverized coal and the air flow.

A split member 424A illustrated in FIG. 38(*b*) has a substantially T-shaped cross-section, and a surface substantially perpendicular to the direction in which the pulverized coal and the air flow is disposed at the outlet side facing the inside of the furnace 411. Furthermore, for example, as illustrated in FIG. 38(*c*), a split member 424A' having a trapezoidal cross-sectional shape may be formed by deforming the substantially T-shaped cross-section.

A split member 424B illustrated in FIG. 38(*d*) has a substantially L-shaped cross-section. That is, in a case where a cross-section obtained by cutting out a part of the substantial T-shape is particularly disposed in the left and right (horizontal) direction, when a substantial L-shape is formed by removing an upper convex portion, it is possible to prevent the deposit of the pulverized coal to the split member 424B. Furthermore, when a lower convex portion increases in size by the removable amount of the upper convex portion, the separation performance necessary for the split member 424B may be ensured.

However, the cross-sectional shape of the split member 424 or the like is not limited to the example illustrated in the drawings, and may be substantially formed in, for example, a Y-shape.

Incidentally, the split member 424 of the embodiment is not limited thereto. Accordingly, the split member 424 may have, for example, a configuration in which four split members are disposed in total in a lattice shape so that two split members are disposed in each of the up and down direction and the left and right direction. In this case, the two split members disposed in the up and down direction are provided so that both upper and lower end portions near the secondary air input port 430 are removed. Then, the two split members disposed in the left and right direction may be provided so as to reach both left and right end portions of the coal primary port 422. Likewise, various configurations may be selected.

That is, when four split members 424 are provided, the split members are disposed in a cross type so that the split members are disposed in a lattice shape in two different directions of the up and down direction and the left and right direction, so that the outlet opening portion of the coal primary port 422 of the pulverized coal burner 421 is finely divided (into nine segments). Further, a pressure loss is large in a portion sandwiched by the split members 424, and the flow velocity of the ejection port decreases, so that the inner ignition is further promoted.

Furthermore, for example, regarding the up and down direction of the split member 424, the removal portion (the removing portion 424*a*) may not be positioned to the split member 424 in the left and right direction. Further, since the end portion of the split member 424 may suppress the ignition at the outer peripheral portion by the removal at the front side thereof, a structure is desirable in which the outer periphery is not equipped with the flame stabilizer.

Further, the removing portion 424*a* may be provided in a direction in which the secondary air amount increases, that is, the secondary air input port 430 is provided near the outer periphery (the upper and lower sides) of the coal secondary port 423.

In the solid-fuel-combustion burner 420 with such a configuration, the split member 424 that is provided near the center of the outlet opening of the pulverized coal burner 421 divides the passage of the pulverized coal and the air so as to disturb the flow therein, and forms the recirculation zone at the front side (downstream side) of the split member 424. Thus, the split member serves as an inner flame stabilization mechanism.

In general, the conventional solid-fuel-combustion burner 420 ignites the pulverized coal of the fuel by the radiation of the outer periphery of the flame. When the pulverized coal is ignited by the outer periphery of the flame, NOx is produced in the hot oxygen remaining zone H (see FIG. 33(*b*)) of the outer periphery of the flame where hot oxygen remains, and hence the NOx discharge amount increase while the reduction is not sufficiently performed.

However, since the split member 424 serving as the inner flame stabilization mechanism is provided, the pulverized coal is ignited at the inside of the flame. For this reason, NOx is produced at the inside of the flame, and the NOx produced at the inside of the flame contains a large amount of hydrocarbons having a reduction action. For this reason, the reduction is promptly performed inside the flame which does not have sufficient air. Accordingly, the solid-fuel-combustion burner 420 is provided in a structure in which the flame stabilization performed by the flame stabilizer at the outer periphery of the flame is stopped, that is, the flame stabilizing mechanism is not provided at the outer periphery of the burner by forming the removing portion 424*a*, and hence the production of NOx at the outer periphery of the flame may be suppressed.

Particularly, when a cross type is employed in which the split members 424 are disposed in a plurality of directions, the intersection portion obtained by intersecting the split members 424 in different directions may be easily provided near the center of the outlet opening of the pulverized coal burner 421. When the intersection portion exists near the center of the outlet opening of the pulverized coal burner 421, the passage of the pulverized coal and the air is divided into plural segments near the center of the outlet opening of the pulverized coal burner 421, and hence the flow is disturbed when the flow is divided into plural flows.

That is, when the split members 424 exist in one direction of the left and right direction, the dispersion or the ignition of the air at the center portion is delayed, so that a zone exists in which air is locally and extremely insufficient. Thus, the unburned combustible content increases. However, in a cross type in which the intersection portion is formed by disposing the split members 424 in a plurality of directions, the mixing of the air at the inside of the flame is promoted and the ignition surface is finely divided. As a result, the unburned combustible content may be reduced.

In other words, when the split members 424 are disposed so as to form the intersection portion, the mixing and the dispersion of the air are promoted to the inside of the flame, so that the ignition surface is finely divided. Thus, the ignition position exists near the center portion (the axis center portion) of the flame, and hence the unburned combustible content of the pulverized coal is reduced. That is, since oxygen easily enters the center portion of the flame, the inner ignition is effectively performed. Accordingly, the reduction is promptly performed at the inside of the flame, and hence the NOx production amount is reduced.

As a result, it is possible to more easily suppress the production of NOx at the outer periphery of the flame by using the solid-fuel-combustion burner 420 that does not have the flame stabilizer at the outer periphery of the flame by stopping the flame stabilization using the flame stabilizer provided at the outer periphery of the flame.

In the split members 424 disposed in a plurality of directions, in the embodiment, it is desirable to remove a plurality of end portions adjacent to the coal secondary port 423 at the outer peripheral side of the split member 424, that is, at least a part of left and right end portions.

In a first modified example of the configuration example illustrated in FIG. 33(*a*), as described above, both upper and lower end portions as the outer peripheral side of the split member 424 in the up and down direction are removed. That is, in the outer peripheral zone formed by removing both upper and lower end portions of the split member 424, the split member 424 does not exist, and the distance from the split member 424 to the coal secondary port 423 and the secondary air input port 430 increases. Furthermore, in the cross type split member 424, the outer peripheral ignition occurs even at both left and right end portions in the horizontal direction. However, in the turning combustion, the amount of the secondary air blowing to the periphery of the flame from the left and right direction is limited. For this reason, in the embodiment, the ignition surface is ensured by leaving both left and right end portions.

As a result, in the outer peripheral side zones of both upper and lower end portions without the split member 424, the ignition using the split member 424 as the ignition source does not occur. Meanwhile, at the center portion side of the split member 424 as the inside of the flame, the flame stabilizing function may be effectively used. Accordingly, in both upper and lower end portion side zones that easily and directly interfere with the secondary air due to the close distance with respect to the secondary air input port 430 that inputs a large amount of the secondary air, the ignition does not easily occurs. For this reason, it is possible to prevent or suppress a zone with a high temperature and a high oxygen concentration at the outer periphery of the flame. That is, the split member 424 that is obtained by removing both upper and lower end portions adjacent to the coal secondary port 423 and the secondary air input port 430 may strengthen the ignition inside the pulverized coal burner 420, and prevent a hot oxygen zone at the outer periphery of the flame, that is, the hot oxygen zones at the upper and lower ends of the flame.

Incidentally, the removal of the end portion of the split member 424 is not limited to the first modified example.

In a second modified example, two split members 424 are disposed in each of the up and down direction and the left and right direction. In this case, as in the above-described embodiment, both upper and lower end portions near the coal secondary port 423 and the secondary air input port 430 are removed in the split member 424 in the up and down direction. The split member 424 may be one or three or more.

In a third modified example, three split members 424 are disposed in each of the up and down direction and the left and right direction. In the split member 424 in the up and down direction of the modified example, both upper and lower end portions near the coal secondary port 423 and the secondary air input port 430 of only one split member disposed at the center portion is removed. Furthermore, in the split member 424 disposed in the up and down direction, that is, the split member 424 in the up and down direction of which both upper and lower end portions are not removed, it is desirable to decrease the ignition surface area by further narrowing the splitter widths W of both upper and lower end portions or the entire portion.

In this way, in the solid-fuel-combustion burner 420 for the turning combustion boiler in which the coal secondary port 423 and the secondary air input port 430 are disposed near the upper and lower sides of the pulverized coal burner 421, when the cross type split member 424 of which at least a part of both upper and lower end portions are removed is provided, it is possible to prevent or suppress a zone with a high temperature and a high oxygen concentration from being formed particularly at the upper and lower end portions easily and directly interfering with the secondary air.

When the hot oxygen remaining zone formed at the outer periphery of the flame is suppressed in this way, the NOx produced inside the flame generated by the pre-mixture combustion is effectively reduced. Accordingly, it is possible to decrease the NOx amount of NOx finally discharged from the AA part 414 due to a decrease in the NOx amount reaching the AA part 414 or a decrease in the NOx amount produced by the input of the additional air.

Further, in a fourth modified example, three or more cross type split members 424 are disposed in at least one of the up and down direction and the left and right direction, and the end portions are removed except for at least one split member disposed at the center portion in the up and down direction and the left and right direction.

That is, in the fourth modified example, the configuration in which three split members 424 are disposed in each of the up and down direction and the left and right direction is the same as those of the second modified example and the third modified example. However, in the modified example, one split member 424 disposed at the center portion in the up and down direction and the left and right direction is provided so as to reach the end portion, and all end portions in the up and down direction and the left and right direction of the split member 424 disposed at both end portions are removed.

In this way, in a case of the split member 424 of the fourth modified example, a structure is formed in which the split member 424 does not exist at the outer peripheral portion except for the center portion in the up and down direction and the left and right direction, and hence the split member 424 does not exist in a zone which contributes the outer peripheral combustion the most. For this reason, the split member 424 of the configuration example like the fourth modified example effectively prevents the outer peripheral ignition in which the split member 424 becomes the ignition source.

Further, for example, like the fifth modified example, in the split member 424 of the embodiment, at least a part of both left and right end portions which may become the outer peripheral ignition source may be removed if necessary.

That is, in the cross type split member 424 serving as the flame stabilizer, the outer peripheral ignition may be generated even at both left and right end portions in the horizontal direction. Accordingly, the structure in which all end portions in the up and down direction and the left and right direction are removed may effectively and completely prevent the outer ignition. Particularly, when the secondary air input port is provided at the left and right sides of the pulverized coal burner 421, it is desirable to remove both left and right end portions so as to reduce the ignition source due to the same reason as that of the above-described upper and lower secondary air input ports 430.

Sixteenth Embodiment

Next, a solid-fuel-combustion burner that is applied to a opposed wall-fired boiler according to a sixteenth embodiment of the invention will be described.

In the solid-fuel-combustion burner of the embodiment, a plurality of concentric secondary air input ports are provided at the outer periphery of the coal primary port having a circular cross-section. The secondary air input port is formed as, for example, two stages with an inner secondary air input port and an outer secondary air input port, but the invention is not limited thereto.

Further, the center portion of the outlet of the coal primary port is equipped with a plurality of split members (for example, four split members disposed in the vertical direction and the horizontal direction in total) that are disposed in a lattice shape in two different directions. In this case, the split members may be disposed by the number, the arrangement, and the cross-sectional shape described in a fifteenth embodiment. However, since the shape is particularly circular, it is desirable to remove the end portion in the entire circumference. Alternatively, a configuration may be employed in which a circular split member is provided and plural radial split members are disposed inside the circular shape so as to divide the circular circumferential direction into plural segments. In this case, the circular split members may have plural concentric circles.

According to the solid-fuel-combustion burner and the solid-fuel-combustion boiler of the embodiment, it is possible to reduce the final NOx production amount of NOx discharged from the AA part 414 by suppressing the hot oxygen remaining zone H formed at the outer periphery of the flame.

Furthermore, the invention is not limited to the above-described embodiments. For example, the pulverized solid fuel is not limited to the pulverized coal, and may be appropriately modified without departing from the spirit of the invention.

Seventeenth Embodiment

In the pulverized-coal-combustion boiler, the pulverized coal (coal) is used as the solid fuel. In this case, the coal contains moisture or a volatile content, and the amount of moisture changes in accordance with the type thereof. For this reason, there is a need to control the operation of the boiler in response to the volatile content or the moisture contained in the coal.

As the control of the operation of the boiler in consideration of the volatile content of the coal, for example, the control disclosed in Patent Literatures above is known. In the pulverized coal burner and the boiler using the same disclosed in Patent Literature 5, there are provided the pulverized coal fuel-air mixture passage that ejects the pulverized coal fuel-air mixture obtained by mixing the pulverized coal with the transportation air and the hot gas supply passage that ejects a hot gas with a low oxygen concentration at a high temperature effective for the discharge of the volatile content of the pulverized coal. Further, in the coal-combustion boiler disclosed in Patent Literature 6, there are provided a temperature detector that detects the temperature of the primary air for supplying the pulverized coal to the coal-combustion boiler, the primary air temperature adjusting unit that adjusts the temperature of the primary air, and the control device that controls the primary air temperature adjusting unit so that the temperature of the primary air becomes a predetermined temperature based on the detection result of the temperature detector.

In the conventional boiler, the entire pulverized coal is heated so as to adjust the moisture or the volatile content, and is burned inside the furnace. In this case, the operation parameter needs to be adjusted based on the operation output of the boiler, and it is difficult to directly set the operation parameter based on the characteristics of the coal.

The invention is made to solve the above-described problems, and it is an object of the invention to provide a boiler and a method for operating the boiler capable of improving an operation efficiency by appropriately burning solid fuel and a volatile content contained in the solid fuel.

Figure 39:
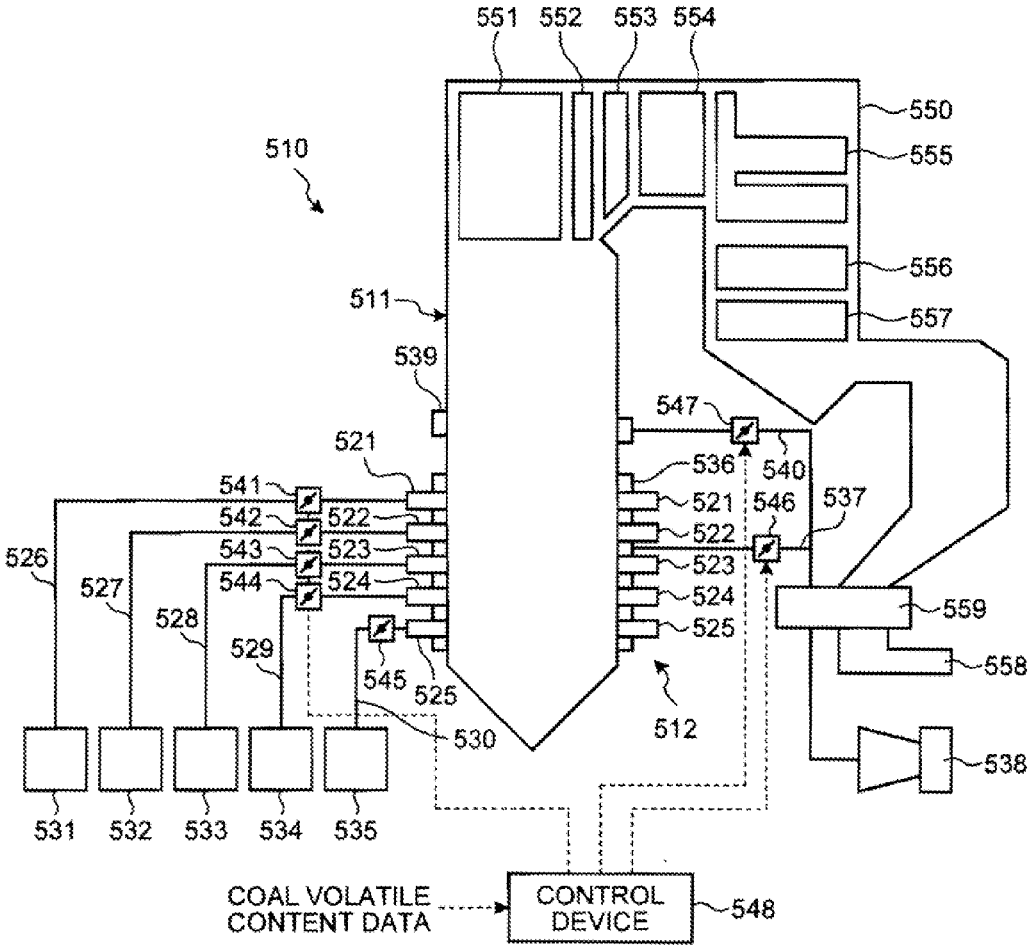
FIG. 39 is a schematic configuration diagram illustrating a pulverized-coal-combustion boiler as a boiler according to a seventeenth embodiment of the invention.
Figure 40:
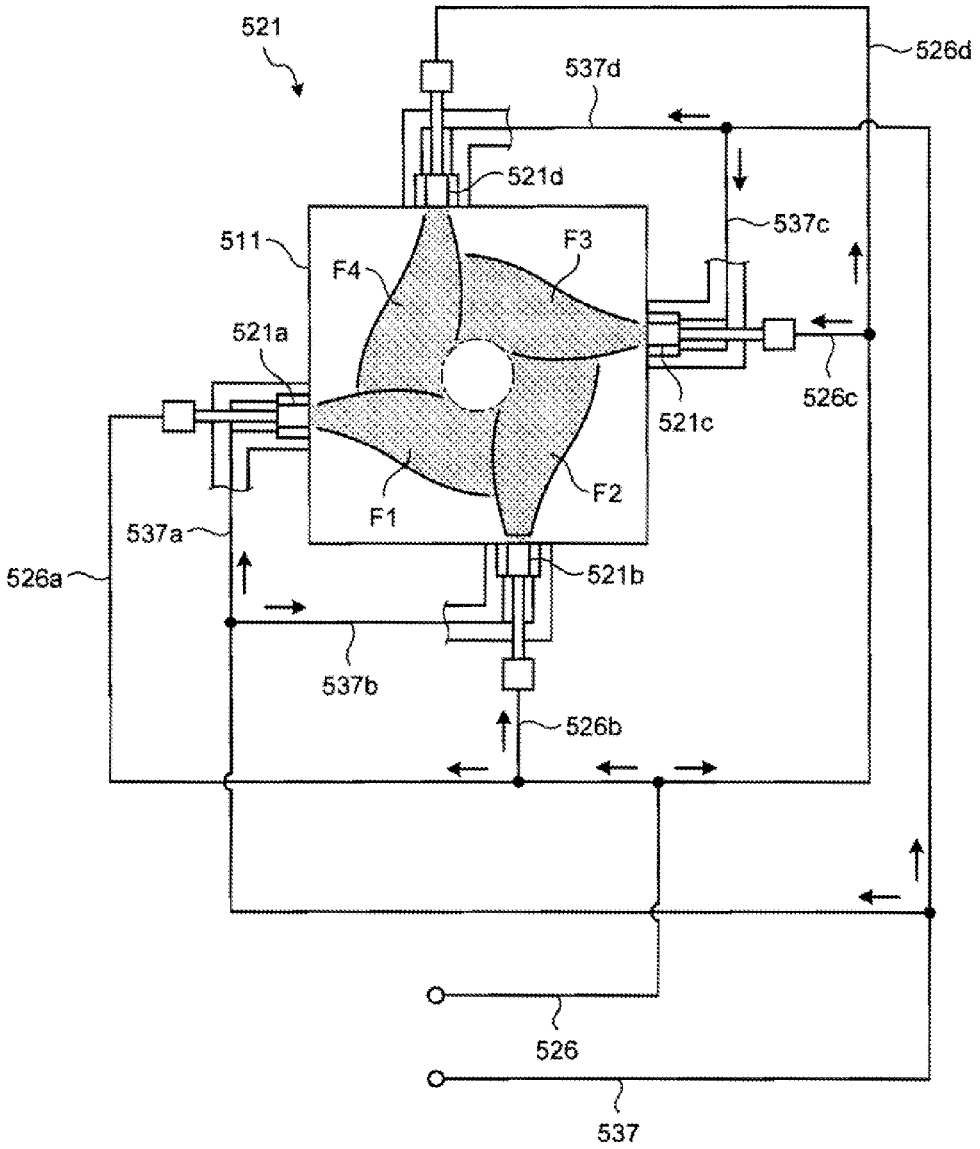
FIG. 40 is a plan view illustrating a combustion burner of the pulverized-coal-combustion boiler of the seventeenth embodiment.
Figure 41:
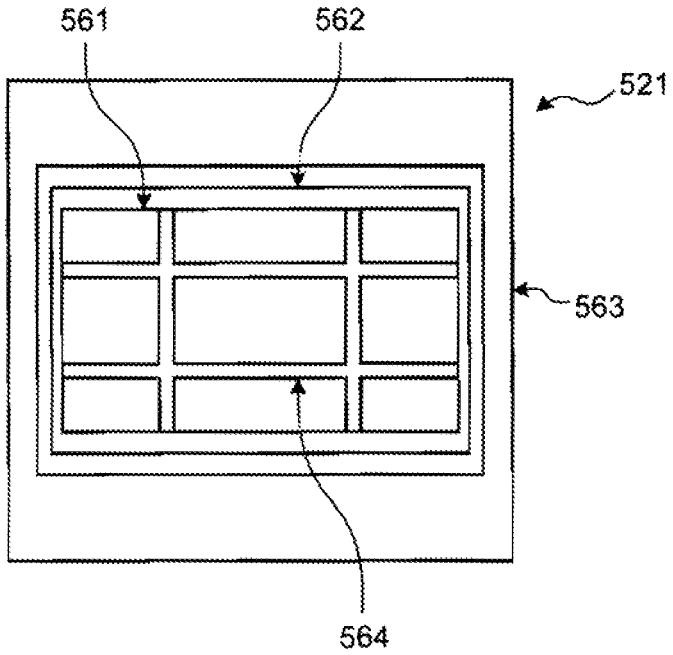
FIG. 41 is a front view illustrating the combustion burner of the seventeenth embodiment.
Figure 42:
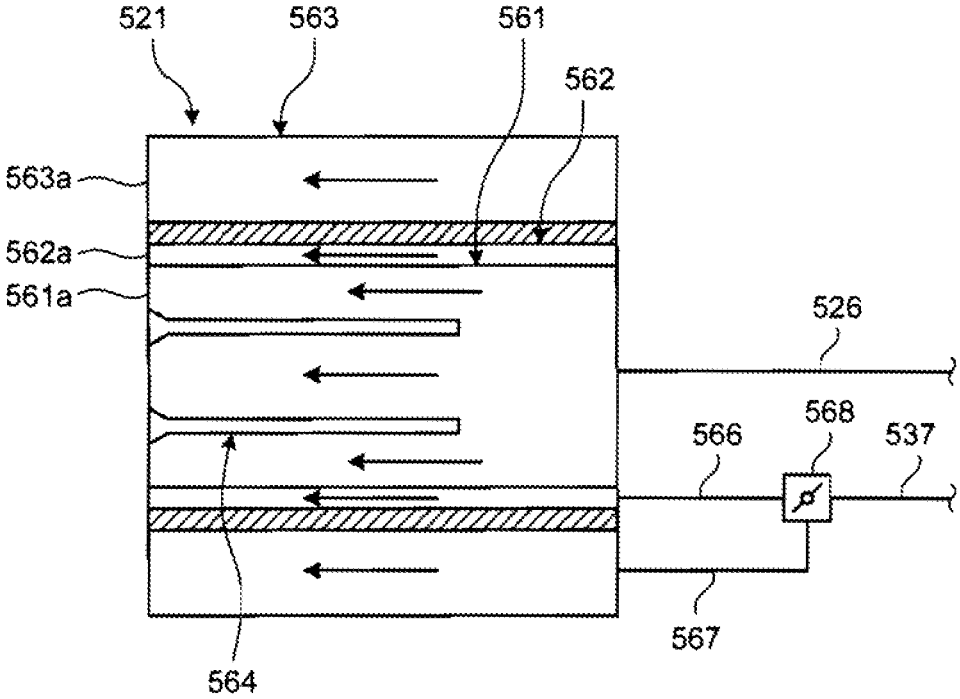
FIG. 42 is a cross-sectional view illustrating the combustion burner of the seventeenth embodiment.
Figure 43:
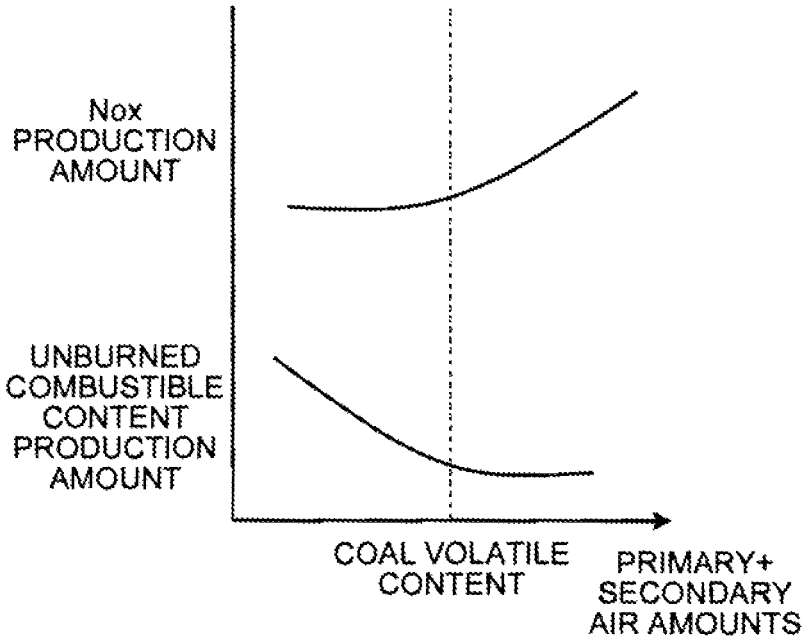
FIG. 43 is a graph illustrating a NOx production amount and an unburned combustible content production amount with respect to primary air and secondary air.

FIG. 39 is a schematic configuration diagram illustrating a pulverized-coal-combustion boiler as a boiler according to a seventeenth embodiment of the invention, FIG. 40 is a plan view illustrating a combustion burner of the pulverized-coal-combustion boiler of the seventeenth embodiment, FIG. 41 is a front view illustrating the combustion burner of the seventeenth embodiment, FIG. 42 is a cross-sectional view illustrating the combustion burner of the seventeenth embodiment, and FIG. 43 is a graph illustrating a NOx production amount and an unburned combustible content production amount with respect to the primary air and the secondary air.

The pulverized-coal-combustion boiler that employs the combustion burner of the seventeenth embodiment is a boiler capable of collecting the heat generated by the combustion by burning the pulverized coal obtained by milling the coal as the solid fuel and burning the pulverized coal through the combustion burner.

In the embodiment, as illustrated in FIG. 39, a pulverized-coal-combustion boiler 510 is a conventional boiler, and includes a furnace 511 and a combustion device 512. The furnace 511 is formed in a hollow square cylindrical shape, and is provided in the vertical direction. Then, the combustion device 512 is provided in the lower portion of the furnace wall forming the furnace 511.

The combustion device 512 includes plural combustion burners 521, 522, 523, 524, and 525 which are attached to the furnace wall. In the embodiment, the combustion burners 521, 522, 523, 524, and 525 are disposed as one set in the circumferential direction at four equal intervals therebetween, and five sets, that is, five stages are disposed in the vertical direction.

Then, the respective combustion burners 521, 522, 523, 524, and 525 are connected to coal pulverizers (mills) 531, 532, 533, 534, and 535 through pulverized coal supply pipes 526, 527, 528, 529, and 530. Although not illustrated in the drawings, the coal pulverizers 531, 532, 533, 534, and 535 have a configuration in which milling tables are supported in a rotational driving state with rotation axes along the vertical direction inside a housing and plural milling rollers are provided while facing the upper sides of the milling tables and are supported so as to be rotatable along with the rotation of the milling tables. Accordingly, when coal is input between plural milling rollers and plural milling tables, the coal is milled into a predetermined size therein. Thus, pulverized coal which is classified by transportation air (primary air) may be supplied from pulverized coal supply pipes 526, 527, 528, 529, and 530 to the combustion burners 521, 522, 523, 524, and 525.

Further, in the furnace 511, wind boxes 536 are provided at the attachment positions of the respective combustion burners 521, 522, 523, 524, and 525, where one end portion of an air duct 537 is connected to the wind box 536 and an air blower 538 is attached to the other end portion of the air duct 537. Moreover, in the furnace 511, an additional air nozzle 539 is provided above the attachment positions of the respective combustion burners 521, 522, 523, 524, and 525, and an end portion of an air duct 540 branched from the air duct 537 is connected to the additional air nozzle 539. Accordingly, the combustion air (the secondary air and the tertiary air) sent from the air blower 538 is supplied from the air duct 537 to the wind box 536 so as to be supplied from the wind boxes 36 to the respective combustion burners 521, 522, 523, 524, and 525 and to be supplied from the branched air duct 540 to the additional air nozzle 539.

For this reason, in the combustion device 512, the respective combustion burners 521, 522, 523, 524, and 525 may blow a pulverized fuel-air mixture (fuel gas) obtained by mixing pulverized coal and primary air into the furnace 511 and may blow secondary air and tertiary air into the furnace 511. Then, a flame may be formed by igniting the pulverized fuel-air mixture through an ignition torch (not illustrated).

Further, the pulverized coal supply pipes 526, 527, 528, 529, and 530 are equipped with flowrate adjustment valves 541, 542, 543, 544, and 545 capable of adjusting the pulverized fuel-air mixture amount, the air duct 537 is equipped with a flowrate adjustment valve 546 capable of adjusting the amount of the combustion air (the secondary air and the tertiary air), and the branched air duct 540 is equipped with a flowrate adjustment valve 547 capable of adjusting the additional air amount. Then, a control device 548 may adjust the opening degrees of the respective flowrate adjustment valves 541, 542, 543, 544, 545, 546, and 547. In this case, the pulverized coal supply pipes 526, 527, 528, 529, and 530 may not be equipped with the flowrate adjustment valves 541, 542, 543, 544, and 545.

Furthermore, when generally activating the boiler, the respective combustion burners 521, 522, 523, 524, and 525 form a flame by ejecting oil fuel into the furnace 511.

A flue gas duct 550 is connected to the upper portion of the furnace 511, and the flue gas duct 550 is equipped with superheaters 551 and 552, repeaters 553 and 554, and economizers 555, 556, and 557 as convection heat transfer portions for collecting the heat of the flue gas. Accordingly, a heat exchange is performed between water and a flue gas that is produced by the combustion in the furnace 511.

The downstream side of the flue gas duct 550 is connected with a flue gas pipe 558 into which the flue gas subjected to the heat exchange is discharged. An air heater 559 is provided between the flue gas pipe 558 and the air duct 557, and a heat exchange is performed between the air flowing through the air duct 537 and the flue gas flowing through the flue gas pipe 558, so that the temperature of the combustion air supplied to the combustion burners 521, 522, 523, 524, and 525 may be increased.

Furthermore, although not illustrated in the drawings, the flue gas pipe 558 is equipped with a denitration device, an electronic precipitator, an inducing air blower, and a desulfurization device, and the downstream end portion thereof is equipped with a stack.

Accordingly, when the coal pulverizers 531, 532, 533, 534, and 535 are driven, pulverized coal produced therein is supplied along with the transportation air to the combustion burners 521, 522, 523, 524, and 525 through the pulverized coal supply pipes 526, 527, 528, 529, and 530. Further, the heated combustion air is supplied from the air duct 537 to the respective combustion burners 521, 522, 523, 524, and 525 through the wind boxes 536, and is supplied from the branched air duct 540 to the additional air nozzle 539. Then, the combustion burners 521, 522, 523, 524, and 525 blow the pulverized fuel-air mixture obtained by mixing the pulverized coal, the transportation air to the furnace 511 and blow the combustion air to the furnace 511, and ignite the pulverized fuel-air mixture and the air at this time so as to form a flame. Further, the additional air nozzle 539 may perform the combustion control by blowing the additional air to the furnace 511. In the furnace 511, when a flame is generated by the combustion of the pulverized fuel-air mixture and the combustion air and the flame is generated at the lower portion inside the furnace 511, the combustion gas (the flue gas) rises inside the furnace 511, and is discharged to the flue gas duct 550.

Furthermore, the inside of the furnace 511 is maintained at the reduction atmosphere in a manner such that the air supply amount with respect to the pulverized coal supply amount becomes smaller than the theoretical air amount. Then, when NOx produced by the combustion of the pulverized coal is reduced in the furnace 511 and additional air is additionally supplied thereto, the oxidization combustion of the pulverized coal is completed and hence the production amount of NOx caused by the combustion of the pulverized coal is reduced.

At this time, water supplied from a water feeding pump (not illustrated) is preheated by the economizers 555, 556, and 557, is supplied to a steam drum (not illustrated), and heated while being supplied to the respective water pipes (not illustrated) of the furnace wall so as to become saturated steam. Then the saturated steam is transported to a steam drum (not illustrated). Further, the saturated steam of the steam drum (not illustrated) is introduced into the superheaters 551 and 552 and is superheated by the combustion gas. The superheated steam produced by the superheaters 551 and 552 is supplied to a power generation plant (not illustrated) (for example, a turbine or the like). Further, the steam which is extracted during the expanding process in the turbine is introduced into the repeaters 553 and 554, is superheated again, and is returned to the turbine. Furthermore, the furnace 511 of a drum type (steam drum) has been described, but the invention is not limited to the structure.

Subsequently, a harmful substance such as NOx is removed from the flue gas which passes through the economizers 555, 556, and 557 of the flue gas duct 550 by a catalyst of a denitration device (not illustrated) in the flue gas pipe 558, a particulate substance is removed therefrom by the electronic precipitator, and a sulfur content is removed therefrom by the desulfurization device. Then, the flue gas is discharged to the atmosphere through the stack.

Here, the combustion device 512 will be described in detail, but since the respective combustion burners 521, 522, 523, 524, and 525 constituting the combustion device 512 have substantially the same configuration, only the combustion burner 521 that is positioned at the uppermost stage will be described.

As illustrated in FIG. 40, the combustion burner 521 includes the combustion burners 521*a*, 521*b*, 521*c*, and 521*d* which are provided at four wall surfaces of the furnace 511. The respective combustion burners 521*a*, 521*b*, 521*c*, and 521*d* are connected with respective branch pipes 526*a*, 526*b*, 526*c*, and 526*d* which are branched from a pulverized coal supply pipe 526, and are connected with respective branch pipes 537*a*, 537*b*, 537*c*, and 537*d* branched from the air duct 537.

Accordingly, the respective combustion burners 521*a*, 521*b*, 521*c*, and 521*d* which are positioned at the respective wall surfaces of the furnace 511 blow the pulverized fuel-air mixture obtained by mixing the pulverized coal and the transportation air to the furnace 511 and blow the combustion air to the outside of the pulverized fuel-air mixture. Then, the pulverized fuel-air mixture is ignited from the respective combustion burners 521*a*, 521*b*, 521*c*, and 521*d*, so that four flames F1, F2, F3, and F4 may be formed. The flames F1, F2, F3, and F4 become a flame swirl flow that turns in the counter-clockwise direction when viewed from the upside of the furnace 511 (in FIG. 40).

As illustrated in FIGS. 41 and 42, in the combustion burner 521 (521*a*, 521*b*, 521*c*, 521*d*) with such a configuration, the combustion burner is equipped a fuel nozzle 561, a secondary air nozzle 562, and a tertiary air nozzle 563 from the center side thereof and is equipped with a flame stabilizer 564. The fuel nozzle 561 may blow the fuel gas (the pulverized fuel-air mixture) obtained by mixing the pulverized coal (the solid fuel) with the transportation air (the primary air). The secondary air nozzle 562 is disposed at the outside of the first nozzle 561 and may blow the combustion air (the secondary air) to the outer peripheral side of the fuel gas ejected from the fuel nozzle 561. The tertiary air nozzle 563 is disposed at the outside of the secondary air nozzle 562, and may blow the tertiary air to the outer peripheral side of the secondary air ejected from the secondary air nozzle 562.

Further, the flame stabilizer 564 is disposed inside the fuel nozzle 561 so as to be positioned at the downstream side of the fuel gas blowing direction and near the axis center, and serves to ignite and stabilize the fuel gas. The flame stabilizer 564 is formed in a so-called double cross split structure in which two flame stabilizing members following the horizontal direction and two flame stabilizing members following the vertical direction (the up and down direction) are disposed in a cross shape. Then, in the flame stabilizer 564, the widened portions are formed in the front end portions of the respective flame stabilizing members (the downstream end portions in the fuel gas flowing direction).

For this reason, each of the fuel nozzle 561 and the secondary air nozzle 562 has an elongated tubular shape, the fuel nozzle 561 includes a rectangular opening portion 561*a*, and the secondary air nozzle 562 includes a rectangular annular opening portion 562*a*. Thus, the fuel nozzle 561 and the secondary air nozzle 562 are formed in a double tube structure. the tertiary air nozzle 563 is disposed as a double tube structure at the outside of the fuel nozzle 561 and the secondary air nozzle 562, and includes a rectangular annular opening portion 563*a*. As a result, the opening portion 562*a* of the secondary air nozzle 562 is disposed at the outside of the opening portion 561*a* of the fuel nozzle 561, and the opening portion 563*a* of the tertiary air nozzle 563 is disposed at the outside of the opening portion 562*a* of the secondary air nozzle 562.

In the nozzles 561, 562, and 563, the opening portions 561*a*, 562*a*, and 563*a* are disposed so as to be flush with one another. Further, the flame stabilizer 564 is supported by the inner wall surface of the fuel nozzle 561 or a plate member (not illustrated) from the upstream side of the passage through which the fuel gas flows. Further, since plural flame stabilizing members are disposed as the flame stabilizer 564 inside the fuel nozzle 561, the fuel gas passage is divided into nine segments. Then, in the flame stabilizer 564, the widened portion of which the width is wide is positioned at the front end portion thereof, and the front end surface of the widened portion is disposed so as to be flush with the opening portion 561*a*.

Further, in the combustion burner 521, the fuel nozzle 561 is connected to the pulverized coal supply pipe 526 from the coal pulverizer 531. The secondary air nozzle 562 is connected with one connection duct 566 branched from the air duct 537 from the air blower 538, and the tertiary air nozzle 563 is connected with the other connection duct 567 branched from the air duct 537. A flowrate adjustment valve (a three-way valve or a damper) 568 is attached to the branch portions of the respective connection ducts 566 and 567 from the air duct 537. Then, the control device 548 (see FIG. 39) may adjust the opening degree of the flowrate adjustment valve 568, and may adjust the distribution of the air to the respective connection ducts 566 and 567.

Accordingly, in the combustion burner 521, the fuel gas obtained by mixing the pulverized coal with the primary air blows from the opening portion 561*a* of the fuel nozzle 561 into the furnace, the secondary air blows from the opening portion 562*a* of the secondary air nozzle 562 to the outside thereof, and the tertiary air blows from the opening portion 563*a* of the tertiary air nozzle 563 to the outside thereof. At this time, the fuel gas is branched at the opening portion 561*a* of the fuel nozzle 561 by the flame stabilizer 564, and is ignited and burned so as to become a fuel gas. Further, since the secondary air blows to the outer periphery of the fuel gas, the combustion of the fuel gas is promoted. Further, since the tertiary air blows to the outer periphery of the combustion flame, the outer peripheral portion of the combustion flame is cooled.

Then, since the flame stabilizer 564 is formed in a split shape in the combustion burner 521, the fuel gas is divided by the flame stabilizer 564 at the opening portion 561*a* of the fuel nozzle 561. At this time, the flame stabilizer 564 is disposed at the center zone of the opening portion 561*a* of the fuel nozzle 561, and the fuel gas is ignited and stabilized at the center zone. Thus, the inner flame stabilization of the combustion flame (the flame stabilization at the center zone of the opening portion 561*a* of the fuel nozzle 561) is realized.

For this reason, compared to the configuration in which the outer flame stabilization of the combustion flame is performed, the temperature of the outer peripheral portion of the combustion flame becomes low, and hence the temperature of the outer peripheral portion of the combustion flame under the high oxygen atmosphere by the secondary air may become low. Thus, the NOx production amount at the outer peripheral portion of the combustion flame is reduced.

Further, since the combustion burner 521 employs a configuration in which the inner flame stabilization is performed, it is desirable to supply the fuel gas and the combustion air (the secondary air and the tertiary air) as a straight flow. That is, it is desirable that the fuel nozzle 561 have a structure in which the secondary air nozzle 562 and the tertiary air nozzle 563 supply the fuel gas, the secondary air, and the tertiary air as a straight flow instead of a swirl flow. Since the fuel gas, the secondary air, and the tertiary air are ejected as the straight flow so as to form the combustion flame, the circulation of the gas inside the combustion flame is suppressed in the configuration in which the inner flame stabilization of the combustion flame is performed. Accordingly, the outer peripheral portion of the combustion flame is maintained in a low temperature, and the NOx production amount caused by the mixture with the secondary air is reduced.

Incidentally, in the pulverized-coal-combustion boiler 510 of the embodiment, the pulverized coal (coal) is used as the solid fuel, and the pulverized coal contains the volatile content. Accordingly, the combustion state becomes different due to the volatile content.

Therefore, in the pulverized-coal-combustion boiler 510 of the embodiment, as illustrated in FIGS. 39 and 42, since the control device 548 may adjust the fuel gas amount, the secondary air amount, the tertiary air amount, and the additional air amount by changing the opening degrees of the respective flowrate adjustment valves 541, 542, 543, 544, 545, 546, 547, and 568, the fuel gas amount, the secondary air amount, the tertiary air amount, and the additional air amount are adjusted in response to the volatile content of the pulverized coal.

In this case, it is desirable that the control device 548 adjust the distribution of the total air amount of the primary air and the secondary air and the air amount of the additional air in response to the volatile content of the pulverized coal. Specifically, the distribution of the total air amount of the primary air and the secondary air and the total air amount of the tertiary air and the additional air is adjusted.

In the embodiment, since the primary air amount and the additional air amount are predetermined air amounts, the control device 548 adjusts the distribution of the secondary air and the tertiary air in response to the volatile content of the pulverized coal. Then, the control device 548 increases the distribution of the secondary air when the volatile content of the pulverized coal increases.

That is, since the fuel nozzle 561 blows the fuel gas obtained by mixing the pulverized coal with the primary air into the furnace 511 and the primary air is the transportation air for the pulverized coal, the distribution of the primary air and the pulverized coal of the fuel gas, that is, the primary air amount is determined by the coal pulverizers 531, 532, 533, 534, and 535. Further, the additional air nozzle 539 performs oxidization combustion by inputting the combustion air to the combustion performed by the combustion burners 521, 522, 523, 524, and 525 to thereby completely perform the combustion. Here, since the additional air from the additional air nozzle 539 strengthens the reduction atmosphere in the main combustion zone and reduces the NOx discharge amount, the additional air amount for each boiler is determined.

Meanwhile, the secondary air nozzle 562 is used to blow the air as the secondary air passing from the air duct 537 to the connection duct 566 into the furnace 11, and the air is mainly used as the combustion air which is burned while being mixed with the fuel gas blowing from the fuel nozzle 561. The tertiary air nozzle 563 is used to blow the air as the tertiary air passing from the air duct 537 to the connection duct 566 into the furnace 511, and the air is mainly used as the additional air with respect to the combustion flame as in the additional air nozzle 359.

For this reason, the control device 548 changes the opening degree of the flowrate adjustment valve 568 so as to adjust the distribution of the total air amount of the primary air and the secondary air and the total air amount of the tertiary air and the additional air, that is, the distribution of the air amounts of the secondary air and the tertiary air, and hence handle a change in the volatile content of the pulverized coal. Here, when the volatile content of the pulverized coal increases, the control device 548 decreases the tertiary air amount and increases the secondary air amount so as to change the distribution of the secondary air and the tertiary air.

Here, as illustrated in FIG. 43, when the total air amount of the primary air and the secondary air increases, the NOx production amount increases and the unburned combustible content production amount decreases. That is, in the combustion burners 521, 522, 523, 524, and 525, the volatile content of the pulverized coal is mainly burned at the ignition portion (the vicinity of the opening portion 551*a* of the fuel nozzle 551). Then, when the air amount therein excessively increases, the NOx production amount increases. On the other hand, when the air amount therein is not sufficient, the pulverized coal is not smoothly burned, and the unburned combustible content production amount increases. For this reason, in the combustion burners 521, 522, 523, 524, and 525, there is a need to set the air amount as the amount in which the NOx production amount and the unburned combustible content production amount are suppressed to be low in consideration of the volatile content of the pulverized coal at the ignition portion.

Furthermore, the volatile content of the pulverized coal is measured before the coal is input to the respective coal pulverizers 531, 532, 533, 534, and 535, and the volatile content is stored as data in the control device 548. Further, since the distribution ratio of the secondary air and the tertiary air with respect to the volatile content of the pulverized coal becomes different depending on the type of the boiler or the combustion types of the combustion burners 521, 522, 523, 524, and 525, the distribution ratio is set in advance by an experiment. For example, a map is prepared, and is stored in the control device 548.

Accordingly, in the combustion burners 521, 522, 523, 524, and 525, the fuel gas blows from the fuel nozzle 561 to the furnace 511, the secondary air blows from the secondary air nozzle 562 to the furnace, and the tertiary air blows from the tertiary air nozzle 563 to the furnace. At this time, the fuel gas is ignited and burned by the flame stabilizer 564, and is further burned while being mixed with the secondary air. At this time, the main combustion zone is formed inside the furnace 511. Then, since the tertiary air blows from the tertiary air nozzle 563 to the main combustion zone, the outer peripheral portion of the combustion flame is cooled and the combustion thereof is promoted. Subsequently, the additional air nozzle 539 blows the additional air to the furnace 511 so as to perform the combustion control.

That is, in the furnace 511, the combustion gas which is obtained by the combustion of the fuel gas from the fuel nozzles 561 of the combustion burners 521, 522, 523, 524, and 525 and the secondary air from the secondary air nozzle 562 becomes less than a theoretical air amount, and the inside of the furnace is maintained at the reduction atmosphere. Then, the NOx which is produced by the combustion of the pulverized coal is reduced by the tertiary air. Subsequently, the oxidization combustion of the pulverized coal is completed by the additional air, and the NOx production amount caused by the combustion of the pulverized coal is reduced.

At this time, the control device 548 obtains the distribution ratio of the secondary air and the tertiary air in the combustion burners 521, 522, 523, 524, and 525 based on the volatile content of the pulverized coal measured in advance and the previously stored distribution ratio map of the secondary air and the tertiary air with respect to the volatile content of the pulverized coal, and sets the opening degree of the flowrate adjustment valve 568. Then, the control device 548 adjusts the opening degree of the flowrate adjustment valve 568 based on the set opening degree. Then, in the combustion burners 521, 522, 523, 524, and 525, the secondary air amount from the secondary air nozzle 562 and the tertiary air amount from the tertiary air nozzle 563 become optimal for the volatile content of the pulverized coal, and hence the pulverized coal and the volatile content are appropriately burned.

In this way, the boiler of the seventeenth embodiment includes the furnace 511 which burns the pulverized coal and the air, the superheaters 551 and 552 which collect heat by the heat exchange inside the furnace 511, the fuel nozzle 561 which is able to blow the fuel gas obtained by mixing the pulverized coal with the primary air to the furnace 511, the secondary air nozzle 562 which is able to blow the secondary air to the furnace 511, the tertiary air nozzle 563 which is able to blow the tertiary air to the furnace 511, the additional air nozzle 539 which is able to blow the additional air to the upper side of the fuel nozzle 561 and the secondary air nozzle 562 in the furnace 511, the flowrate adjustment valve 568 which performs the distribution of the secondary air amount and the tertiary air amount, and the control device 548 which controls the opening degree of the flowrate adjustment valve 568 in response to the volatile content of the pulverized coal.

Accordingly, since the control device 548 adjusts the distribution of the air amount of the secondary air nozzle 562 and the air amount of the tertiary air nozzle 563 by controlling the opening degree of the flowrate adjustment valve 568 in response to the volatile content of the pulverized coal, the secondary air amount and the tertiary air amount are adjusted in response to the volatile content of the pulverized coal. Accordingly, the volatile content of the pulverized coal may be appropriately burned, and the pulverized coal may be appropriately burned. Thus, the production of the NOx or the unburned combustible content may be suppressed, and hence the boiler operation efficiency may be improved. Further, the pulverized coal and the volatile content thereof may be appropriately burned while maintaining a predetermined fuel-air ratio.

Further, in the boiler of the seventeenth embodiment, the control device 548 increases the distribution of the secondary air when the volatile content of the pulverized coal increases. Since the secondary air is the combustion air which burns the pulverized coal while being mixed with the fuel gas, the distribution of the secondary air increases when the volatile content of the pulverized coal increases, so that the pulverized coal and the volatile content thereof may be appropriately burned.

Further, in the method for operating the boiler of the seventeenth embodiment, the distribution of the secondary air and the tertiary air is adjusted in response to the volatile content of the pulverized coal in the pulverized-coal-combustion boiler 510. Accordingly, the volatile content of the pulverized coal may be appropriately burned, and the pulverized coal may be appropriately burned. Thus, the production of the NOx or the unburned combustible content may be suppressed, and hence the boiler operation efficiency may be improved.

Furthermore, in the above-described embodiment, the distribution of the secondary air amount and the tertiary air amount is adjusted and the distribution of the secondary air increases when the volatile content of the pulverized coal increases. However, the invention is not limited to the configuration. For example, in the coal pulverizers 531, 532, 533, 534, and 535, the air amount (the transportation air amount) may be increased or decreased or the additional air amount may be increased or decreased.

Further, the boiler of the invention is not limited to the configuration of the pulverized-coal-combustion boiler 510 or the configuration or the number of the combustion burners 521, 522, 523, 524, and 525.

Further, in the above-described embodiment, as the combustion device 512, four combustion burners 521, 522, 523, 524, and 525 respectively provided in the wall surface of the furnace 511 are disposed as a five stages in the vertical direction, but the configuration is not limited thereto. That is, the combustion burner may be disposed at the corner instead of the wall surface. Further, the combustion device is not limited to the turning combustion type, and may be a front combustion type in which the combustion burner is disposed in one wall surface or an opposed combustion type in which the combustion burners are disposed in two wall surfaces so as to be opposed to each other.

REFERENCE SIGNS LIST

10 PULVERIZED-COAL-COMBUSTION BOILER
11 FURNACE
21, 22, 23, 24, 25 COMBUSTION BURNER
51, 111 FUEL NOZZLE
52, 112 SECONDARY AIR NOZZLE
53, 113 TERTIARY AIR NOZZLE
54, 71, 81, 91, 114, 121, 131, 161 FLAME STABILIZER
55, 75, 95, 101, 115, 135, 141, 151 RECTIFICATION MEMBER
210 PULVERIZED-COAL-COMBUSTION BOILER
211 FURNACE
221, 222, 223, 224, 225 COMBUSTION BURNER
251 FUEL NOZZLE
252 SECONDARY AIR NOZZLE
253 TERTIARY AIR NOZZLE
254, 291 FLAME STABILIZER
255, 271 GUIDE MEMBER
261, 262, 263, 264 FLAME STABILIZING MEMBER
261*c*, 262*c*, 263*c*, 264*c* NOTCHED SURFACE (GUIDE MEMBER)
281, 282, 283, 284 TRIANGULAR PLATE (GUIDE MEMBER)
297 DRIVING DEVICE
310 TURNING COMBUSTION BOILER
311 FURNACE
312 BURNER
314 ADDITIONAL AIR INPUT UNIT (AA PART)
320, 320A SOLID-FUEL-COMBUSTION BURNER
321 PULVERIZED COAL BURNER (FUEL BURNER)
322 COAL PRIMARY PORT
323 COAL SECONDARY PORT
324 SPLIT MEMBER
324V VERTICAL SPLITTER
324H HORIZONTAL SPLITTER
330 SECONDARY AIR INPUT PORT
340 DAMPER
350 TRIANGULAR PLATE (SHIELDING MEMBER)
350A TRIANGULAR PYRAMID (SHIELDING MEMBER)
410 TURNING COMBUSTION BOILER
411 FURNACE
412 BURNER
414 ADDITIONAL AIR INPUT UNIT (AA PART)
420 SOLID-FUEL-COMBUSTION BURNER
421 PULVERIZED COAL BURNER (FUEL BURNER)
422 COAL PRIMARY PORT
423 COAL SECONDARY PORT
424 SPLIT MEMBER
424*a* REMOVING PORTION
430 SECONDARY AIR INPUT PORT
440 DAMPER
510 PULVERIZED-COAL-COMBUSTION BOILER
511 FURNACE
521, 522, 523, 524, 525 COMBUSTION BURNER
537 AIR DUCT
539 ADDITIONAL AIR NOZZLE (ADDITIONAL AIR NOZZLE)
540 BRANCHED AIR DUCT
541, 542, 543, 544, 545, 546, 547, 568 FLOWRATE ADJUSTMENT VALVE (AIR AMOUNT ADJUSTING DEVICE)
548 CONTROL DEVICE
551, 552 SUPERHEATER (HEAT EXCHANGER)
553, 554 REHEATER (HEAT EXCHANGER)
555, 556, 557 ECONOMIZER (HEAT EXCHANGER)

561 FUEL NOZZLE
562 SECONDARY AIR NOZZLE
563 TERTIARY AIR NOZZLE

The invention claimed is:

1. A combustion burner that inputs pulverized solid fuel and air into a furnace, the combustion burner comprising:

a fuel burner that inputs pulverized fuel and primary air into the furnace; and a secondary port that ejects secondary air from the outer periphery of the fuel burner, wherein a split member as an inner flame stabilization member is disposed at a front side of a passage of the fuel burner, and a part of an end portion at the outer periphery of the split member adjacent to a wall of the fuel burner is removed, wherein a plurality of split members of the inner flame stabilization member are disposed in at least one direction, wherein three or more cross type split members are disposed in at least one of a first direction and a second direction, and the end portions of the cross type split members are removed except for at least one cross type split member disposed at a center portion in the at least one of the first direction and the second direction.

2. A combustion burner that inputs pulverized solid fuel and air into a furnace, the combustion burner comprising:

a fuel burner that inputs pulverized fuel and primary air into the furnace; and a secondary port that ejects secondary air from the outer periphery of the fuel burner, wherein a split member as an inner flame stabilization member is disposed at a front side of a passage of the fuel burner, and the split member is arranged such that there is a space between an end portion at the outer periphery of the split member and a wall of the fuel burner, wherein a plurality of split members of the inner flame stabilization member are disposed in at least one direction, wherein three or more cross type split members are disposed in at least one of a first direction and a second direction, and there is a space between the end portions of the cross type split members and a wall of the fuel burner except for at least one cross type split member disposed at a center portion in the at least one of the first direction and the second direction.

* * * * *